US008101250B2

(12) United States Patent
Haenen et al.

(10) Patent No.: US 8,101,250 B2
(45) Date of Patent: Jan. 24, 2012

(54) COATED PAPER FOR SHEET-FED OFFSET PRINTING

(75) Inventors: Jean-Pierre Haenen, Eysden (NL); Peter Resch, Vasoldsberg (AT); Bert Scholte, Sittard (NL)

(73) Assignee: Sappi Netherlands Services B.V., Maastricht (NL)

( * ) Notice: Subject to any disclaimer, the term of this patent is extended or adjusted under 35 U.S.C. 154(b) by 744 days.

(21) Appl. No.: 11/995,230

(22) PCT Filed: Jul. 12, 2006

(86) PCT No.: PCT/EP2006/064143

§ 371 (c)(1),
(2), (4) Date: Jul. 14, 2008

(87) PCT Pub. No.: WO2007/006794

PCT Pub. Date: Jan. 18, 2007

(65) Prior Publication Data

US 2009/0197005 A1 Aug. 6, 2009

(30) Foreign Application Priority Data

Jul. 13, 2005 (EP) ..... 05106427

(51) Int. Cl.
*B41M 5/40* (2006.01)

(52) U.S. Cl. ..... 428/32.21; 428/32.22; 428/32.27; 428/32.28; 428/32.32; 428/32.33; 428/32.35; 428/32.37; 427/243; 347/105

(58) Field of Classification Search ..... 428/32.21, 428/32.22, 32.27, 32.28, 32.32, 32.33, 32.35, 428/32.37; 427/243; 347/105
See application file for complete search history.

(56) References Cited

U.S. PATENT DOCUMENTS

| | | | |
|---|---|---|---|
| 5,316,576 | A | 5/1994 | Freeman |
| 5,597,612 | A | 1/1997 | Schoen et al. |
| 5,952,051 | A | 9/1999 | Asano et al. |

(Continued)

FOREIGN PATENT DOCUMENTS

| | | | |
|---|---|---|---|
| EP | 0 524 635 | A1 | 1/1993 |
| EP | 0 734 881 | A1 | 10/1996 |
| EP | 0 770 729 | A1 | 5/1997 |

(Continued)

OTHER PUBLICATIONS

European Search Report for corresponding European Patent Application No. 09168205, dated Jan. 17, 2011.

*Primary Examiner* — Betelhem Shewareged
(74) *Attorney, Agent, or Firm* — Sughrue Mion, PLLC

(57) ABSTRACT

The specification pertains to a single or multiple coated printing sheet in particular but not exclusively for sheet-fed offset printing with an image receptive coating layer on a paper substrate. Unexpectedly short converting times and times until reprinting can be achieved by choosing a coating, in which the image receptive coating layer comprises a top layer and/or at least one second layer below said top layer, said top and/or second layer comprising a pigment part, wherein this pigment part is composed of 1-95 preferably of 80-95 parts in dry weight of a fine particulate carbonate and/or of a fine particulate kaolin or clay and 1-100, preferably 6 to 25 parts in dry weight of a fine particulate silica, and a binder part, wherein this binder part is composed of 5-20 parts in dry weight of binder and less than 4 parts in dry weight of additives. Furthermore methods for making such a printing sheet and uses of such a printing sheet are disclosed.

42 Claims, 38 Drawing Sheets

U.S. PATENT DOCUMENTS

Figure 1:
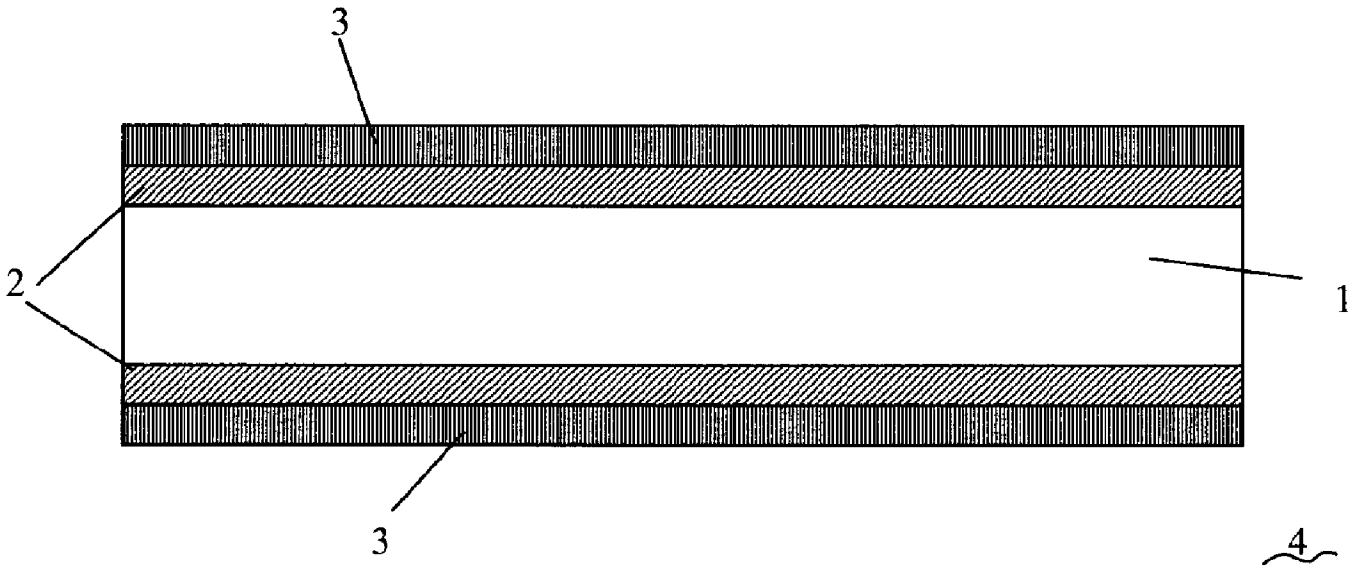

| | | | | |
|---|---|---|---|---|
| 5,965,244 | A * | 10/1999 | Tang et al. | 428/32.36 |
| 6,187,430 | B1 * | 2/2001 | Mukoyoshi et al. | 428/331 |
| 2004/0023008 | A1 * | 2/2004 | Rosset | 428/195.1 |
| 2004/0066446 | A1 | 4/2004 | Yamaguchi et al. | |

FOREIGN PATENT DOCUMENTS

| | | | |
|---|---|---|---|
| EP | 0 806 300 | A2 | 11/1997 |
| EP | 1 498 278 | A1 | 1/2005 |
| GB | 2 380 695 | A | 4/2003 |

* cited by examiner a)

b)

a)

b)

a)

b)

COATED PAPER FOR SHEET-FED OFFSET PRINTING

TECHNICAL FIELD

The present invention pertains to a single or multiple coated printing sheet in particular, but not exclusively, for sheet-fed offset printing, with an image receptive coating layer on a paper substrate. The invention furthermore pertains to methods for making such a coated printing sheet and to uses of such coated printing sheets.

BACKGROUND OF THE INVENTION

In the field of sheet fed offset printing it is desirable to be able to further process of freshly printed sheet as quickly as possible, while at the same time still allowing the printing inks to settle in and on the surface of the paper in a way such that the desired print gloss and the desired resolution can be achieved. Relevant in this context are on the one hand the physical ink drying process, which is connected with the actual absorption of the ink vehicles into an image receptive coating, e.g. by means of pores or a special system of fine pores provided therein. On the other hand there is the so-called chemical drying of the ink, which is connected with solidification of the ink in the surface and on the surface of the ink receptive layer, which normally takes place due to an oxidative cross-linking (oxygen involved) of cross linkable constituents of the inks. This chemical drying process can on the one hand also be assisted by IR-irradiation, it may however also be sped up by adding specific chemicals to the inks which catalytically support the cross-linking process. The more efficient the physical drying during the first moments after the application of the ink, the quicker and more efficient the chemical drying takes place.

Nowadays typically times until reprinting and converting times are in the range of several hours (typical values until reprinting for standard print layout: about 1-2 h; typical values until converting for standard print layout: 12-14 h; matt papers are more critical than glossy papers in these respects), which is a severe disadvantage of the present ink and/or paper technology, since it slows down the printing processes and makes intermediate storage necessary. Today shorter times are possible if for example electron beam curing or UV irradiation is used after the printing step, but for both applications special inks and special equipment is required involving high costs and additional difficulties in the printing process and afterwards.

SUMMARY OF THE INVENTION

The objective problem underlying the present invention is therefore to provide an improved printing sheet, single coated or multiple coated, in particular for sheet fed offset printing. The printing sheet shall be provided with an image receptive coating layer on a paper substrate, and it shall allow much shorter reprinting times and converting times when compared with the state of the art, however at the same time showing sufficient paper and print quality like e.g. paper gloss and print gloss.

The present invention solves the above problem by providing a specific coating composition comprising silica. More particularly, the image receptive coating layer is designed such that it comprises a top layer and/or at least one second layer below said top layer, said top and/or second layer comprising: a pigment part, wherein this pigment part is composed of 0 or 1 to 99 parts in dry weight of a fine particulate carbonate (precipitated or ground carbonate or combinations thereof) and/or of a fine particulate kaolin and/or of a fine particulate clay, and 1 to 100 parts in dry weight of a fine particulate silica, and a binder part, wherein this binder part is composed of: 5-20 parts in dry weight of binder and less than 4 parts in dry weight of additives. For certain applications also binder contents up to 30 parts may be advantageous in particular in combination with a pigment part which is essentially consisting of silica gel or precipitated silica only. In this context it should be noted that the term particulate silica shall include compounds commonly referred to as silica sol, as well as colloidal silica and fumed silica, and preferably also amorphous silica gel as well as precipitated silica. To clarify, the image receptive coating may either be a single layer coating, wherein this single layer coating has a pigment part as defined above. The image receptive coating may however also be a double layer coating, so it may have a top layer and a second layer below said top layer. In this case, the top layer can have the above pigment composition, the second layer may have the above pigment composition, or both may have the above pigment composition. In all these cases, advantageous effects according to the present invention are possible.

It should generally be noted that the kaolin can be substituted or supplemented by clay. Clay is a generic term used to describe a group of hydrous aluminium phyllosilicates minerals, that are typically less than 2 micrometers in diameter. Clay consists of a variety of phyllosilicate minerals rich in silicon and aluminium oxides and hydroxides which include variable amounts of structural water. There are three or four main groups of clays: kaolinite, montmorillonite-smectite, illite, and chlorite. There are about thirty different types of 'pure' clays in these categories but most 'natural' clays are mixtures of these different types, along with other weathered minerals. Kaoline so is a specific clay mineral with the chemical composition $Al_2Si_2O_5(OH)_4$. It is a layered silicate mineral, with one tetrahedral sheet linked through oxygen atoms to one octahedral sheet of alumina octahedra.

When talking about parts in dry weight the numerical values given in this document are preferably to be understood as follows: the pigment part comprises 100 parts in dry weight, wherein this is shared on the one side by the carbonate and/or kaolin and/or clay and on the other side by the silica. This means that the carbonate and/or kaolin and/or clay complements the silica parts to 100 parts in dry weight. The binder part and the additives are then to be understood as calculated based on the 100 parts in dry weight of the pigment part.

Preferably, the desired ink setting properties are made available by means of use of a silica (and/or of a fine particulate carbonate and/or of a fine particulate kaolin and/or of a fine particulate clay) which has a pore volume above 0.2 ml/g. Even better properties are obtained, if a pore volume above 0.5 ml/g, or preferably above 1 ml/g is used. Generally when talking about pore volumes of pigments in this document, this means the internal pore volume if not mentioned otherwise. It is the pore volume of the particles which is accessible from the outside and thus contributes to the accessible pore structure of the final paper.

According to a preferred embodiment, the silica is an amorphous silica gel. According to another preferred embodiment, the silica is an amorphous precipitated silica. In the latter case, this silica usually has a surface area (generally as measured according to BET-method) above 150 $m^2/g$, preferably it has a surface area above 500 $m^2/g$, even more preferably in the range of 600-800 $m^2/g$.

Generally it is preferred, if the silica has an internal pore volume above or equal to 1.8 ml/g, preferably above or equal to 2.0 ml/g.

At this point, it seems appropriate to discuss the most important aspect of the above-mentioned silica types in somewhat more detail. Reference is specifically made here to the book "Handbook of Porous Solids" (Wiley-VCH, volume 3, Ferdi Schüth (Editor), Kenneth S. W. Sing (Editor), Jens Weitkamp (Editor), ISBN: 3-527-30246-8, 2002), and specifically to pages 1586-1572 thereof, the disclosure of this part of the book being explicitly included into this disclosure.

In principle silica can be classified in three main branches, the so-called crystalline silica (including for example quartz), amorphous silica (including for example fused silica) and synthetic amorphous silica.

The latter are of particular interest in the context of the present invention, and of those in particular the silicas, which are prepared in a wet process.

The synthetic amorphous silica types based on a wet process are silica gel (also called xerogel) and precipitated silica as well as colloidal silica. Fumed silica is made in a thermal process.

Colloidal silica (also called silica sol) can be considered as a suspension of primary particles which are fine sized and nonporous. In the context of this invention, colloidal silica is possible but not preferred.

Fumed silica can have various differing properties depending on the method of production, and fumed silica with low primary particle sizes (3-30 nm) and high surface area (50-600 $m^2/g$) could, in spite of not been preferred, potentially also be used in the context of the present invention.

Particularly preferred in the context of the present invention are, as already outlined above, however precipitated silica and silica gel. Silica gel (xerogel) is generally preferred, while precipitated silica is generally only preferred if it has a high surface area typically above 200 $m^2/g$ and for particle sizes below 10 micrometer, so e.g. for particle sizes in the range of 5-7 micrometer. Such systems are for example available by a supplier Degussa under the name Sipernat 310 and 570. Both types, i.e. silica gel and precipitated silica, are characterised in a porous particle structure (mean internal pore diameter can be down to 2 nm) and in a high surface area. For a comparison of these types reference is made to Table 2 in the above-mentioned book on page 1556.

Particularly preferred is the use of silica gel. Silica gel is a porous, amorphous form of silica ($SiO_2.H_2O$). Due to its unique internal structure silica gel is radically different to other $SiO_2$-based materials. It is composed of a vast network of interconnected microscopic pores. Silica gels have accessible internal pores with a narrow range of diameters—typically between 2 nm and 30 nm, or even between 2-20 nm.

Due to its uniquely fast (and selective) absorptive properties of mineral oil solvent/vehicle (more generally of liquid ink vehicle) silica and in particular silica gel (e.g. of the type as Syloid C803) and also precipitated silica is optimally capable of very fast and tight 'setting' of cross-linkable ink parts upon and in the surface of the paper. Due to this maximum concentrated form mechanical properties of ink film are already on a very high level and due to maximum concentration of crosslinkable chains subsequent chemical crosslinking process is now under optimum conditions to more quickly end up (at 100% cross-linking) to highest level of mechanical properties of ink layer. Another positive point of these pigments (in particular of the type as Syloid C803) is that in this chemical stage optionally incorporated metals (see discussion further below) can act as catalysts to even further speed up crosslinking process. In fact in commercial printing tests at 300-400% ink density (and better than in lab tests) it was repeatedly experienced via Fogra ink drying test (and following total curve in time to dot dry behaviour) that the proposed pigments at the end really are capable of enhanced physical and chemical ink drying, compared to case without the proposed pigments, in particular silica gel or precipitated silica.

It should be noted that it is possible to partly or totally substitute silica gel or precipitated silica by nano-dispersive pigments (e.g. carbonates, colloidal silica, fumed silica/Aerosil) as long as the essential fine pore structure and a specific minimal internal pore volume is achieved with high amounts of small pigment particles which are packed or aggregated leading to aggregated or interparticle structure with an equivalent surface area and equivalent porosity properties as defined above.

According to a further preferred embodiment, the printing sheet is characterised in that the image receptive coating layer has a cumulative porosity volume as measured by mercury intrusion of pore widths in the range of 8-20 nm of more than 8 ml/(g total paper), preferably of more than 9 ml/(g total paper). Preferably the cumulative porosity volume in a range of 8-40 nm is more than 12 ml/(g total paper), preferably more than 13 ml/(g total paper) (for a paper with a single side coated substrate of 14 $g/m^2$ coat weight on a precoated paper substrate of 95 $g/m^2$).

As already outlined above, the present printing sheet with incorporated silica is tailored for offset printing. Correspondingly, in contrast to inkjet papers, it is specifically tailored for taking up typical inks as used in sheet-fed offset printing, and not for printing inks as used in inkjet printing, which show much less attractive acceptance at present printing sheet. Commercially available offset printing inks are generally being characterised by their total surface energy in the range of about 20-28 mN/m (average about 24 mN/m) and dispersive part of total surface energy in the range of 9-20 mN/m (average about 14 mN/m). Surface energy values measured at 0.1 seconds, on a Fibrodat 1100, Fibro Systems, Sweden. Commercially available inkjet printing inks on the other hand are being characterised by their (higher) total surface energy in the range of about 28-31 mN/m (average about 31 mN/m) and dispersive part of total surface energy in the range of 28-31 mN/m (average about 30 mN/m), thus with very low polar part of total energy (average about 1 mN/m). According to another preferred embodiment therefore, the total surface energy of the image receptive coating layer is thus matching the surface energy characteristics of the offset ink, so the surface energy is e.g. less than or equal to 30 mN/m, preferably less than or equal to 28 mN/m. This in contrast to typical inkjet papers, which have total surface energy values of at least 40 mN/m and up to about 60 mN/m. It is further preferred that the dispersive part of the total surface energy of the image receptive coating layer is less than or equal to 18 mN/m, preferably less than or equal to 15 mN/m. Again, this is in complete contrast to values of inkjet papers, as for these the dispersive part generally is well above 20 mN/m and even up to 60 mN/m. A particularly preferred embodiment is characterised in that the pigment part comprises 80-95 parts in dry weight of a fine particulate carbonate and/or of a fine particulate kaoline and/or of a fine particulate clay, and 6 to 25 parts in dry weight of a fine particulate silica.

According to a further preferred embodiment, the total of 100 parts in dry weight of the pigment part is composed of 1-50 parts in dry weight silica, preferably of silica gel or precipitated silica, and correspondingly the carbonate and/or kaolin and/or clay part complements with 99-50 parts in dry weight. It is further preferred, that the pigment part comprises 1-30 parts in dry weight of silica, preferably of silica gel or precipitated silica, and correspondingly 99-70 parts in dry weight of the carbonate and/or kaolin and/or clay part. It is most preferred that the pigment part is composed of 6-25 parts in dry weight of silica gel or precipitated silica, and 75-94 parts in dry weight of carbonate and/or kaolin and/or clay.

One of the key features of the invention is therefore the fact that by providing the specific combination of an appropriate amount (and type) of silica, preferably with appropriately chosen absorption properties e.g. as defined by the (internal) pore volume and/or by the specific surface in a coating which comes into in contact with the ink applied to the image receptive coating leads to significantly improved physical as well as chemical ink drying due to inherent properties of silica.

In another preferred embodiment of the present invention, the pigment part comprises 7-15, preferably 8-12 parts in dry weight of a fine particulate silica, preferably 8-10 parts in dry weight of a fine particulate silica. As a matter of fact, if the silica content is too high, the printing ink shows ink setting which is too fast leading to inappropriate print gloss properties and other disadvantages. Therefore only a specific window of the silica content actually leads to appropriate properties for sheet fed offset printing, which requires a medium fast ink setting on a short timescale (in the range of 15-120 seconds as determined in the so-called set off test) but exceptionally fast ink setting on a long timescale (in the range of 2-10 minutes as determined in the so-called multicolour ink setting test).

Alternatively one can say that it is beneficial, if, as long as the paper is still in the press (typically less than 1 sec), the ink setting is moderate, while after that it should be as fast as possible.

If silica gel or precipitated silica is used in the pigment part, also high contents are advantageous up to 100 parts, and even faster ink setting can be achieved.

The ink setting properties are optimal if a fine particulate silica with a particle size distribution is chosen such that the average particle size is in the range of 0.1-5 μm, preferably in the range of 0.3-4 μm. Particularly good results can be achieved if the average particle size of the silica is in the range of 0.3-1 μm or in the range of 3-4 μm. Also the surface properties of the silica used as well as its porosity have an influence on the physical and/or chemical drying properties. Correspondingly, a fine particulate silica with a surface area above 200 $m^2/g$, preferably above 250 $m^2/g$, even more preferably of at least 300 $m^2/g$ is preferably used. The pigment part preferably comprises a fine particulate silica with a surface area in the range of 200-1000 $m^2/g$, preferably in the range of 200-400 $m^2/g$ or of 250-800 $m^2/g$.

In this context it has to be noted that also other types of organic and/or inorganic pigments (so not only silica but also ground and/or precipitated carbonates, e.g. porous PCC and/or clay/kaolines and/or plastic pigments) are theoretically/principally able to fulfil a function analogous to the one as described above for a silica as long as these inorganic pigments have a surface area in the range of 18-400 $m^2/g$, or of 40-400 $m^2/g$, preferably of 100-400 $m^2/g$, and/or they have a non-vanishing internal pore volume e.g. above 0.3 ml/g, preferably above 0.5 ml/g, and preferably as long as they comprise traces of metal selected from the group of iron, manganese, cobalt, chromium, nickel, zinc, vanadium or copper or another transition metal, wherein at least one of these traces or the sum of the traces is present in an amount higher than 100 ppb, preferably higher than 500 ppb.

It should be noted in the context of precipitated carbonates, that it is generally possible to (partially) substitute and/or supplement the silica as mentioned above by a porous precipitated calcium carbonate (PCC) with internal pore structure. Such a porous precipitated calcium carbonate preferably has a surface area in the range of 50-100 $m^2/g$, even more preferably of 50-80 $m^2/g$. Typically such a porous PCC has particle sizes in the range of 1-5 micrometer, preferably of 1-3 micrometer. If such a porous PCC is used instead of or together with silica, in particular instead of silica gel or precipitated silica, due to the slightly lower typical surface area larger amounts/fractions of the porous PCC are usually necessary for achieving the same or an equivalent effect as if using silica.

As a matter of fact, the porosity relevant for the physical ink absorption may either be made available by means of porosity of one of the pigments used, it may be generated by a particular structure of the coating leading to the desired porosity (also via packing of non-porous particles leading to the porosity of the full coating) or by surface modified pigments. Typically the proper porosity can be recognized by a specific profile in the mercury intrusion measurements of the final coating, showing a characteristic peak or rather an increase in porosity at 8-40 nm, preferably 8-20 nm and even more preferably 0.01-0.02 μm, indicating that pores of this size are present which essentially contribute to the fast physical ink absorption. As already mentioned above, this porosity may either be generated by the internal porosity of the pigment and/or by the inter-particular structure or particular agglomerate of pigment particles generated in the top or other coating.

This general concept is in principle independent from the above-mentioned concept of specific silica contents, and in itself represents an invention. The inorganic and/or organic pigments may be intentionally enriched in such metal traces. Typically an iron content above 500 ppb is preferred and a manganese content above 20 ppb. Also preferred is a chromium content above 20 ppb. It should be noted that in case of use of such pigments, the composition may also be different from the one described above, namely the full inorganic pigment part may be formed by such a specific pigment. Preferentially the inorganic pigment in this case has an average particle size in the range of 0.1-5 μm. So it is either possible to replace the silica in the formulations given above and below by such a specific inorganic pigment (which may be carbonate, or also kaoline or clay), or it is possible to replace the full inorganic pigment part by such a specific inorganic pigment.

According to another preferred embodiment of the invention, the pigment part comprises 70-80 parts in dry weight of a fine particulate carbonate, preferably with a particle size distribution such that 50% of the particles are smaller than 1 μm. Particularly good results can be achieved if a particle size distribution such that 50% of the particles are smaller than 0.5 μm is chosen, and most preferably with a particle size distribution such that 50% of the particles are smaller than 0.4 μm (always as measured using Sedigraph methods).

As already pointed out above, the combination of carbonate and kaoline (or clay) in the pigment part shows to have advantages. In respect of the kaoline (or clay) it is preferred to have 10-25 parts in dry weight of a fine particulate kaolin (or clay), preferably 13-18 parts in dry weight of a fine particulate kaolin (or clay). The fine particulate kaolin (or clay) may be chosen to have a particle size distribution such that 50% of the particles are smaller than 1 μm, even more preferably with a particle size distribution such that 50% of the particles are smaller than 0.5 μm, and most preferably with a particle size distribution such that 50% of the particles are smaller than 0.3 μm.

As already mentioned above, it is key to find a compromise between paper gloss and print gloss and fast ink setting properties. The faster the ink setting properties, the less advantageous usually the print gloss properties. Therefore a specific combination of binder proportion and silica proportion as proposed in the main claim provides the ideal compromise for sheet fed offset printing. Even better results can however be achieved if the binder part comprises 7-12 parts in dry weight of a binder. Higher binder contents of up to 30 parts are useful if silica gel or precipitated silica are used as the silica part in high amounts. The binder may be chosen to be a single binder type or a mixture of different or similar binders. Such binders can for example be selected from the group consisting of latex, in particular styrene-butadiene, styrene-butadiene-acrylonitrile, styrene-acrylic, in particular styrene-n-butyl acrylic copolymers, styrene-butadiene-acrylic latexes, acrylate vinylacetate copolymers, starch, polyacrylate salt, polyvinyl alcohol, soy, casein, carboxymethyl cellulose, hydroxymethyl cellulose and copolymers as well as mixtures thereof, preferably provided as an anionic colloidal dispersion in the production. Particularly preferred are for example latexes based on acrylic ester copolymer which are based on butylacrylate, styrene and if need be acrylonitrile. Binders of the type Acronal as available from BASF (Germany) or other type Litex as available from PolymerLatex (Germany) are possible.

In addition to the actual binder, the binder part may comprise at least one additive or several additives selected from defoamers, colorants, brighteners, dispersants, thickeners, water retention agents, preservatives, crosslinkers, lubricants and pH control agents or mixtures thereof.

More specifically, a particularly suitable formulation for the application in sheet fed offset could be shown to be characterised in that the top coat of the image receptive layer comprises a pigment part, wherein this pigment part is composed of 75-94 or 80-95 parts in dry weight of a fine particulate carbonate and/or of a fine particulate kaolin and/or of a fine particulate clay and 6 to 25 parts in dry weight of a fine particulate silica. Even better results can be obtained if the printing sheet is characterised in that the top coat of the image receptive layer comprises a pigment part comprising 70-80 parts in dry weight of a fine particulate carbonate with a particle size distribution such that 50% of the particles are smaller than 0.4 μm, 10-15 parts in dry weight of a fine particulate kaoline (or clay) with a particle size distribution such that 50% of the particles are smaller than 0.3 cm, 8-12 parts in dry weight of a fine particulate silica with an average particle size between 3-5 μm and a surface area of 300-400 $m^2/g$, and a binder part comprising 8-12, preferably 9-11 parts in dry weight of a latex binder less than 3 parts in dry weight of additives.

The printing sheet according to the present invention may be calendered or not, and it may be a matt, glossy or also a satin paper. The printing sheet may be characterised by a gloss on the surface of the image receptive coating of more than 75% according to TAPPI 75 deg or of more than 50 according to DIN 75 deg for a glossy paper (e.g. 75-80% according to TAPPI 75 deg), by values of less than 25% according to TAPPI 75 deg for matt papers (e.g. 10-20%) and by values in between for satin grades (for example 25-35%).

An image receptive coating may be provided on both sides of the substrate, and it may be applied with a coat weight in the range of 5 to 15 $g/m^2$ on each side or on one side only. The full coated paper may have a weight in the range of 80-400 $g/m^2$. Preferably the substrate is a woodfree paper substrate.

The silica may be present in the top layer, it may however also be present in a layer which is right beneath a top layer. In this case, the top layer may also comprise silica, is however also possible to have a top free of silica. According to another preferred embodiment of the invention, the printing sheet is therefore characterised in that the image receptive coating layer has a second layer beneath said top layer comprising: a pigment part, wherein this pigment part is composed of 80-98 parts in dry weight of a mixture of or a single fine particulate carbonate, preferably with a particle size distribution such that 50% of the particles are smaller than 2 μm or even smaller than 1 μm, 2-25 parts in dry weight of a fine particulate silica and a binder part, wherein this binder is composed of: less than 20 parts in dry weight of binder, preferably 8-15 parts in dry weight of latex or starch binder, less than 4 parts in dry weight of additives. In this case, it shows to have advantages if in this second layer the fine particulate carbonate of the pigment part consists of a mixture of one fine particulate carbonate with a particle distribution such that 50% of the particles are smaller than 2 μm, and of another fine particulate carbonate with a particle distribution such that 50% of the particles are smaller than 1 μm, wherein preferentially those two constituents are present in approximately equal amounts. It has to be pointed out that also further layers beneath such as second layer, which is optional, maybe provided. Such further layers may for example be sizing layers, there may however also be further layers even comprising certain amounts of silica. Typically, the pigment part of the second layer comprises 5-15 parts in dry weight of silica, preferably in a quality as defined above in the context of the top layer.

As already discussed further above, the time to converting and reprinting should be reduced significantly. According to another preferred embodiment therefore the printing sheet is characterised in that it is re-printable within less than 30 minutes, preferably within less than 15 minutes and convertable within less than one hour, preferably within less than 0.5 hours. In this context, re-printable is intending to mean that a printed sheet can be fed for a second time through the printing process to be printed on the opposite side without detrimental side effects like for example blocking, marking, smearing etc. In this context, convertable means to be able to undergo converting steps as well-known in the paper industry (converting includes turning, shuffling, folding, creasing, cutting, punching, binding and packaging etc of printed sheets).

Preferably, the printing sheet is further characterised in that at least a fraction of the pigment part, preferably the fine particulate silica, comprises or is even selectively and purposely enriched in traces of metals, preferably of transition metals, wherein at least one metal is present in more than 10 ppb or at least one metal or the sum of the metals is present in more than 500 ppb. E.g. iron may be present in such amount, but also copper, manganese etc are advantageous. This aspect of the presence of specific metal contents is actually also independent of the concept of a coating with silica.

The metal, be it in elemental or in ionic form, seems to contribute to the chemical drying of the ink. A larger content in metal may compensate a lower presence in parts in dry weight of pigment with the proper porosity and/or surface area, so for example if the pigment part comprises 80-95 parts in dry weight of a fine particulate carbonate and/or of a fine particulate kaoline and/or of a fine particulate clay, and 6 to 25 parts in dry weight of a fine particulate silica, the silica content may be smaller if it has higher metal contents.

There is 3 groups of metals which are particularly active as drier metals or related to drier function if present in one of the pigments, in particular in the silica fraction:

A) Primary or top or surface drier metals: all transition metals like Mn with both +2 (II) and +3 (III) valency. They catalyse formation and especially decomposition of peroxides, formed by reaction of $O_2$ with drying oils. This oxidative or free-radical chemistry leads to the formation of polymer-to-polymer crosslinks (=top drying) and also to formation of hydroxyl/carbonyl/carboxyl groups on the drying oil molecules. The most important ones are: Co, Mn, V, Ce, Fe. Also possible are Cr, Ni, Rh and Ru.

B) Secondary or through or coordination drier metals: The O-containing groups are used by these driers (but always in combination with primary driers, via joined complex formation) to form specific cross-links. The most important ones are: Zr, La, Nd, Al, Bi, Sr, Pb, Ba.

C) Auxiliary drier metals or promoter metals: they themselves do not perform a drying function directly, but via special interaction with primary or secondary driers (or some say via increase of solubility of prim. and sec. driers) they can support their activity. The most important ones are Ca, K, Li and Zn.

To have significant activity of these metals, they should be present in the pigment (preferably in the silica) from 10 ppb as lower limit up to the following upper limits:

Primary drier metals: all up to 10 ppm, except Ce: up to 20 ppm, and except Fe: up to 100 ppm.

Secondary drier metals: all up to 10 ppm, except Zr, Al, Sr and Pb: here all up to 20 ppm. Auxiliary drier metals: all up to 20 ppm.

Some specific combinations of these metals are particularly effective, like e.g. Co+Mn, Co+Ca+Zr or La or Bi or Nd, Co+Zr/Ca, Co+La. Possible is e.g. a combination of Mn(II+II)acetate (only surface of ink is quickly dried and closed towards oxygen) with some K-salt (to activate Mn activity) and possibly with Zr-salt (to increase through drying of ink bulk, so to improve wet ink rub behaviour of printed ink layer).

According to another preferred embodiment, the printing sheet is characterised in that the top coat and/or the second layer further comprises a chemical drying aid, preferably selected from a catalytic system like a transition metal complex, a transition metal carboxylate complex, a manganese complex, a manganese carboxylate complex and/or a manganese acetate or acetylacetate complex (e.g. Mn(II) $(Ac)_2 \cdot 4H_2O$ and/or Mn(acac)), wherein for proper catalytic activity of Mn complexes preferably Mn(II) as well as Mn(III) are present concomitantly, or a mixture thereof, wherein this chemical drying aid is preferably present in 0.5 to 3 parts in dry weight, preferably in 1 to 2 parts in dry weight. In case of a metal catalyst system like the above mentioned Mn complexes, the metal part of the catalyst system is preferably present in the coating in 0.05-0.6 weight-%, preferably in 0.02-0.4 weight-%, of the total dry weight of the coating. To support or enhance the catalytic activity of such systems is possible to combine them with secondary dryers and/or auxiliary dryers. It is also possible to enhance the catalytic activity by providing different ligands for a metal systems, so for example the above acetate complex may be mixed with bipyridine-ligands (bipy). Also possible is the combination with other metal complexes like Li(acac). Further enhancements are possible by combining the catalytic systems with peroxides to have the necessary oxygen directly at the spot without diffusional limitations. It has to be pointed out that the use of such catalyst systems for fixing polymerizable or crosslinkable constituents of the offset ink is also advantageous for coatings of completely different nature and is not necessarily linked to the concept of having silica in a coating.

It can be shown that lower silica contents can be compensated by the presence of such a chemical drying aid in the layer of the coating, and even a synergistic effect can be seen if the combination of silica and for example manganese acetate is used. The use of such a chemical drying aid in addition provides a further parameter to adjust the balance between paper gloss, print gloss, ink setting on a short timescale and ink setting on a longer timescale etc.

The present invention furthermore relates to a method for making a printing sheet according as discussed above. The method is characterised in that a silica comprising coating formulation is applied onto an uncoated, a pre-coated or on coated paper substrate, preferably on woodfree basis, using a curtain coater, a blade coater, a roll coater, a spray coater, an air knife, cast coating or specifically by a metering size press. Depending on the paper a gloss to be achieved, the coated paper may be calendered. Possible calendering conditions are as follows: calendering at a speed of in the range of 200-2000 m/min, at a nip load of in the range of 50-500 N/mm and at a temperature above room temperature, preferably above 60° C., even more preferably in the range of 70-95° Celsius, using between 1 and 15 nips.

Furthermore, the present invention relates to the use of a printing sheet as defined above in a sheet fed offset printing process. In such a process preferably reprinting and/or converting takes place within less than one hour, preferably within less than 0.5 hours, and as outlined further above.

Further embodiments of the present invention are outlined in the dependent claims.

SHORT DESCRIPTION OF THE FIGURES

Figure 2:
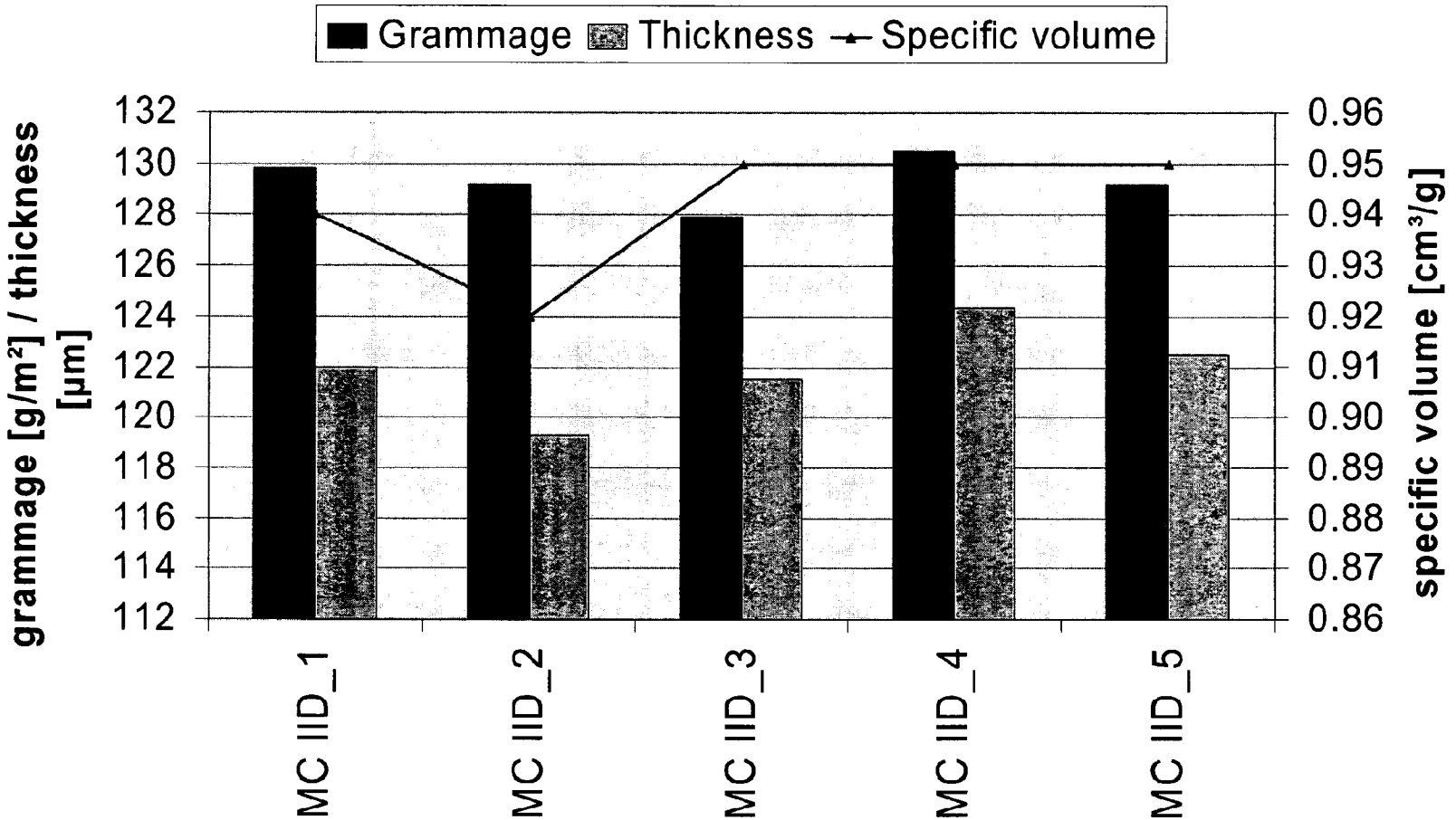
Figure 3:
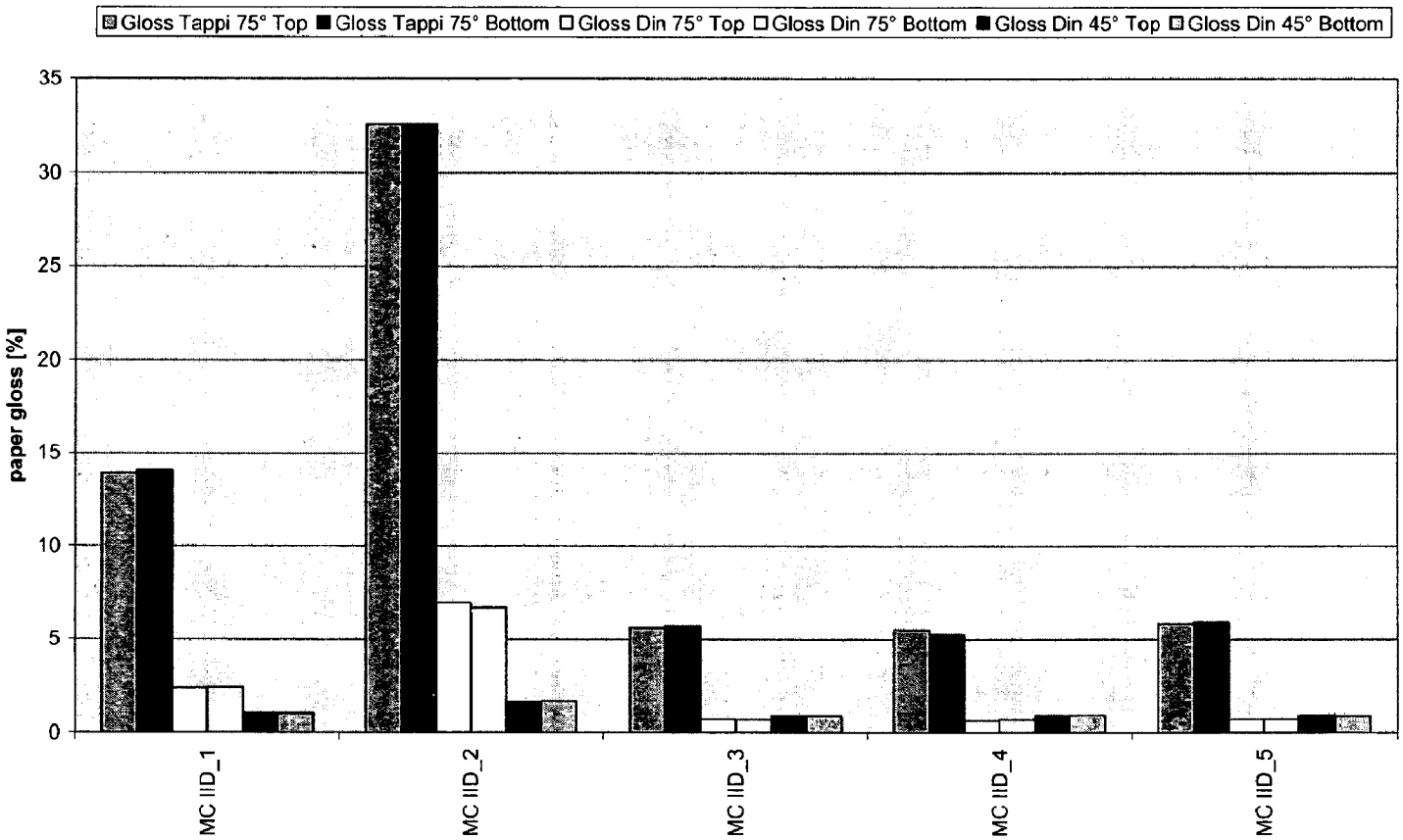
Figure 4:
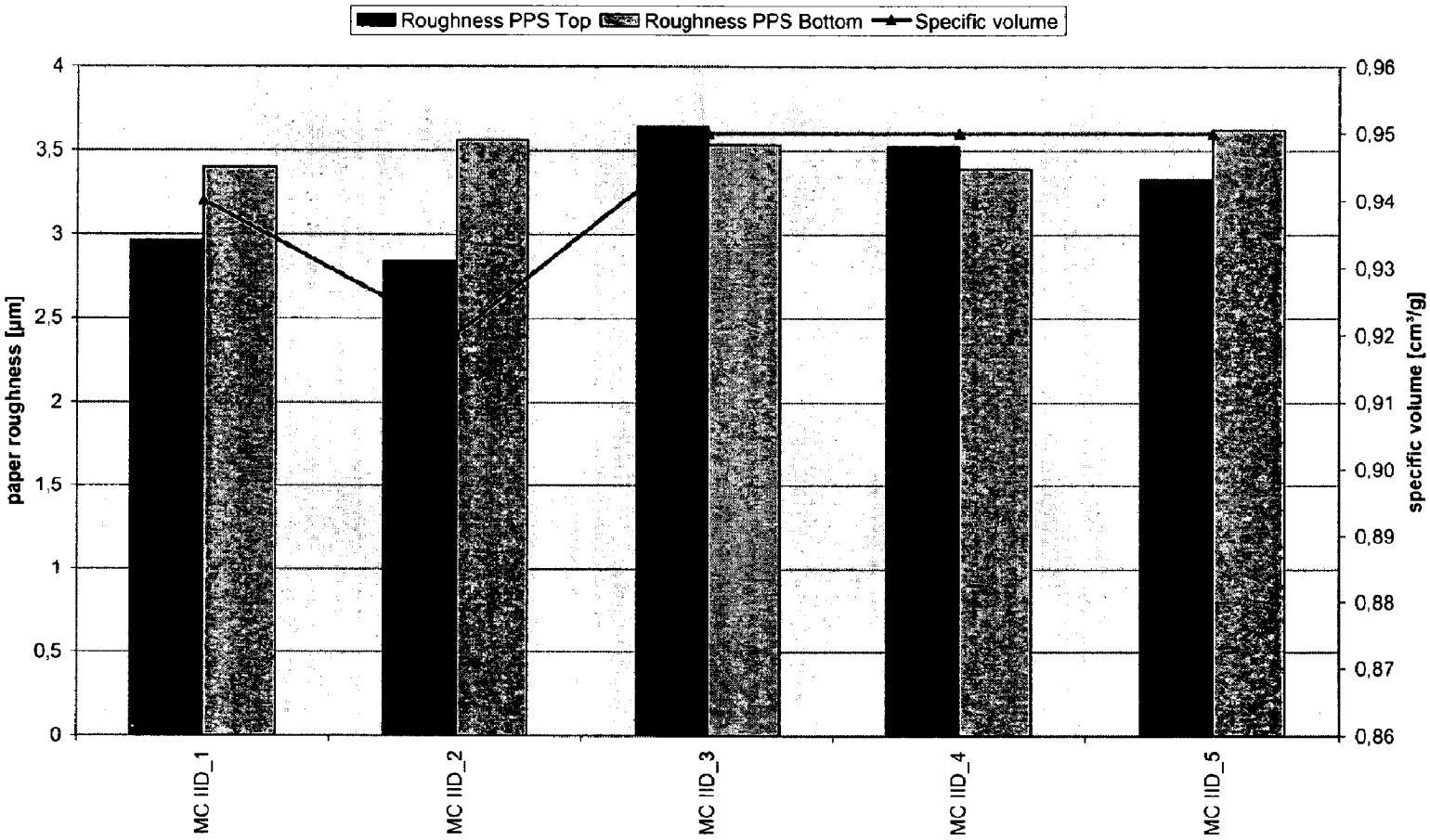
Figure 5:
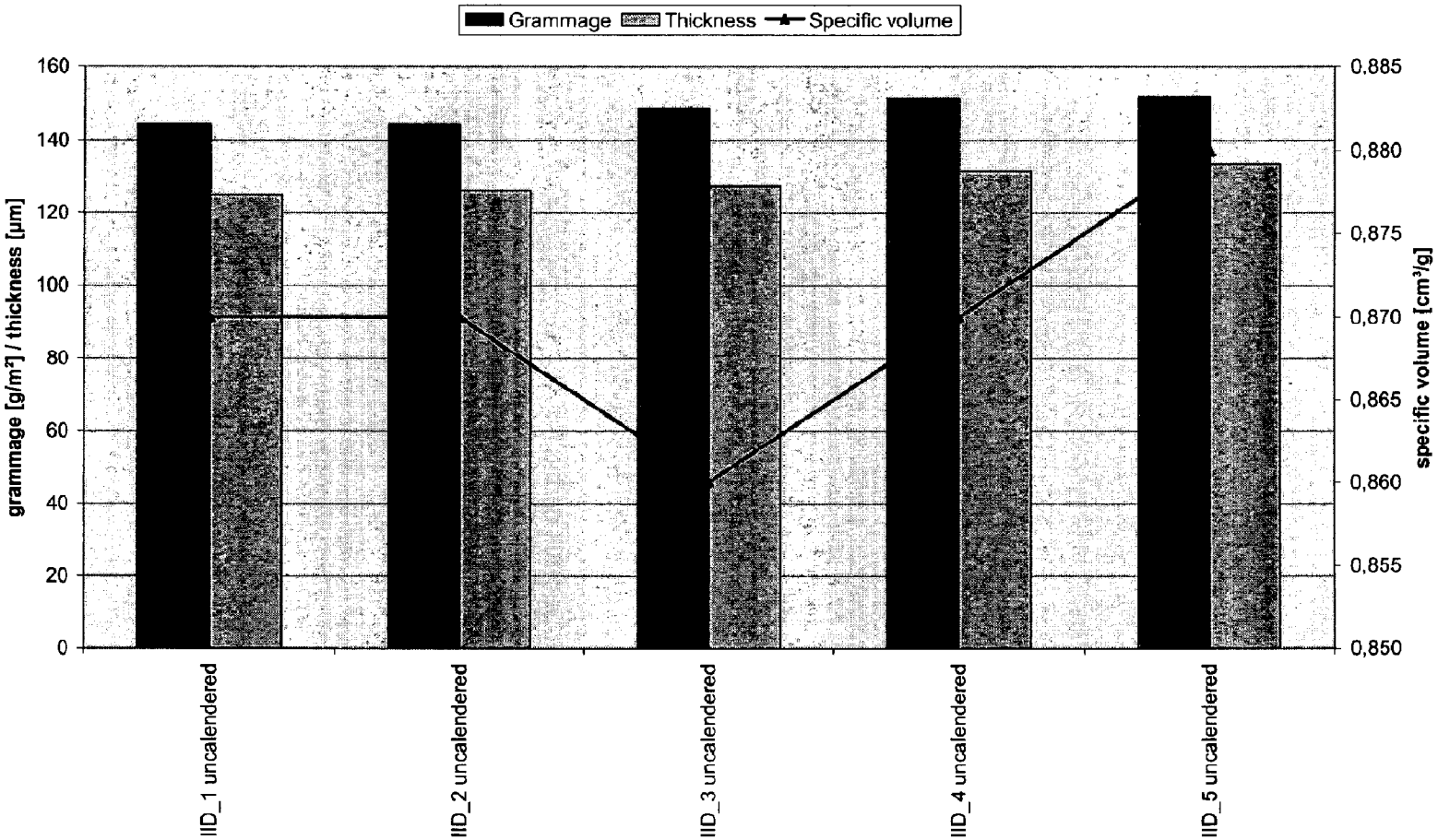
Figure 6:
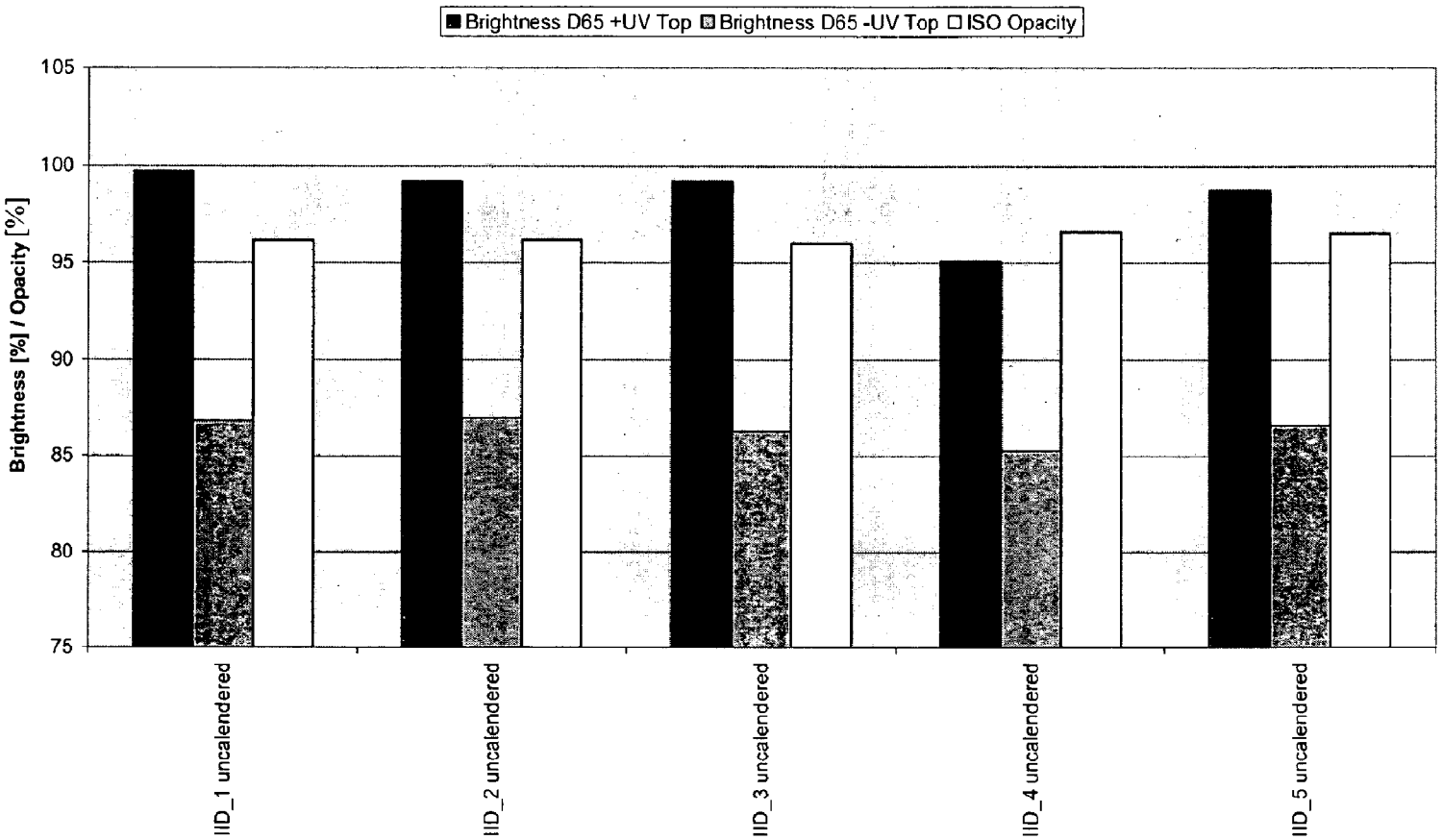
Figure 7:
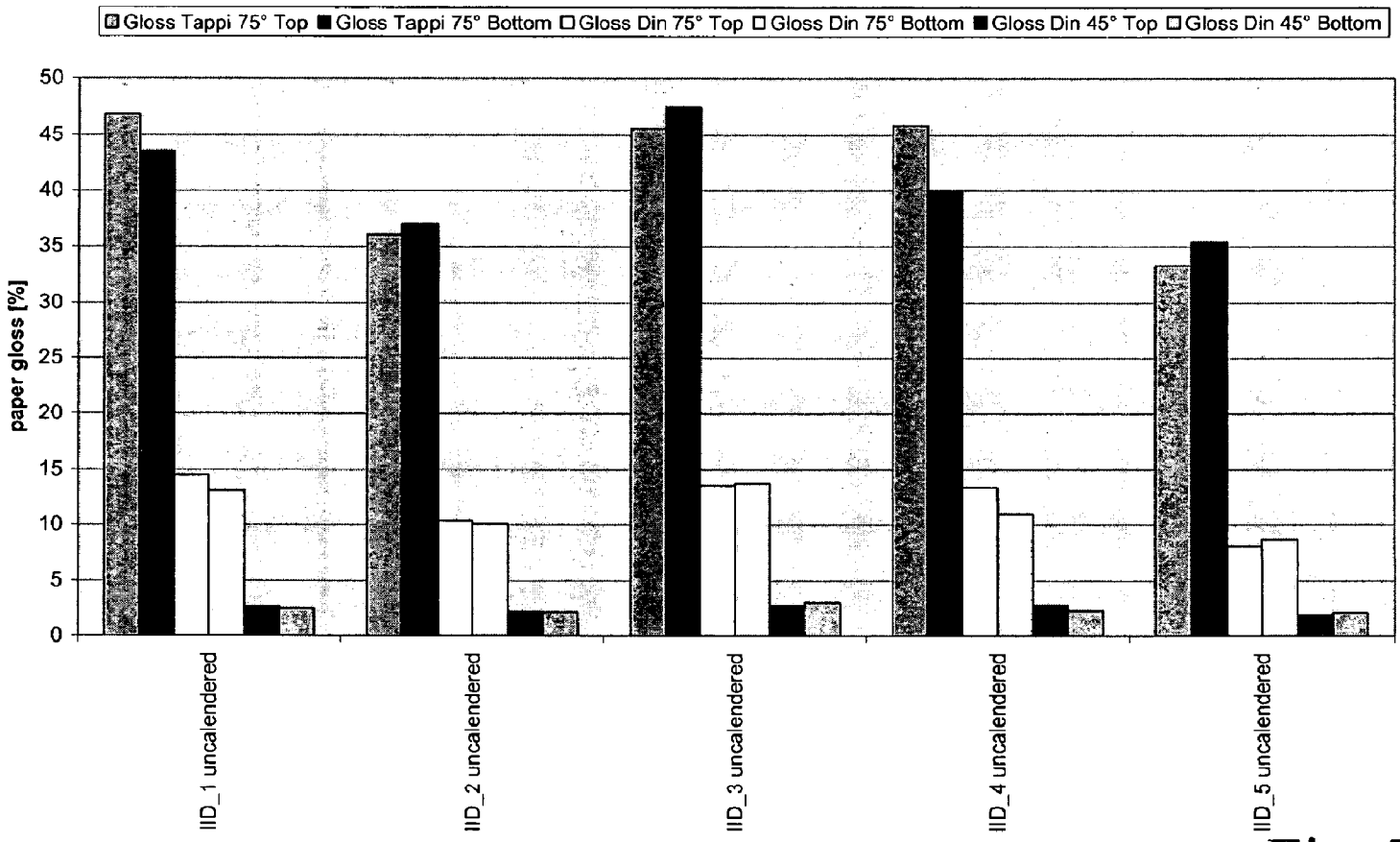
Figure 8:
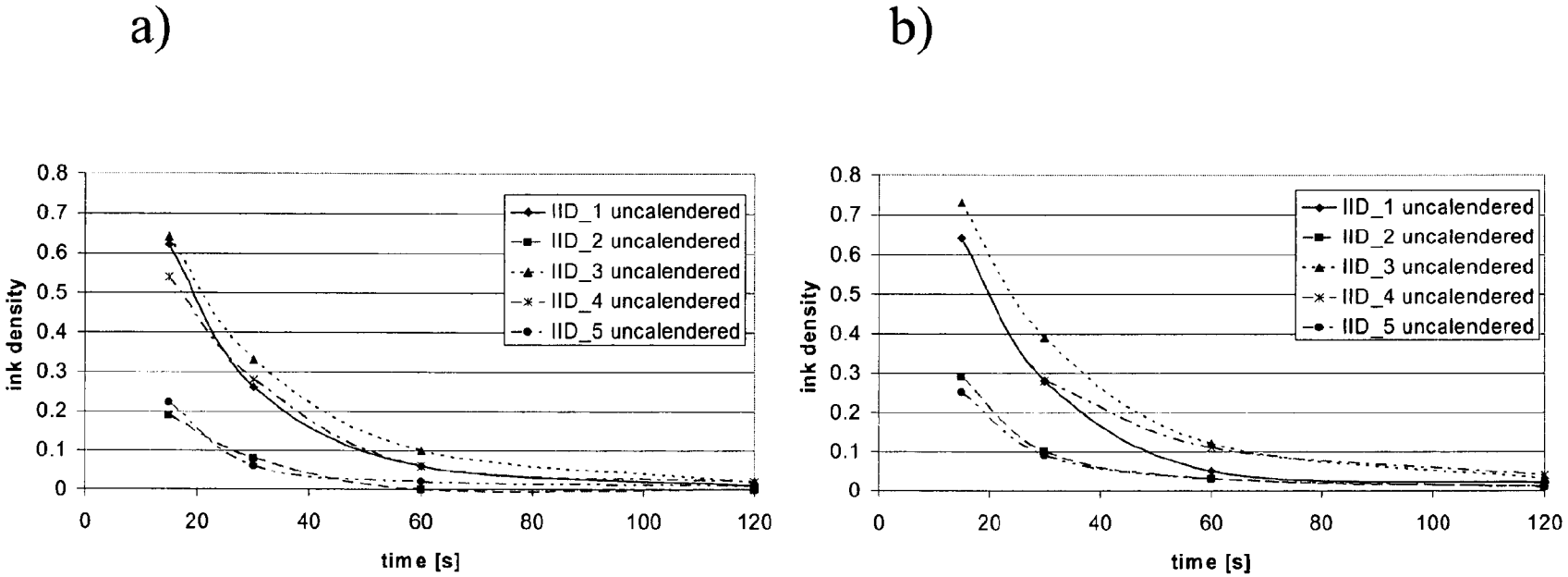
Figure 9:
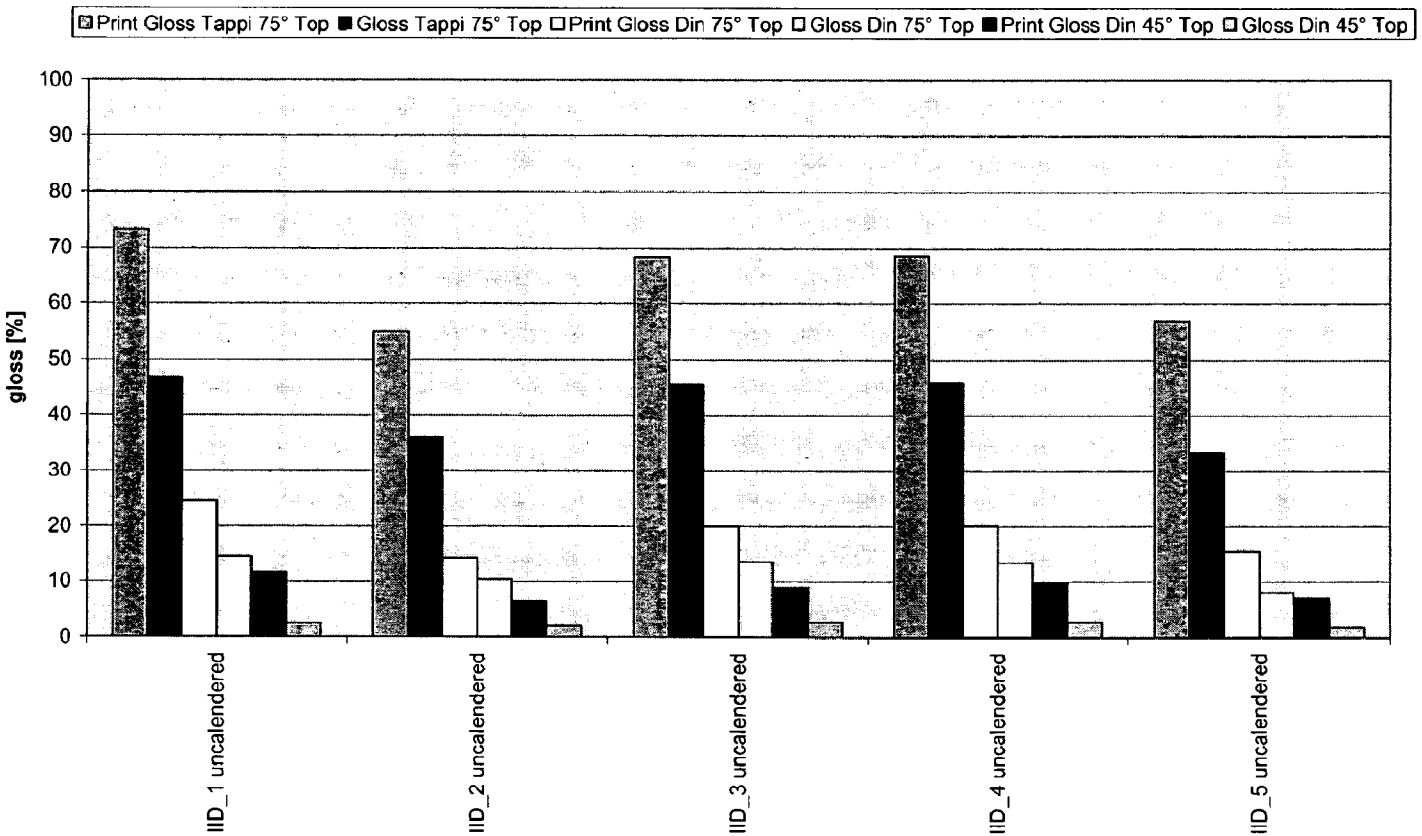
Figure 10:
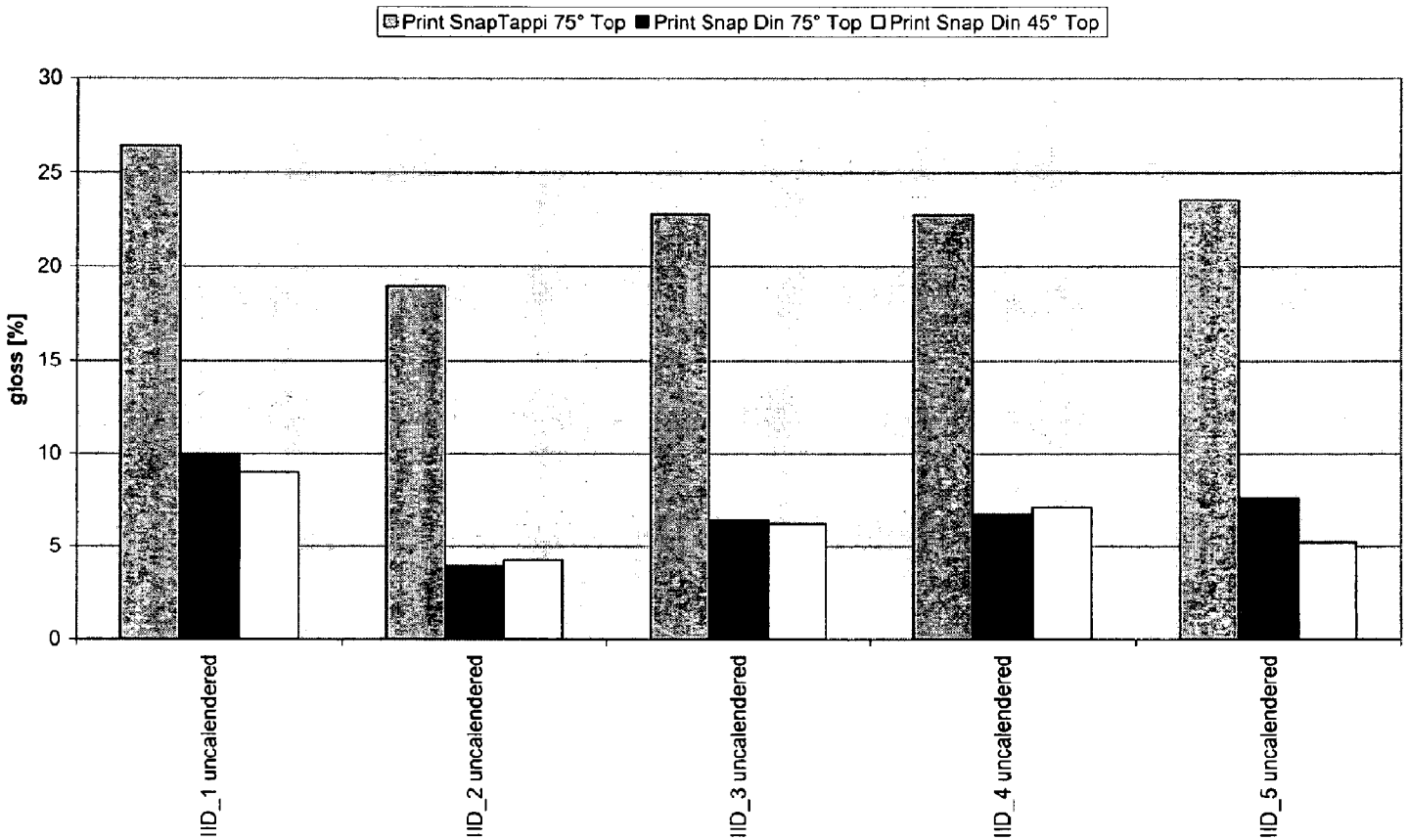
Figure 11:
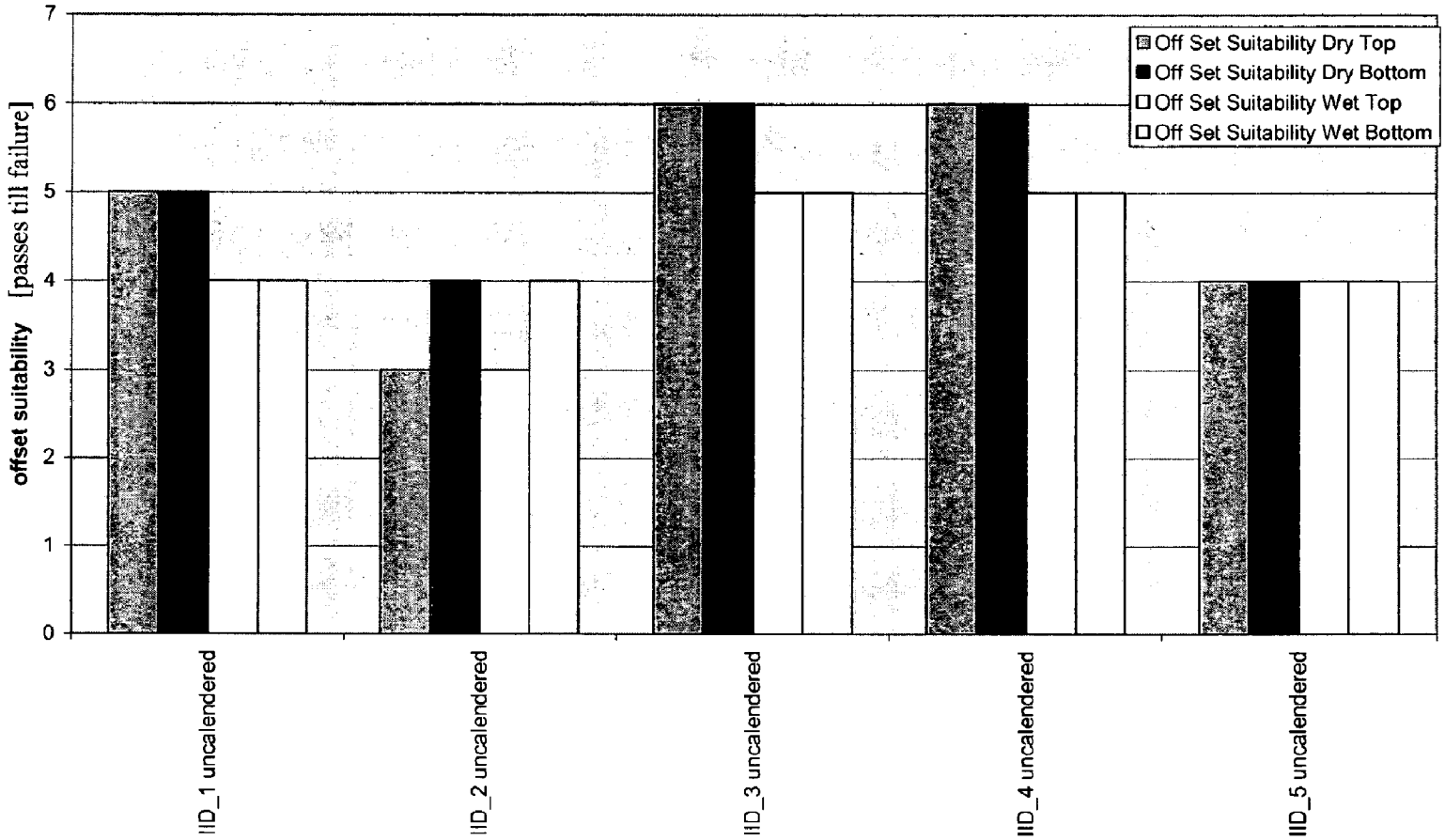
Figure 12:
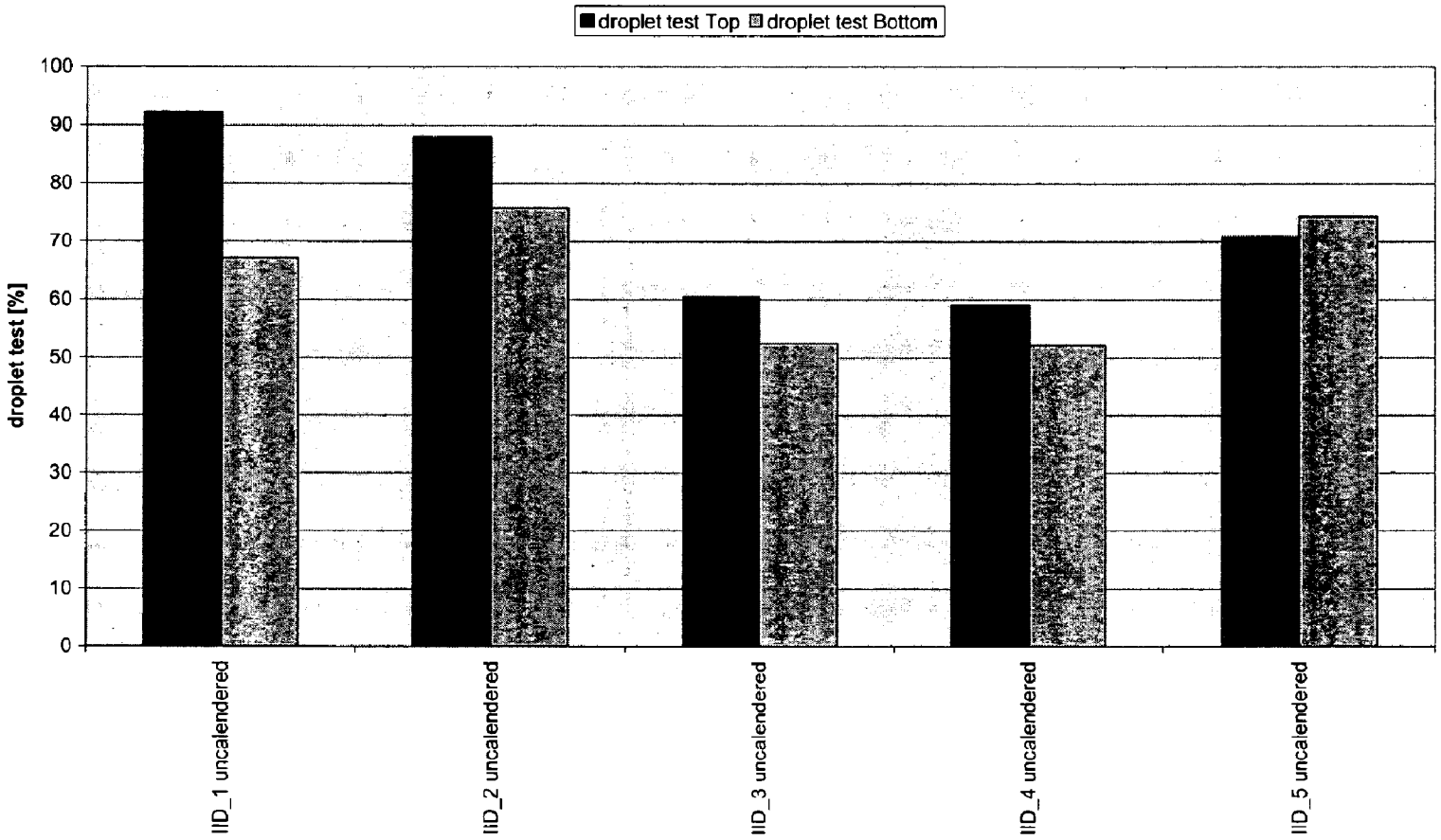
Figure 13:
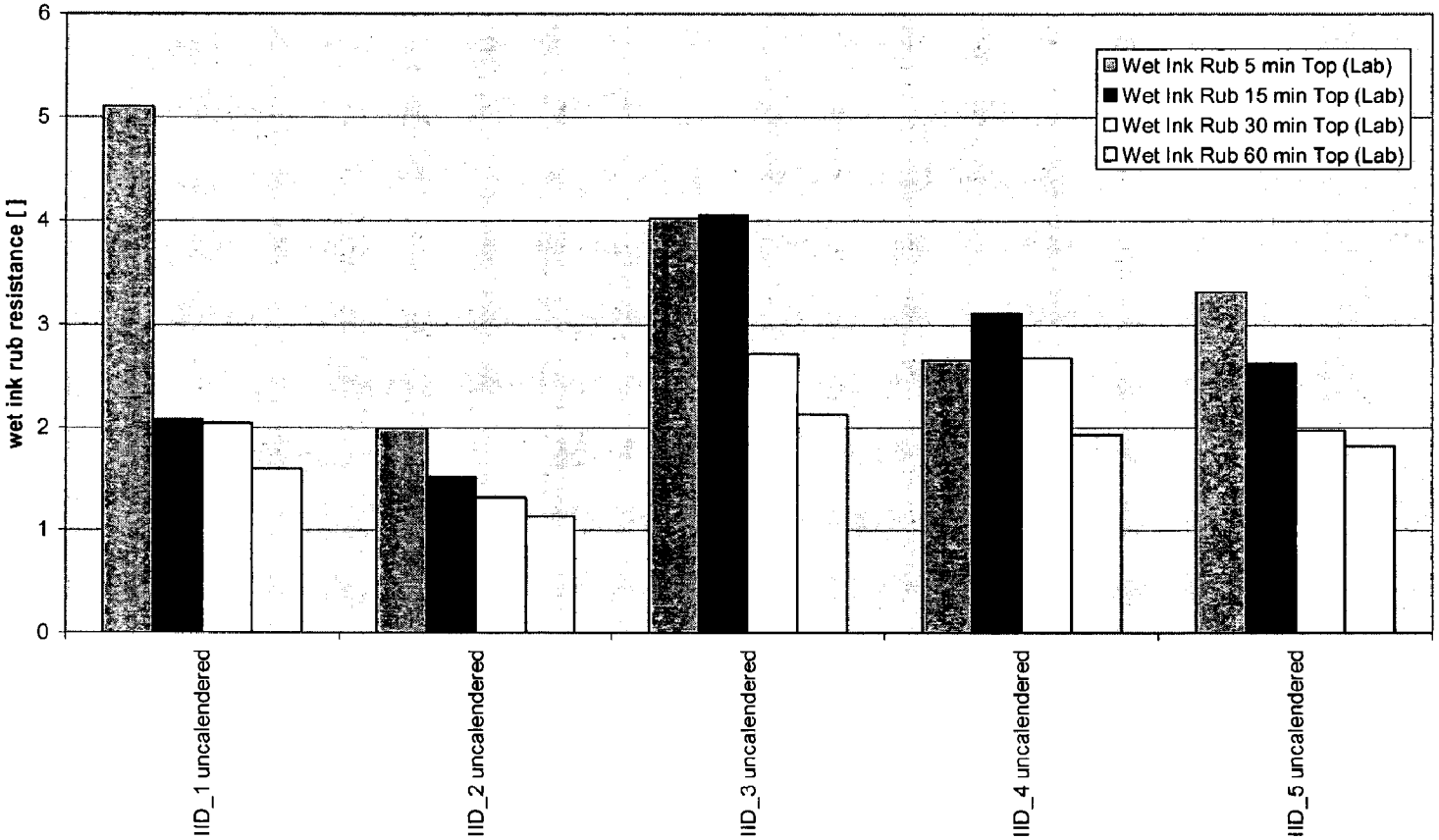
Figure 14:
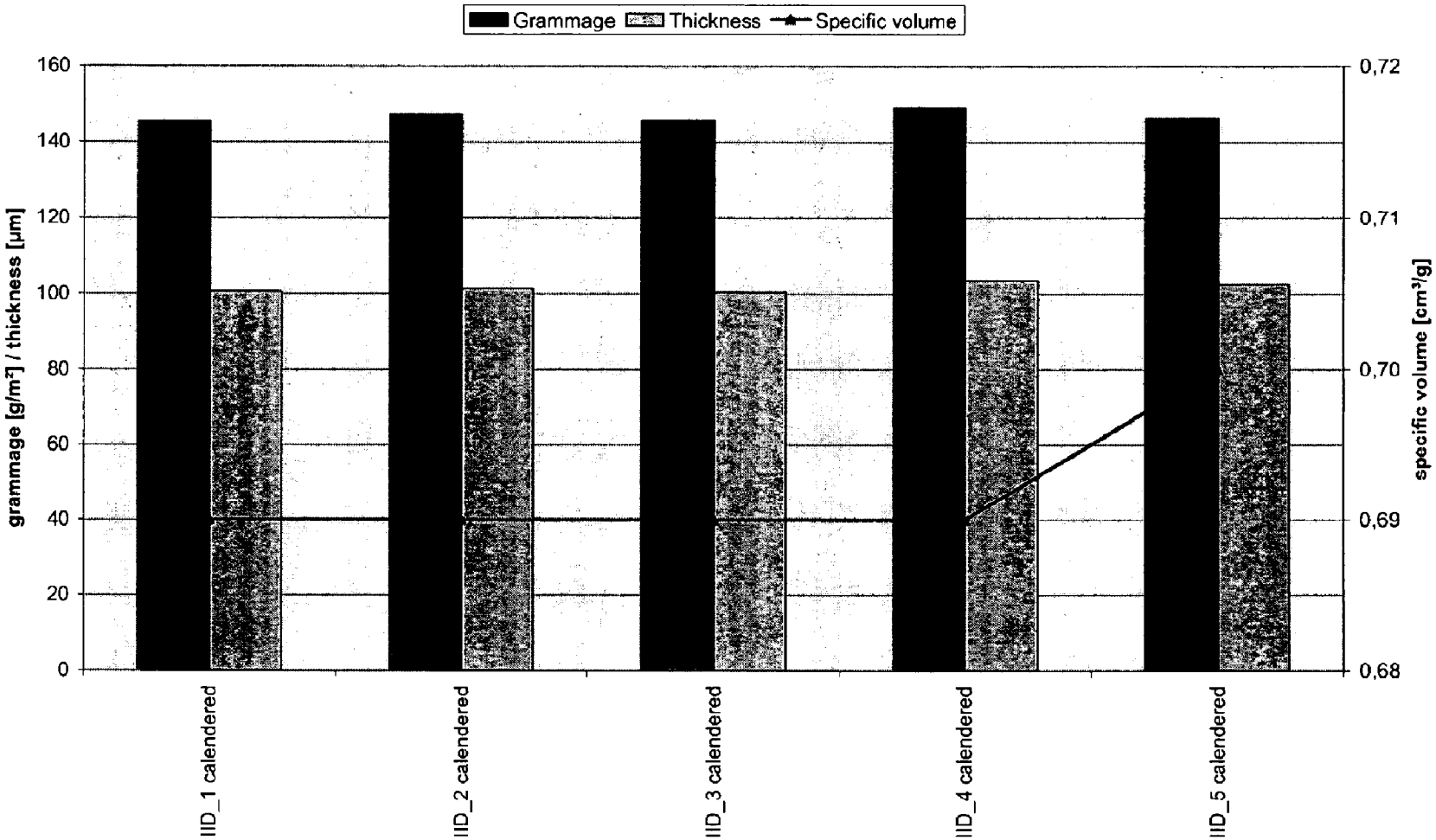
Figure 15:
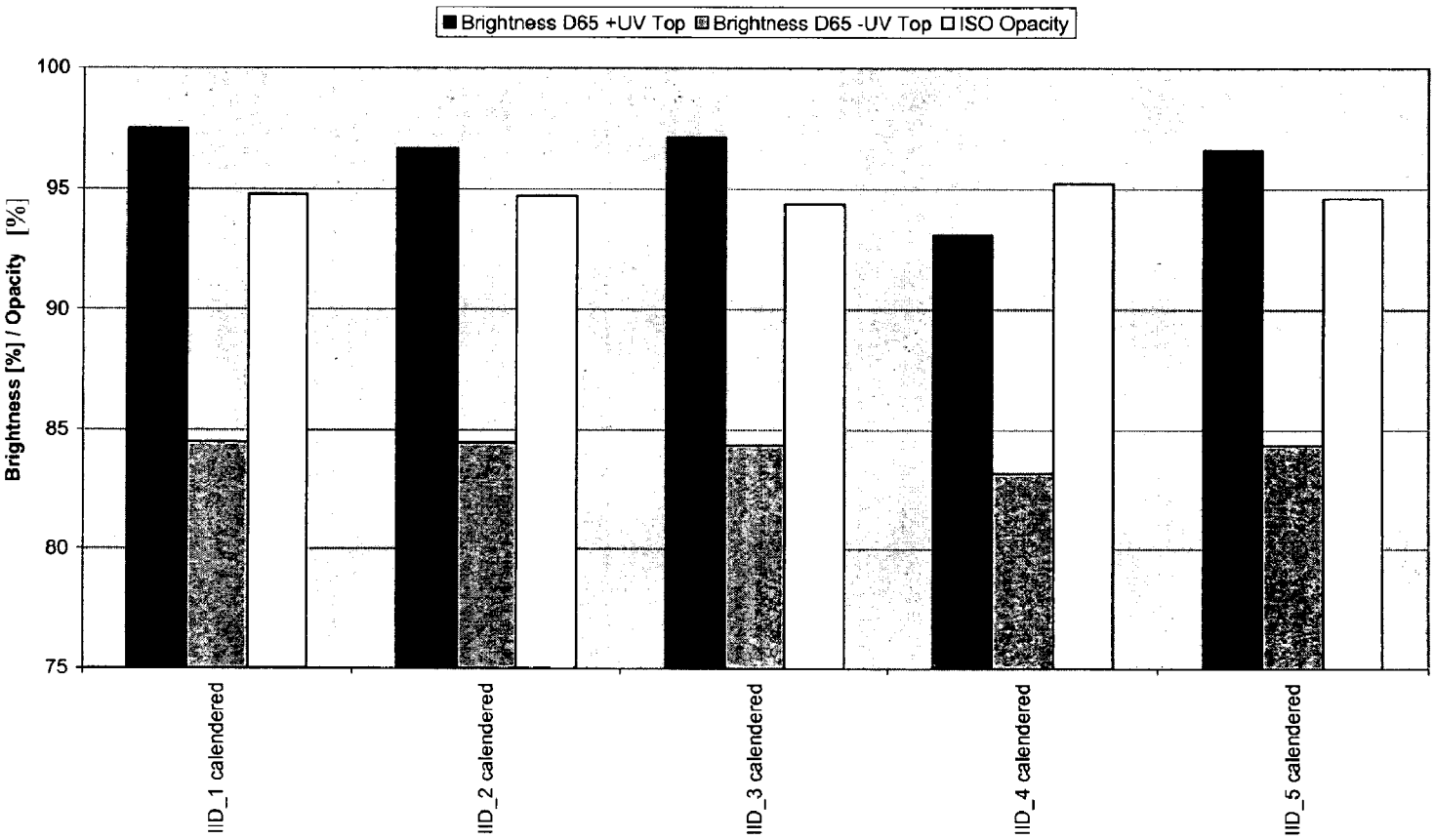
Figure 16:
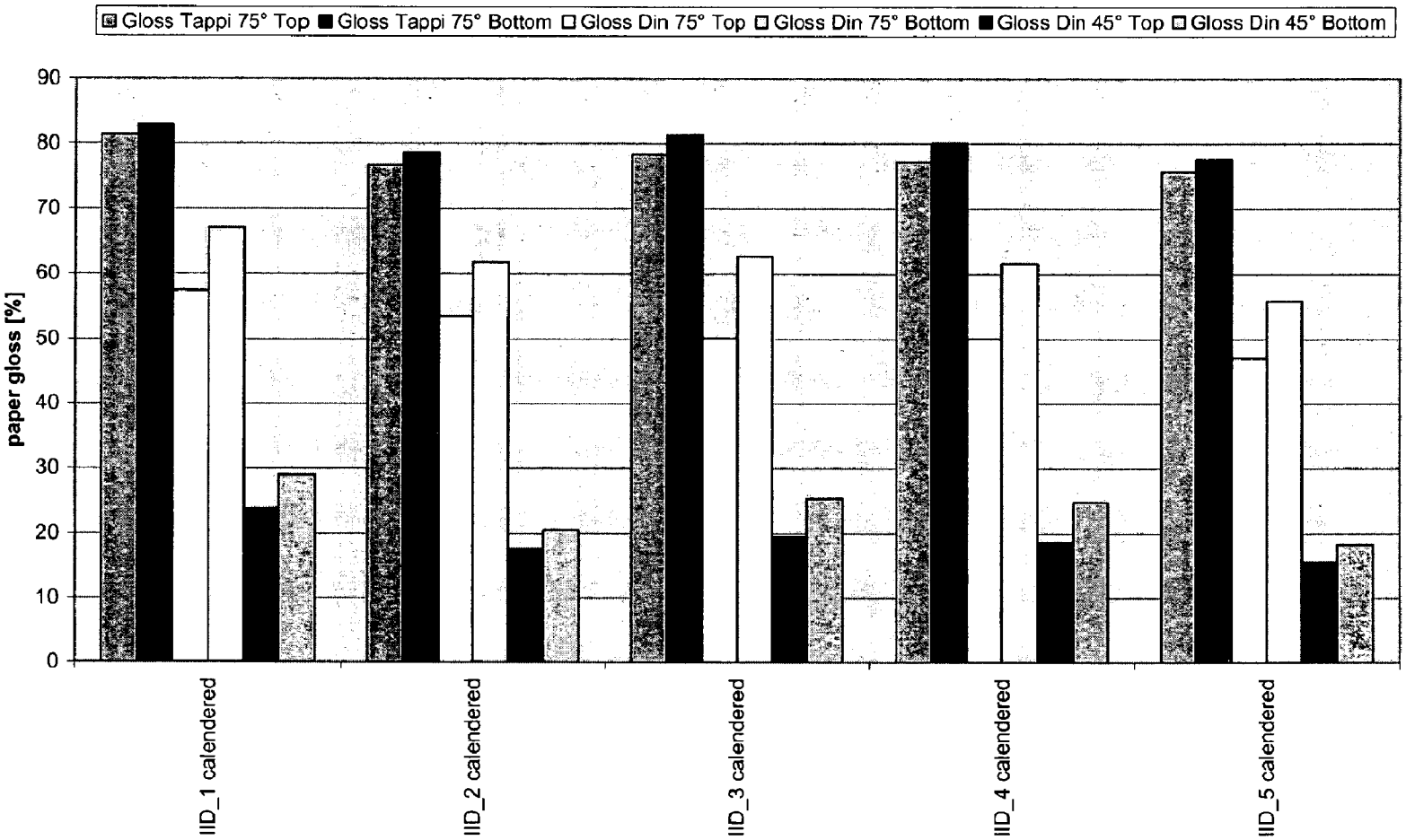
Figure 17:
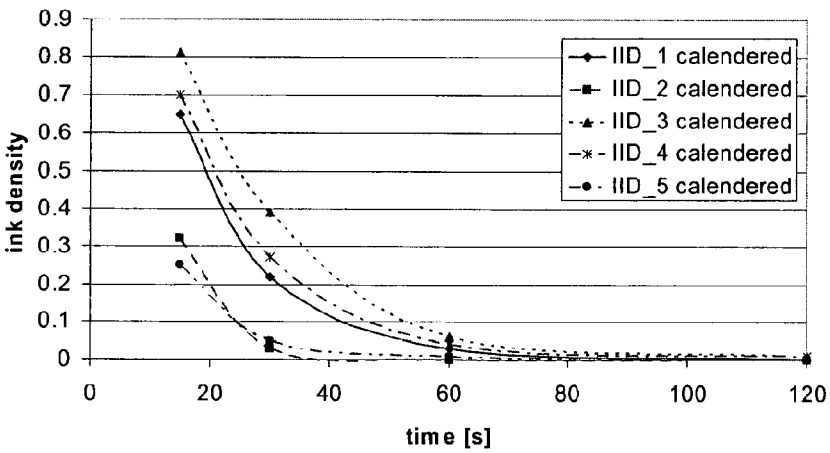
Figure 17:
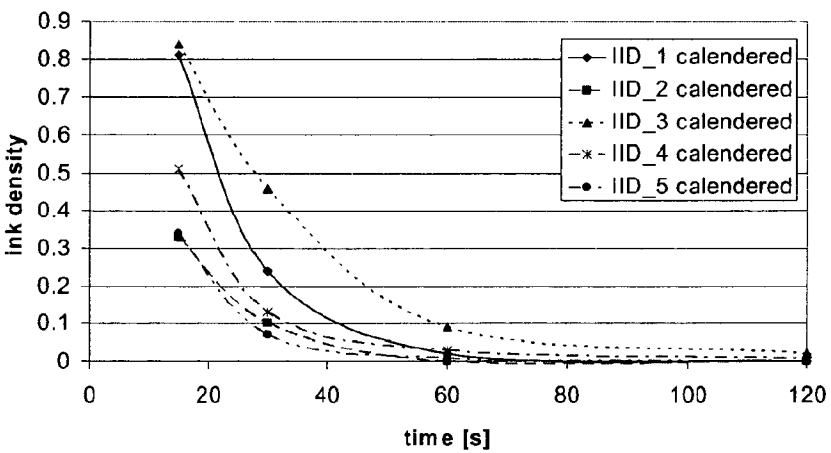
Figure 18:
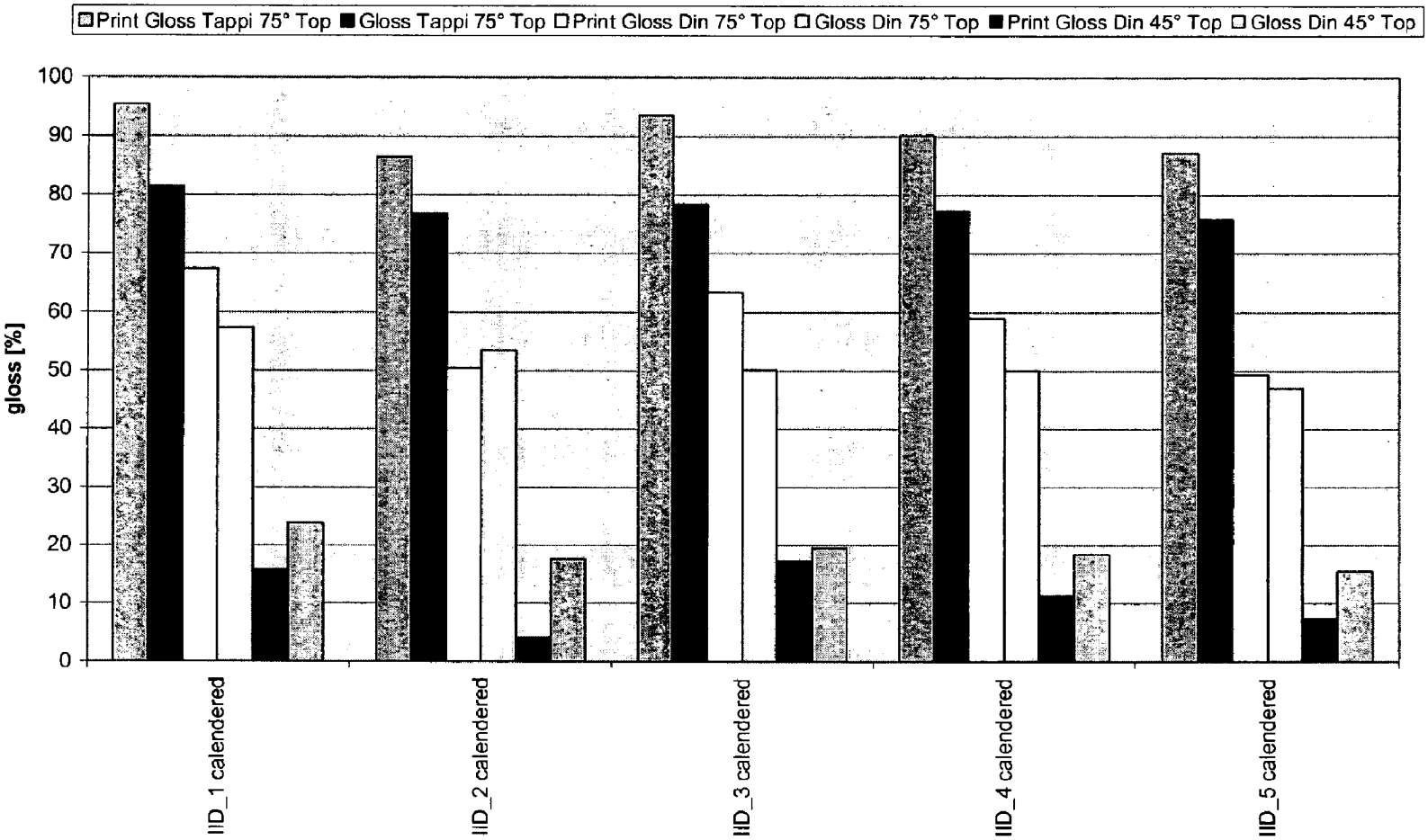
Figure 19:
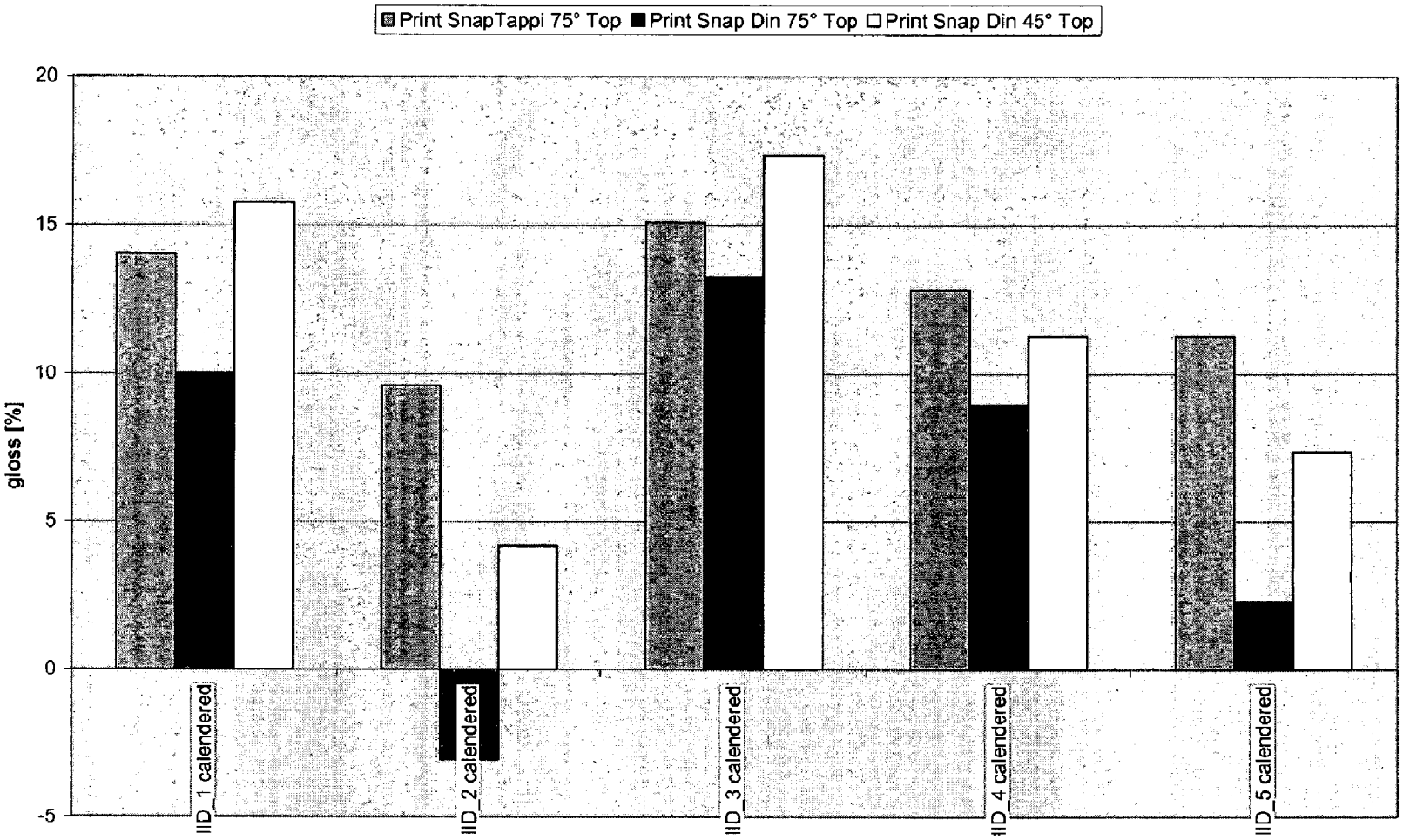
Figure 20:
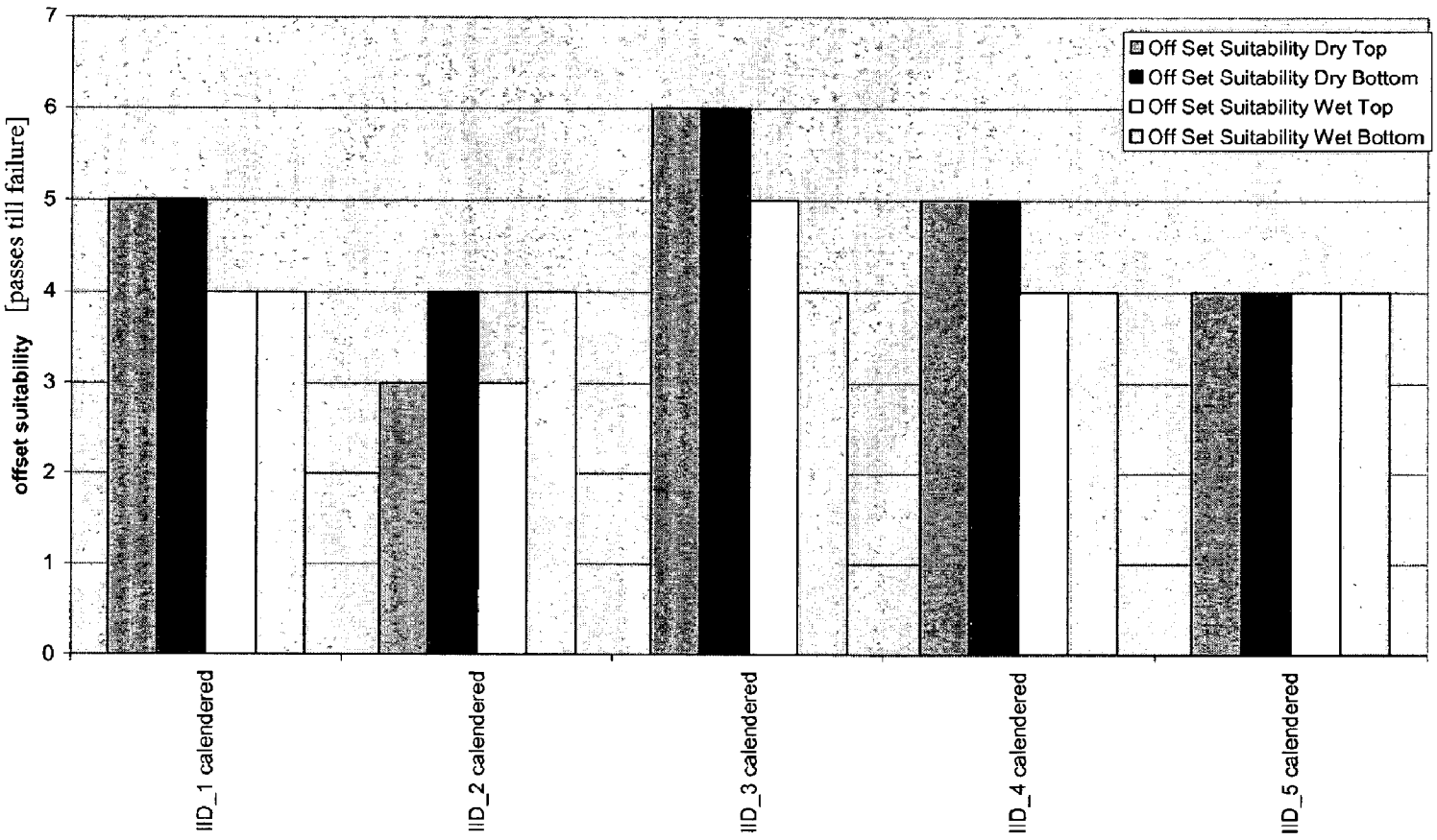
Figure 21:
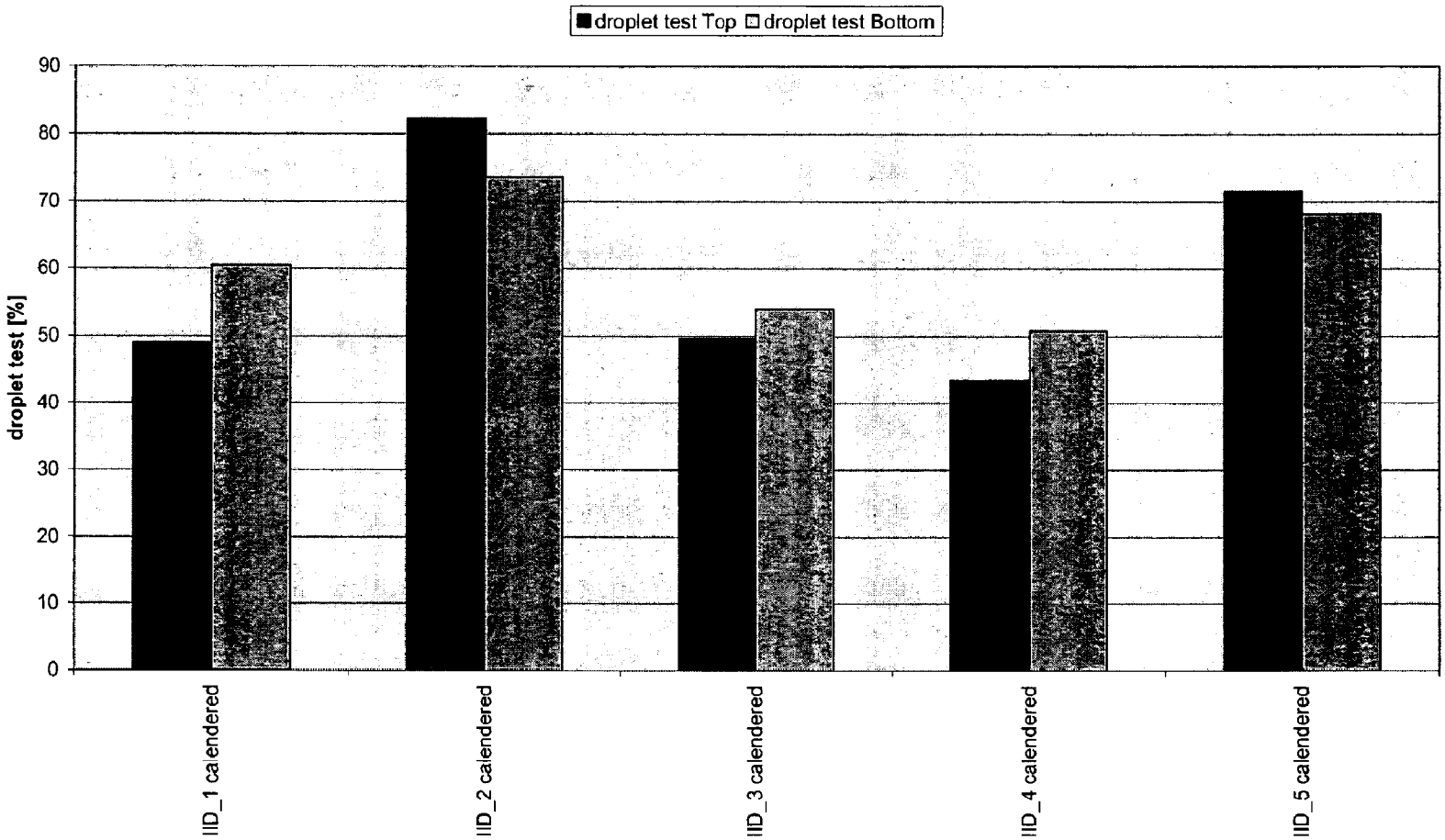
Figure 22:
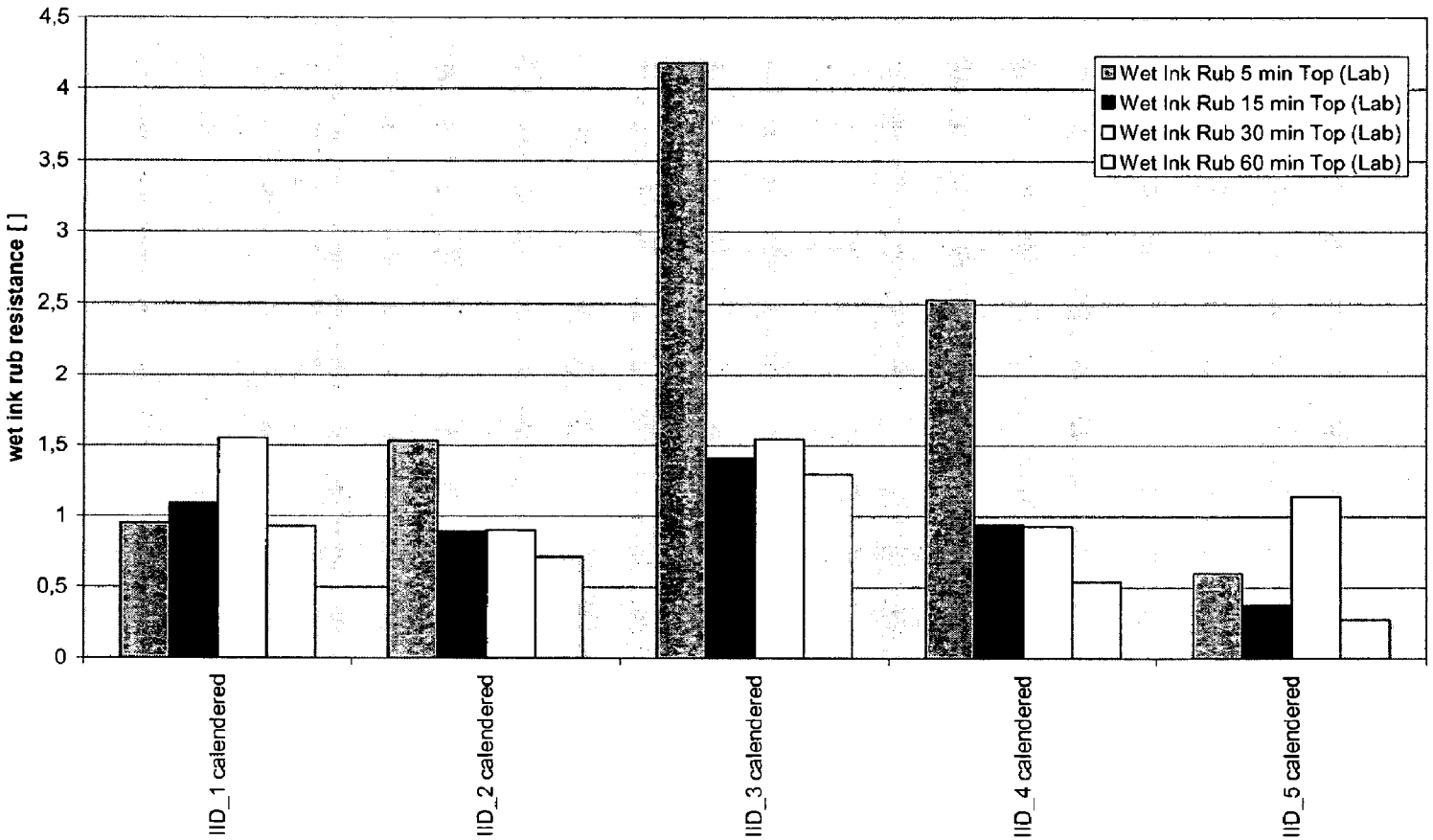
Figure 23:
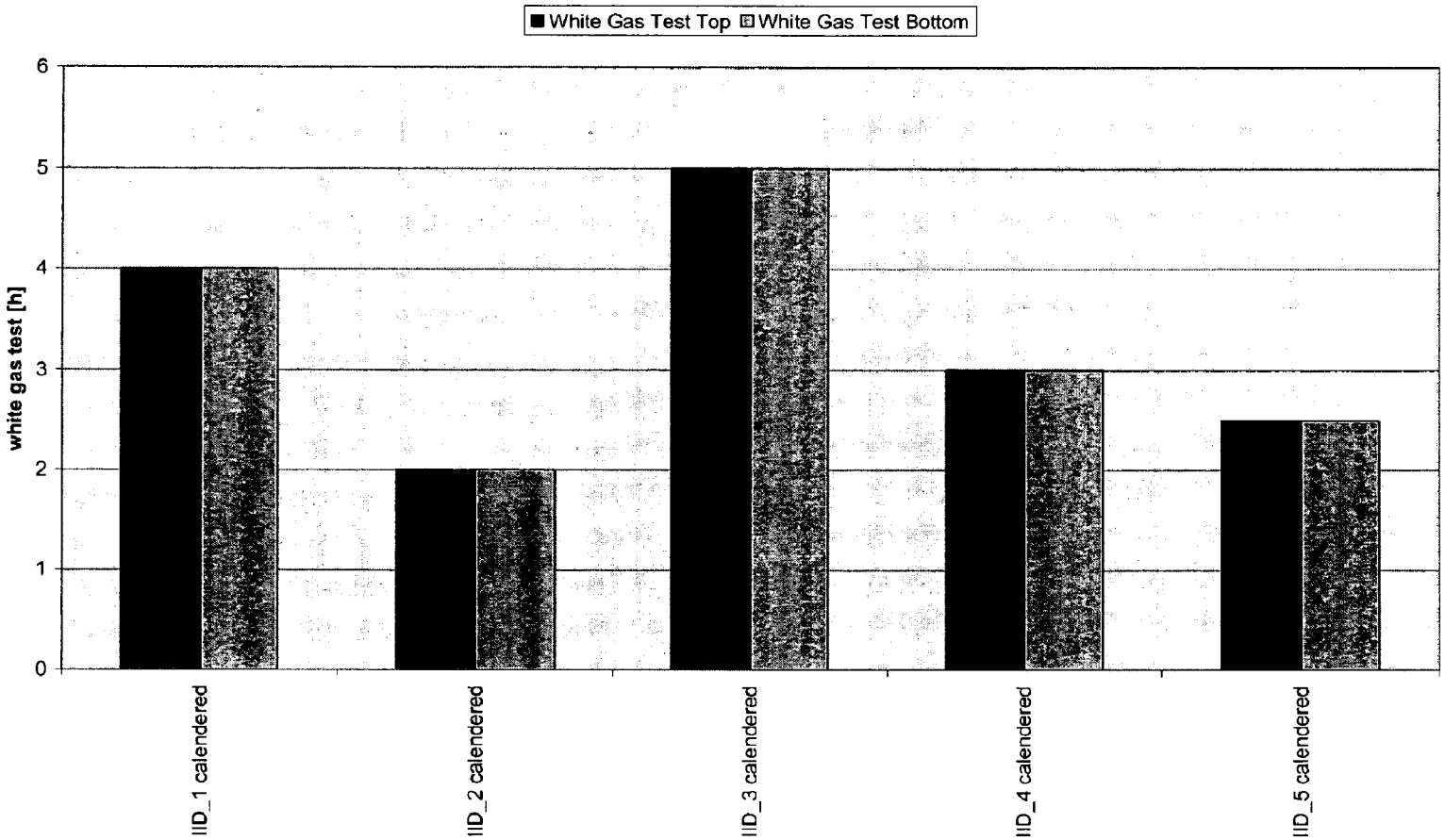
Figure 24:
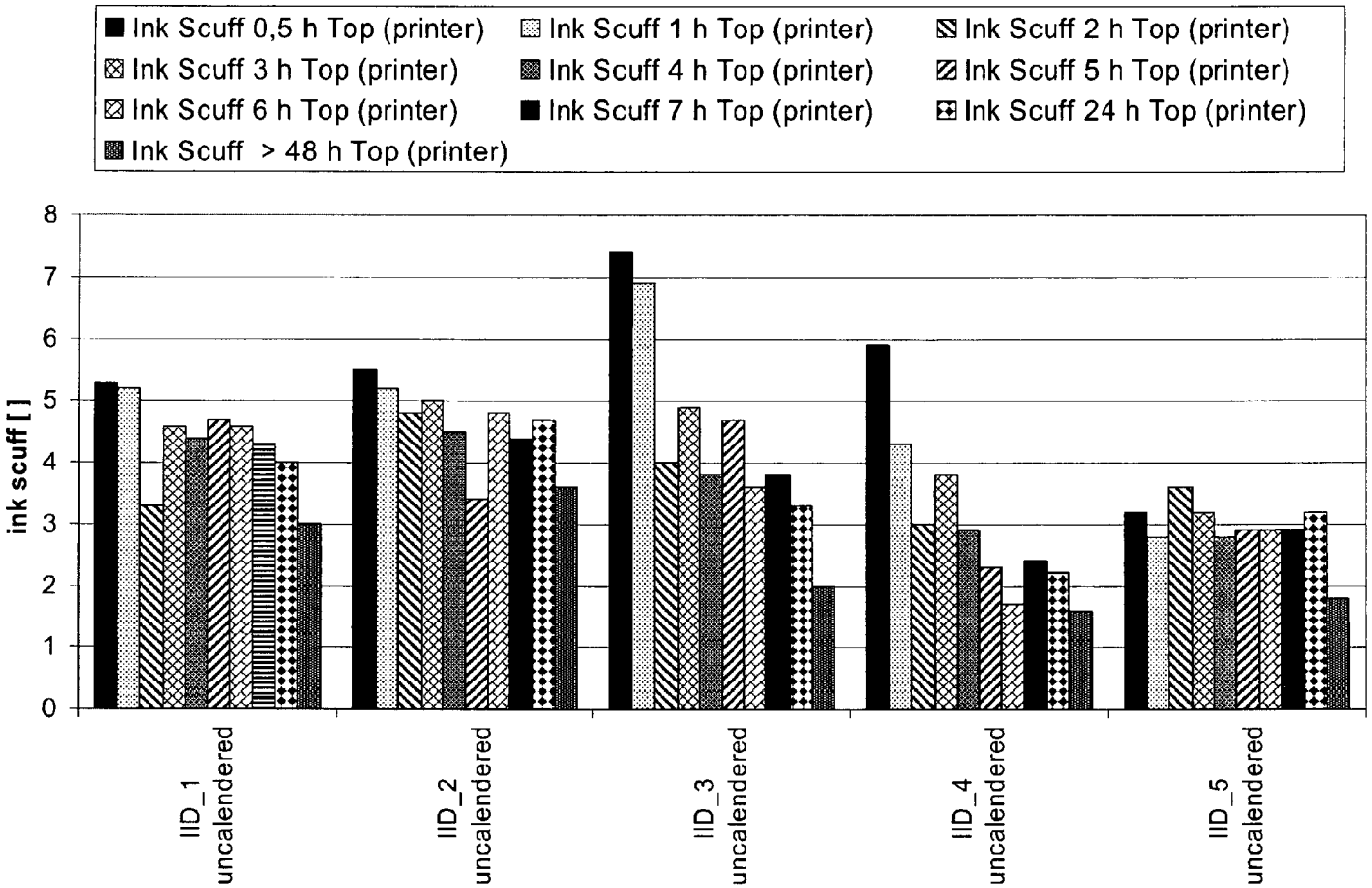
Figure 25:
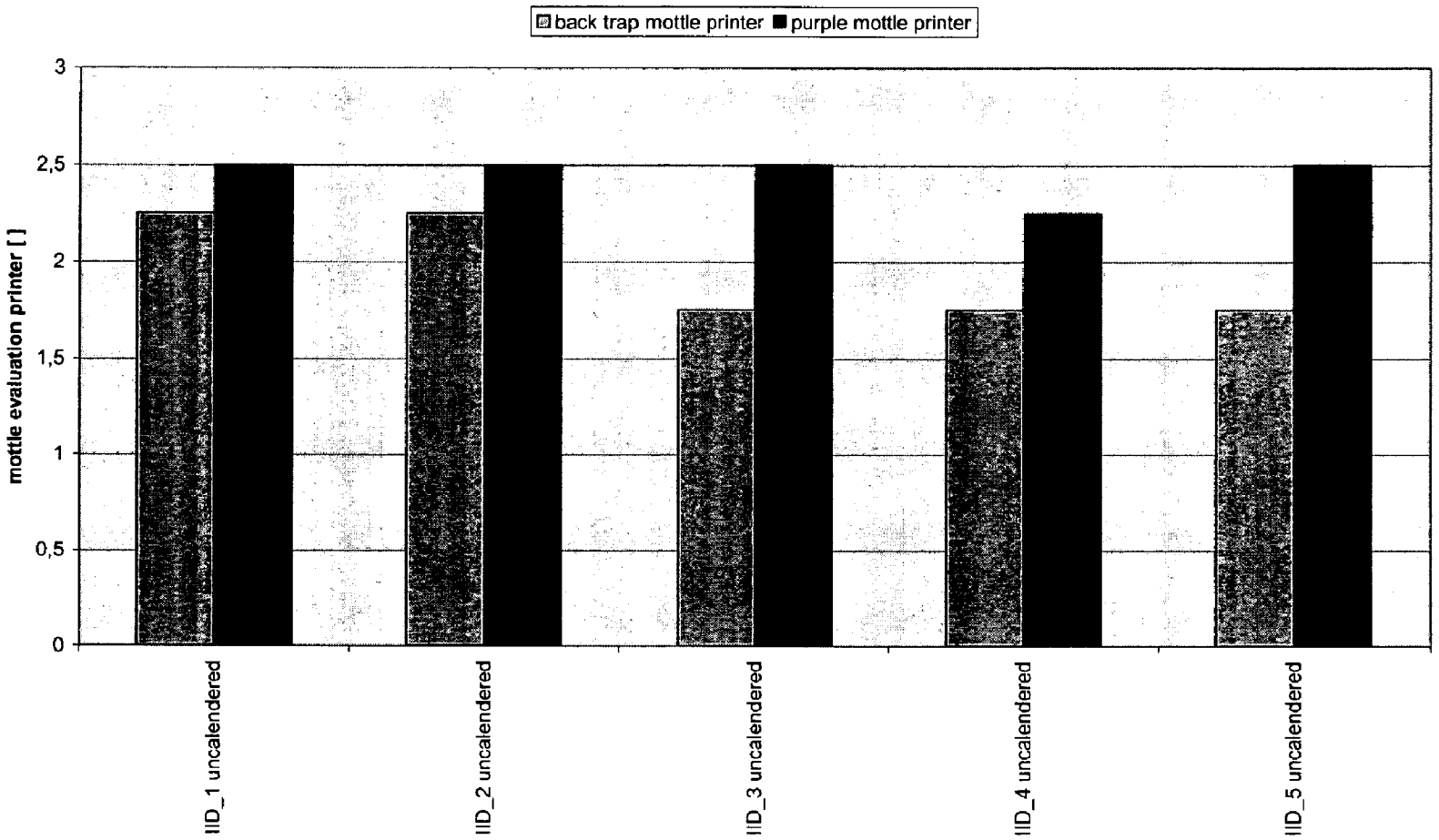
Figure 26:
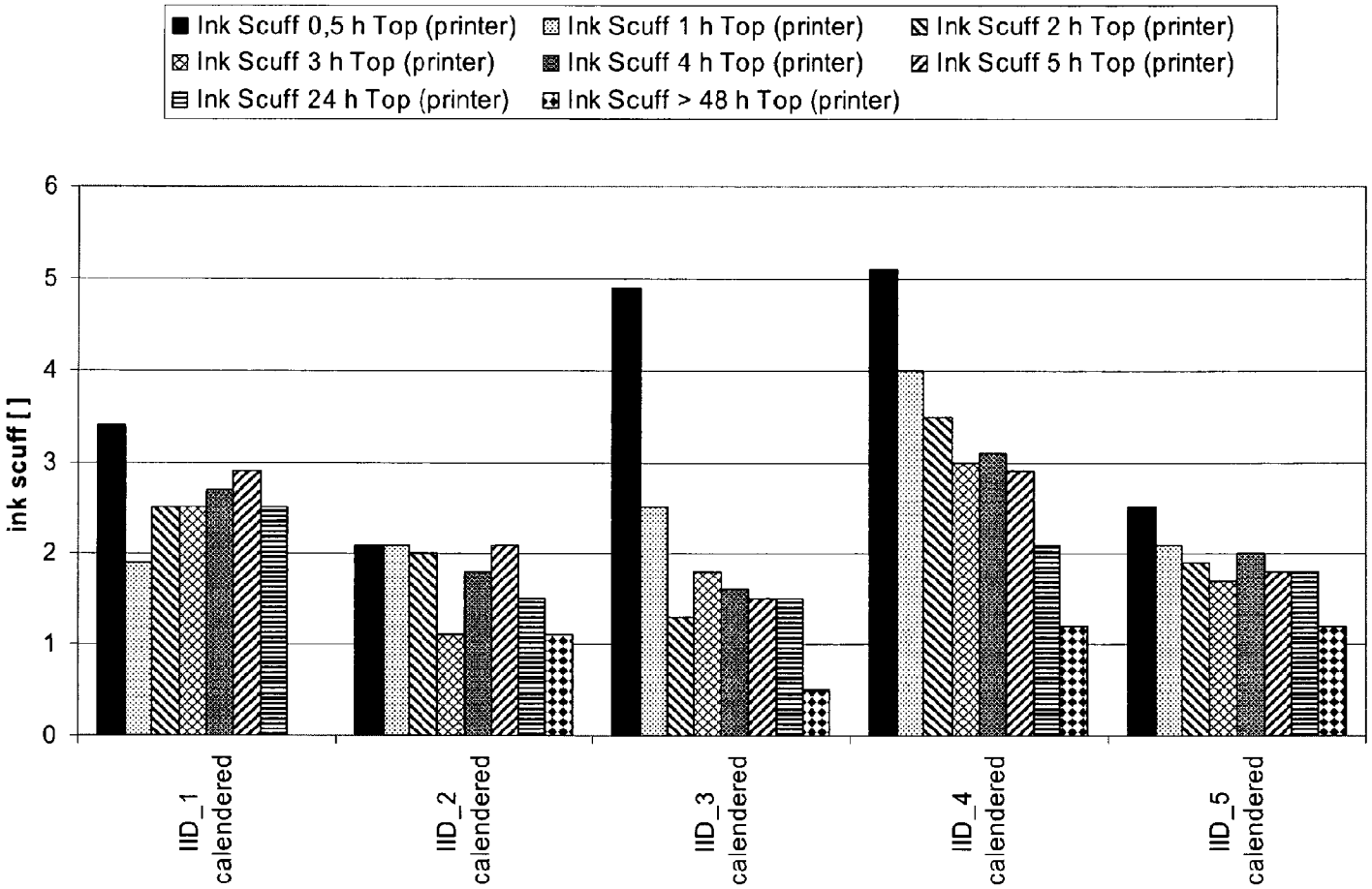
Figure 27:
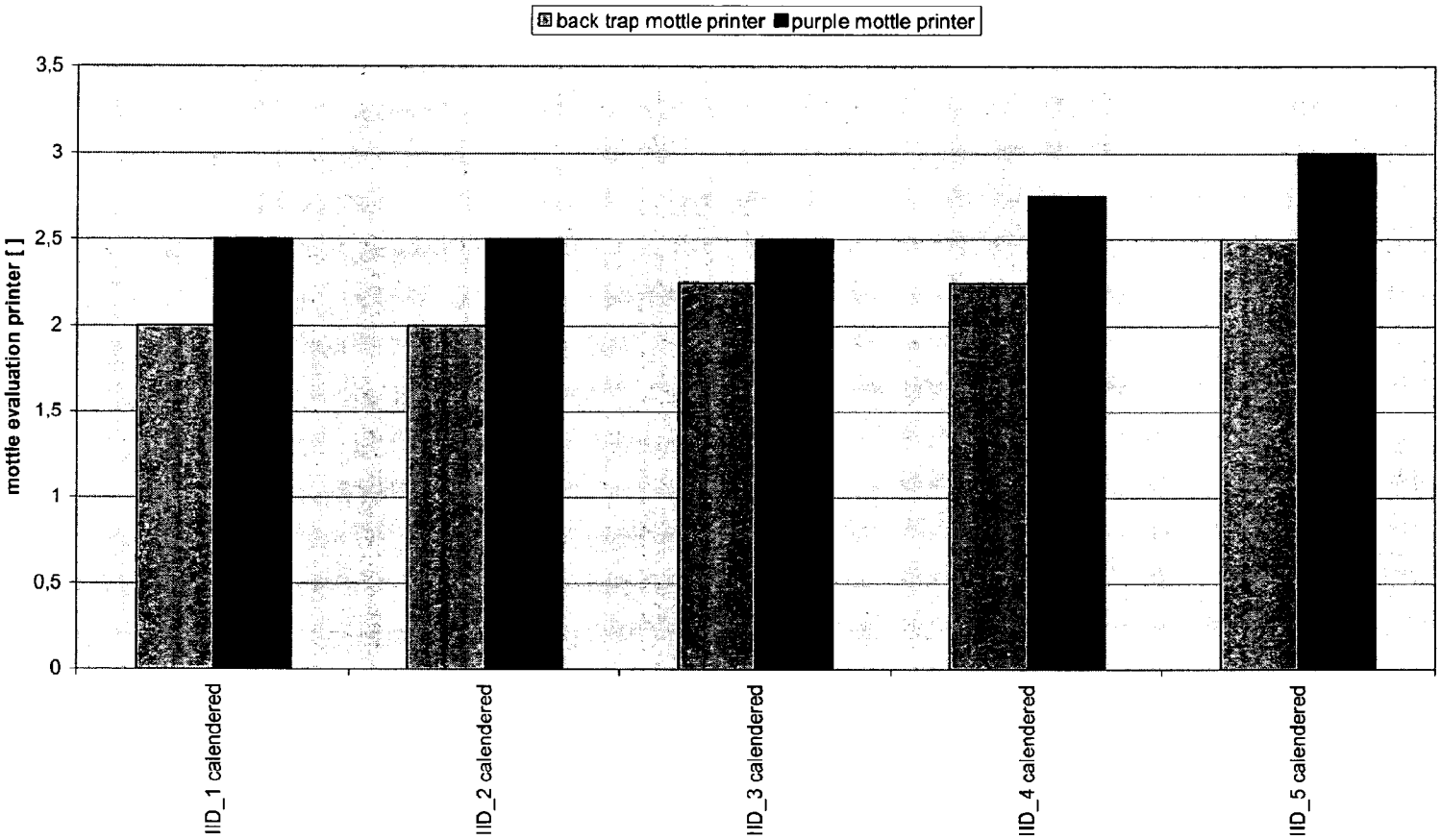
Figure 28:
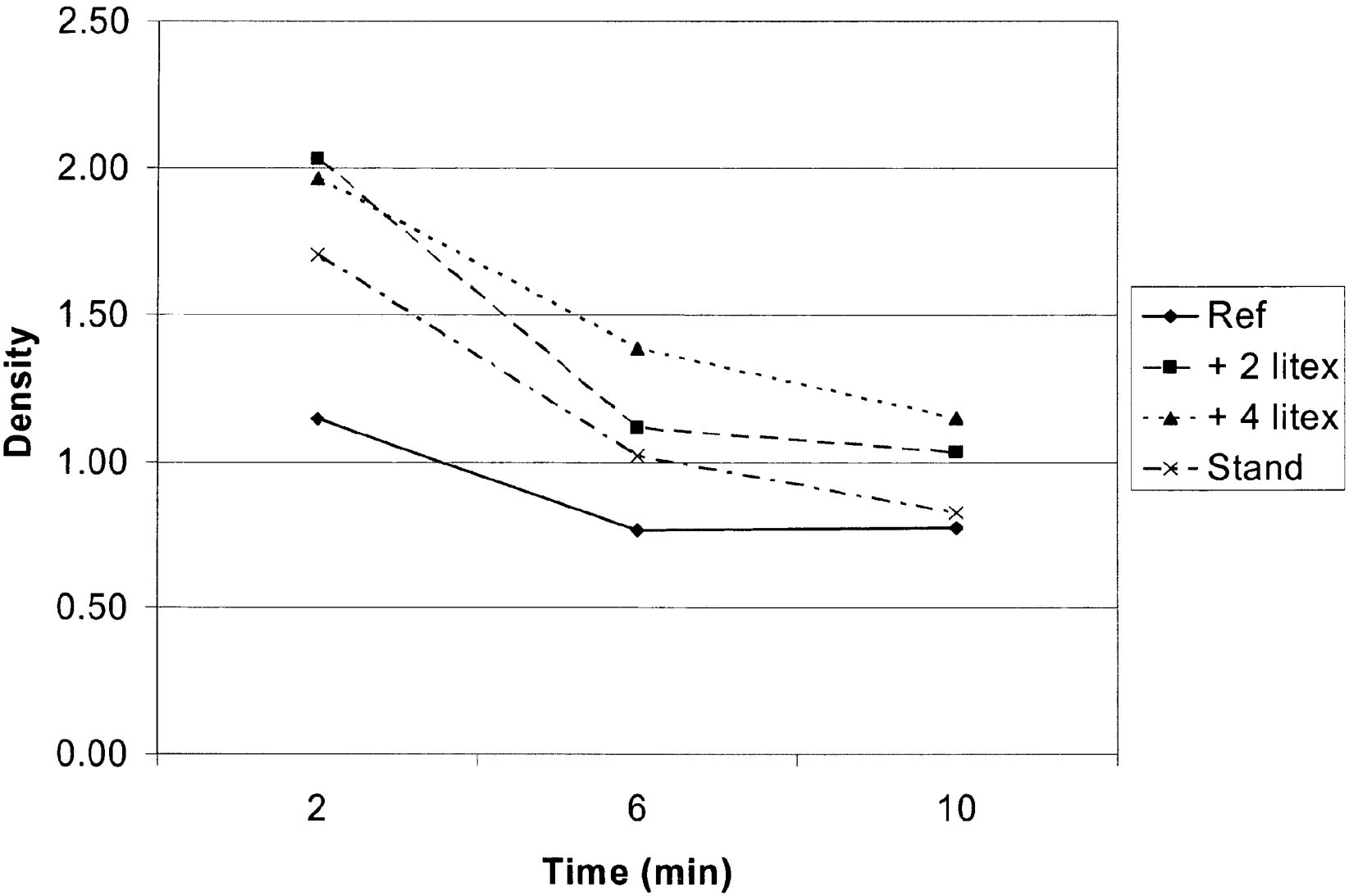
Figure 29:
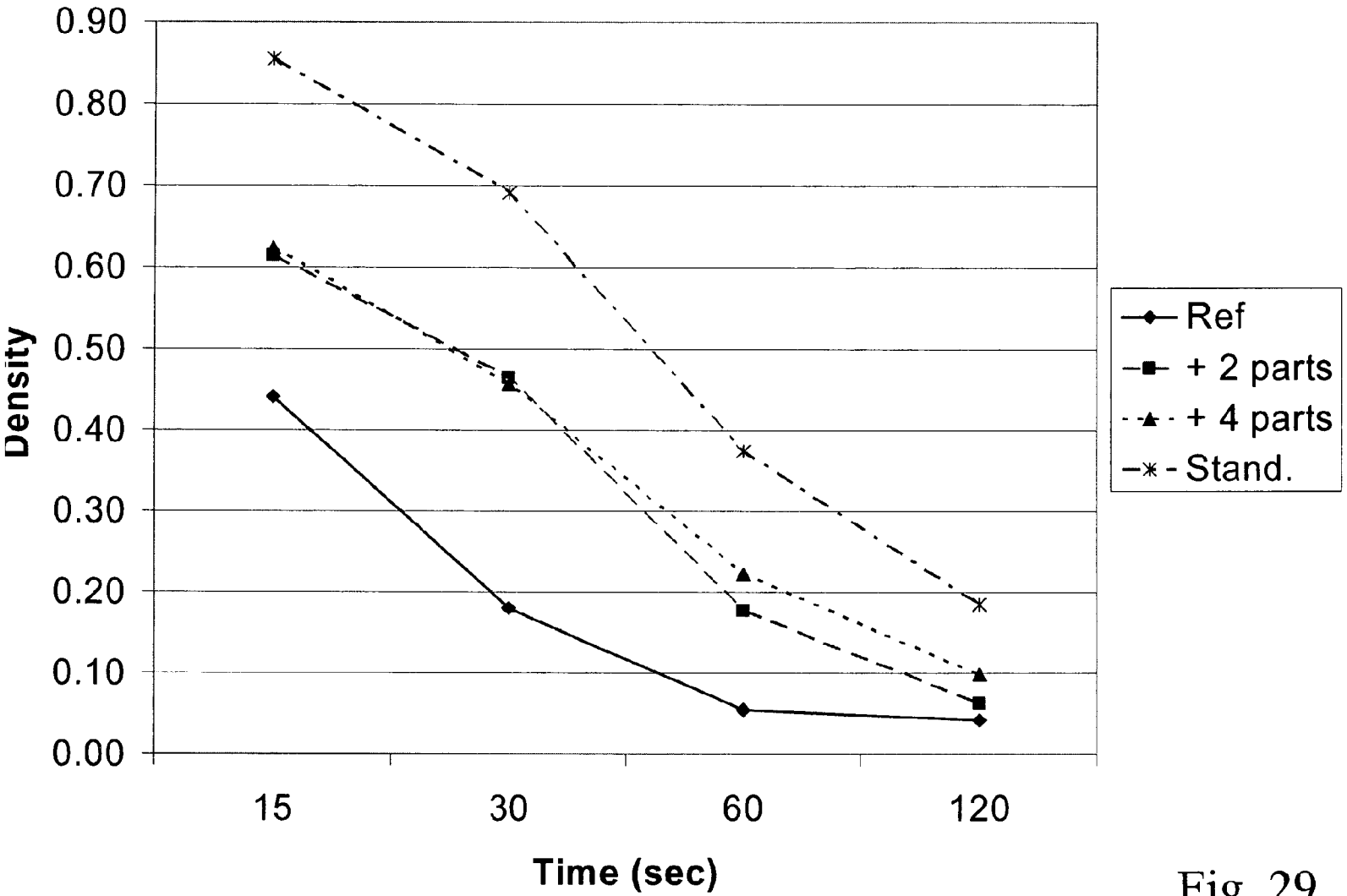
Figure 30:
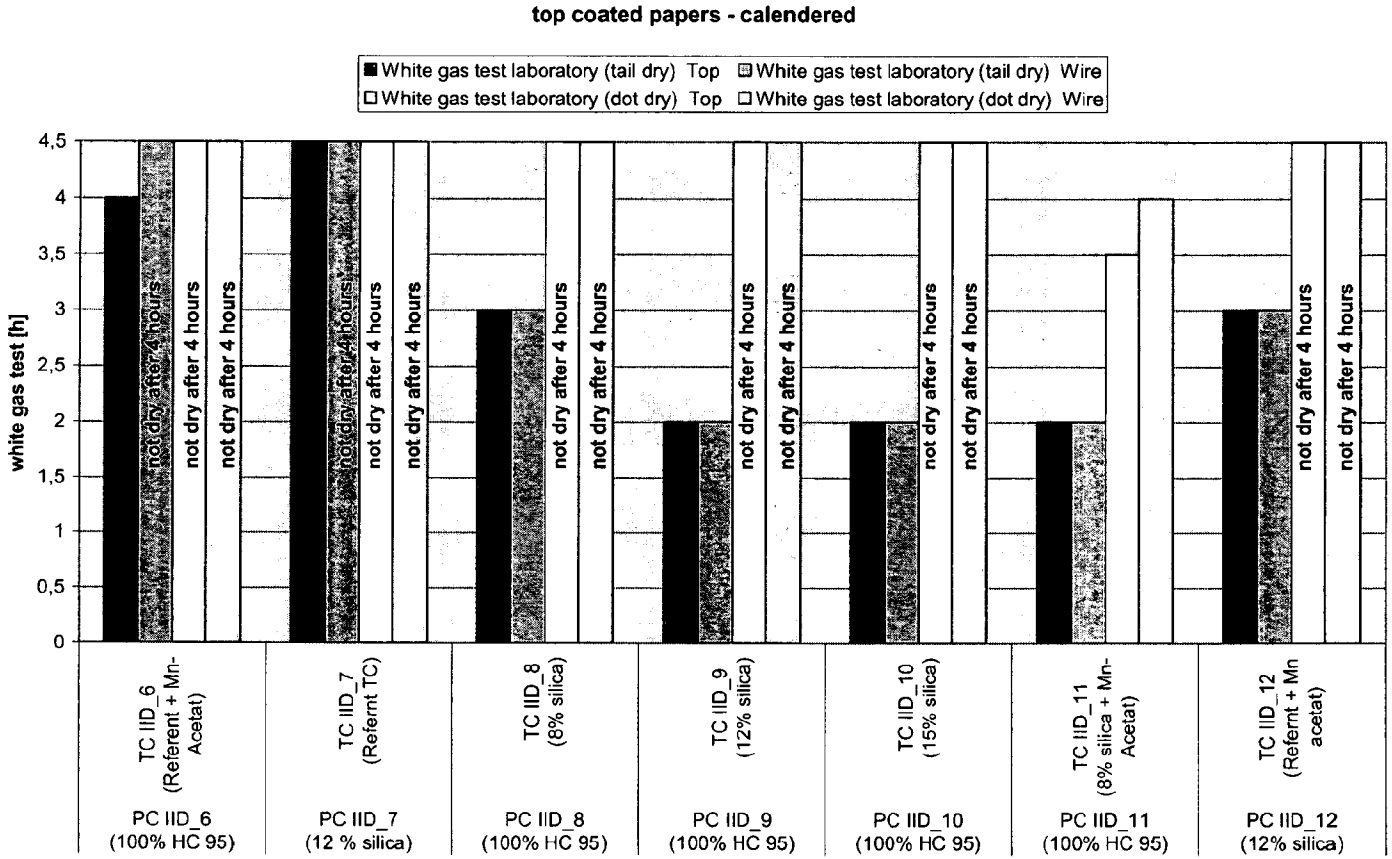
Figure 31:
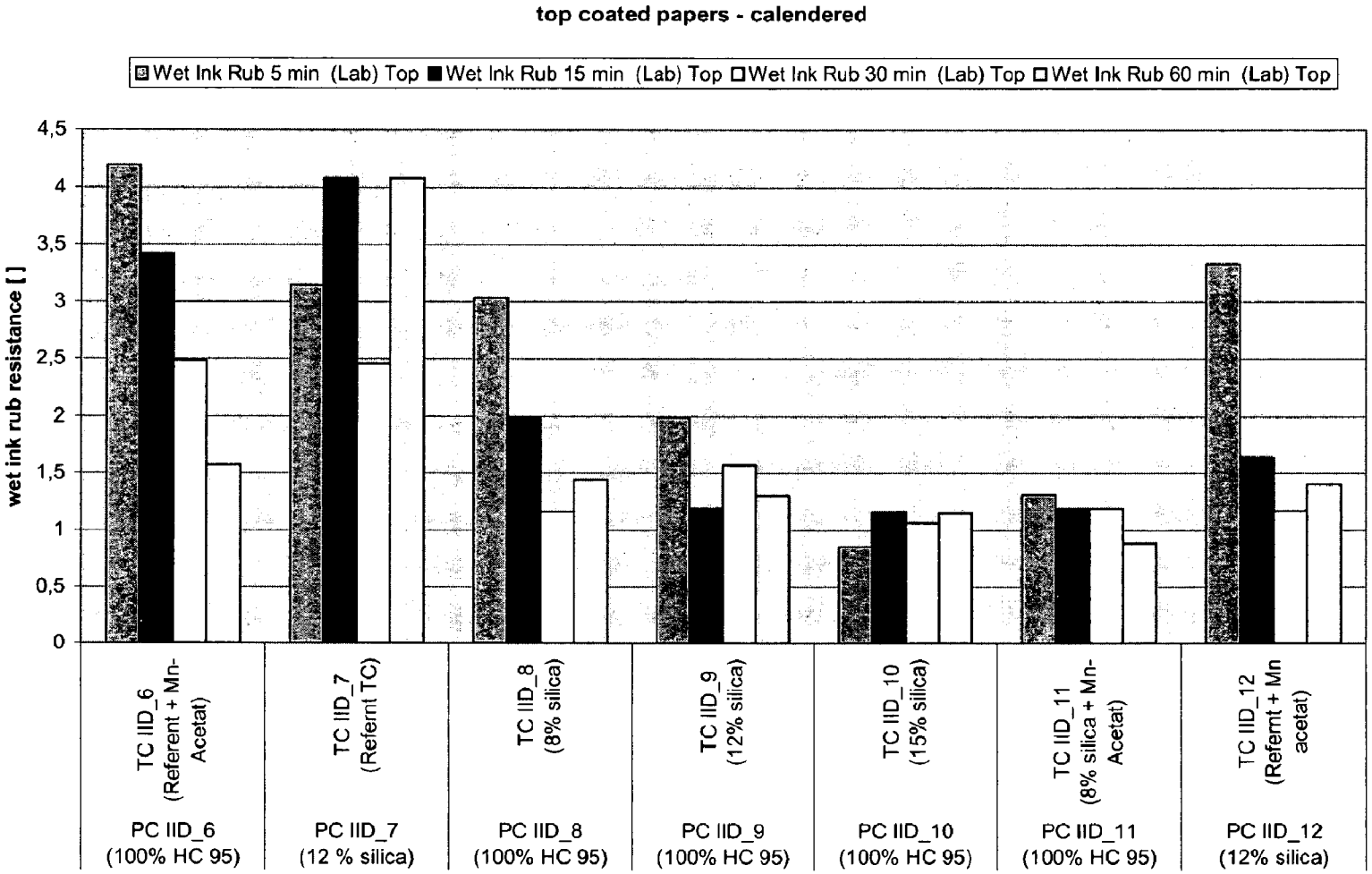
Figure 32:
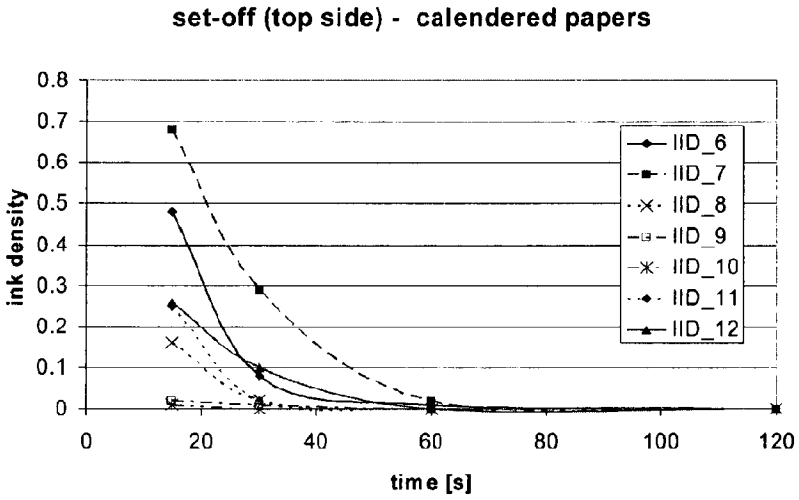
Figure 32:
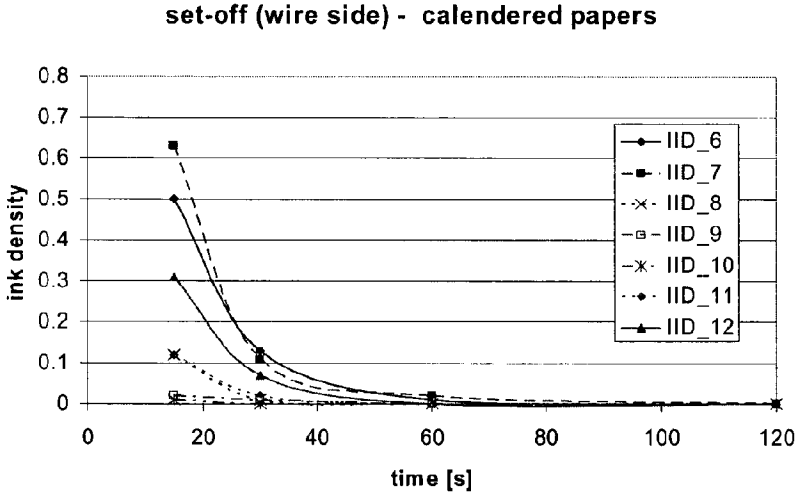
Figure 33:
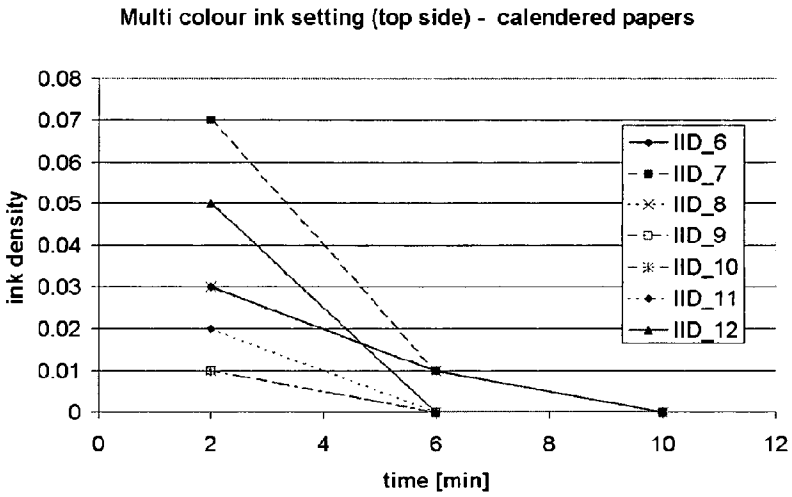
Figure 33:
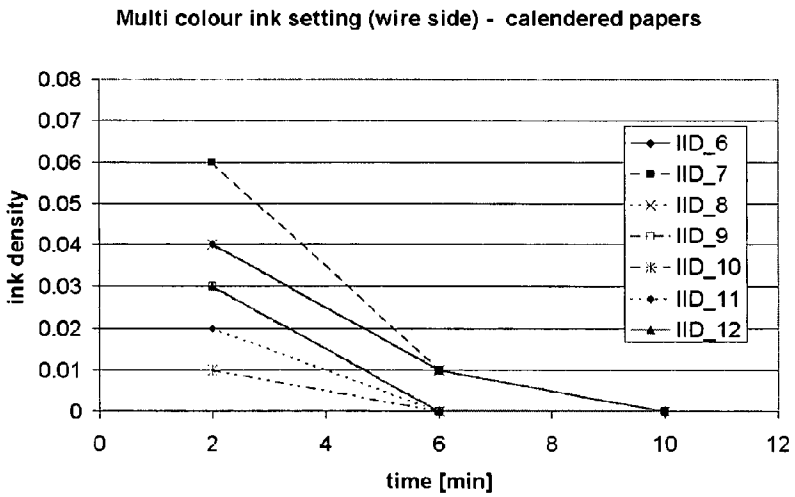
Figure 34:
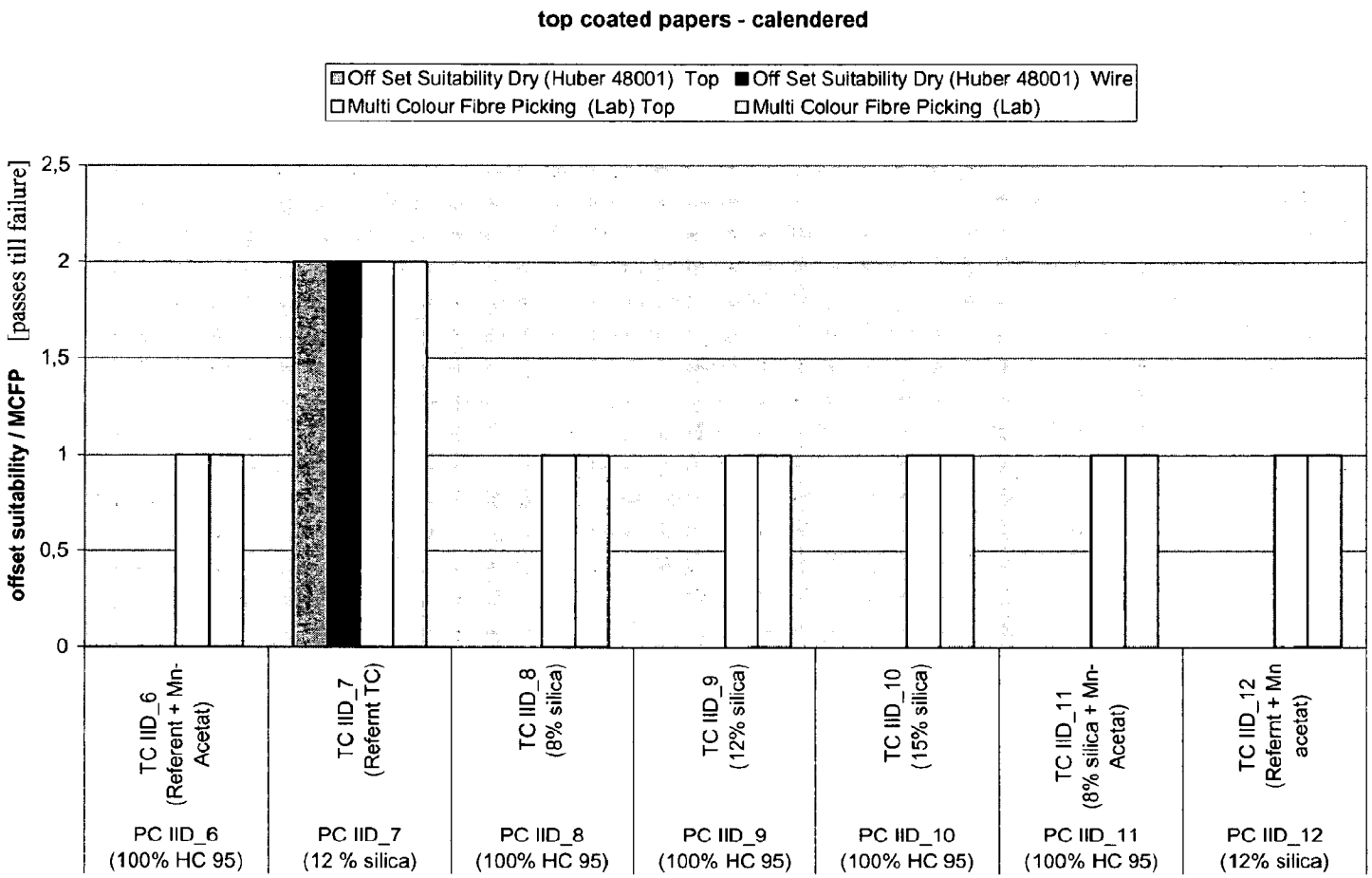
Figure 35:
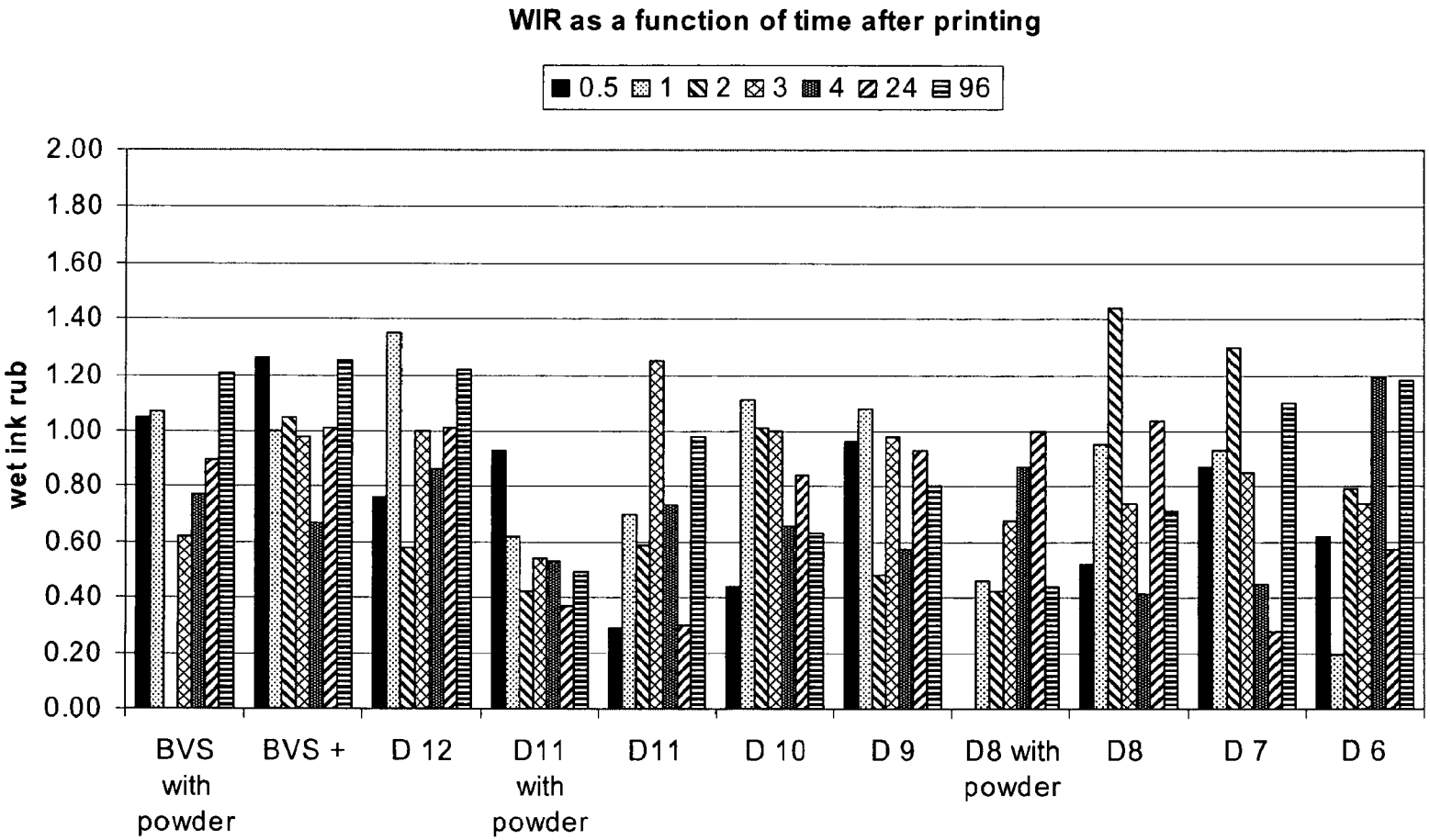
Figure 36:
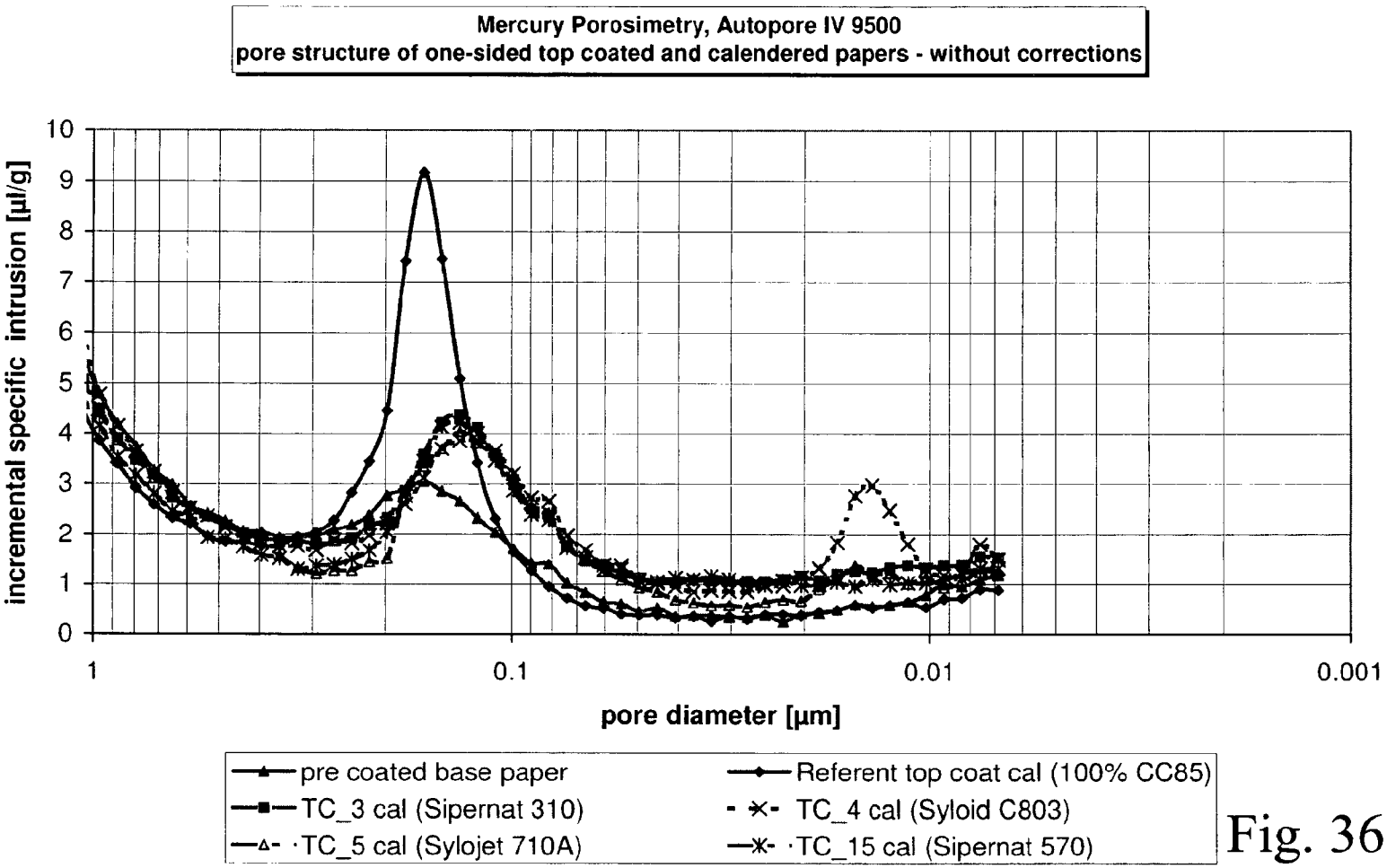
Figure 37:
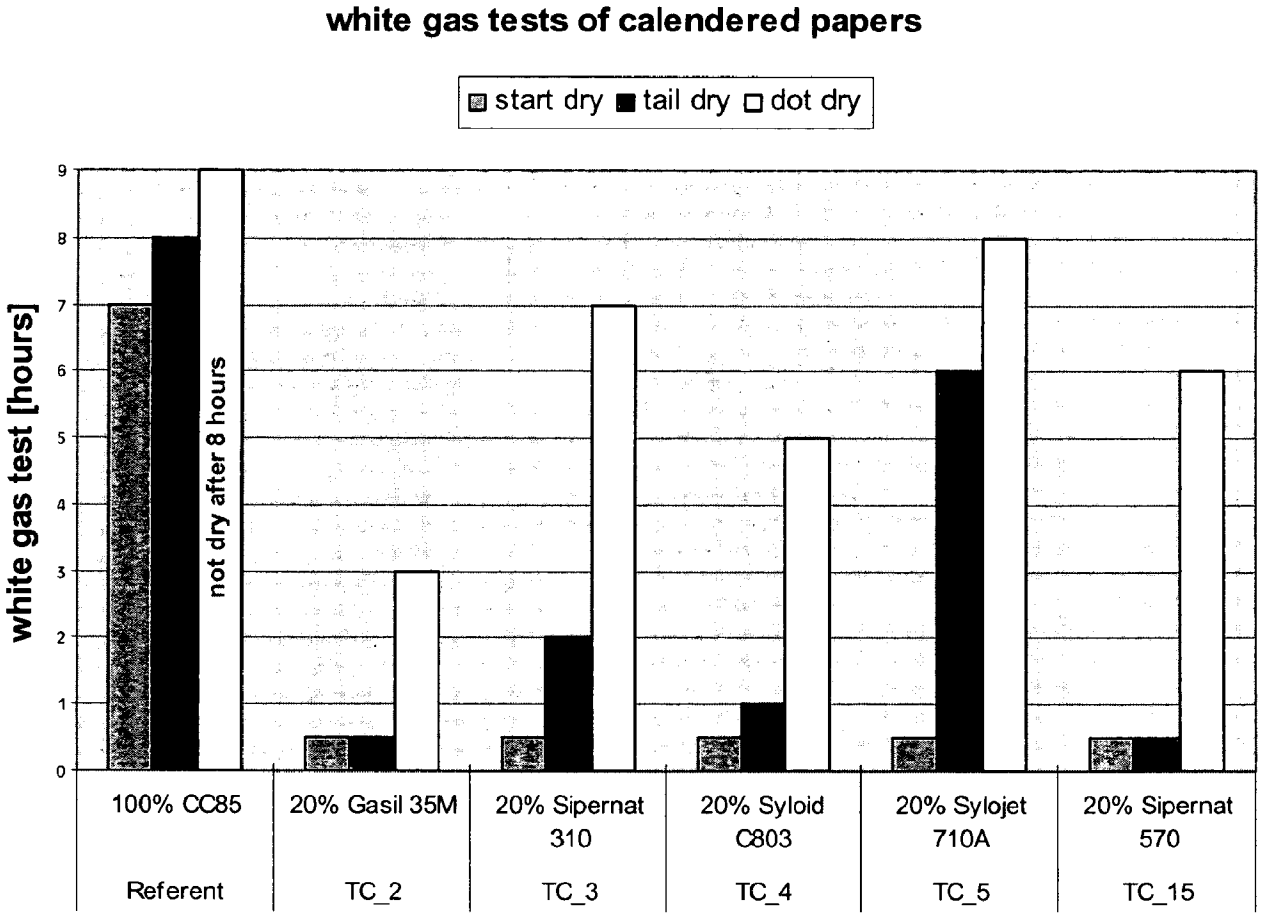
Figure 38:
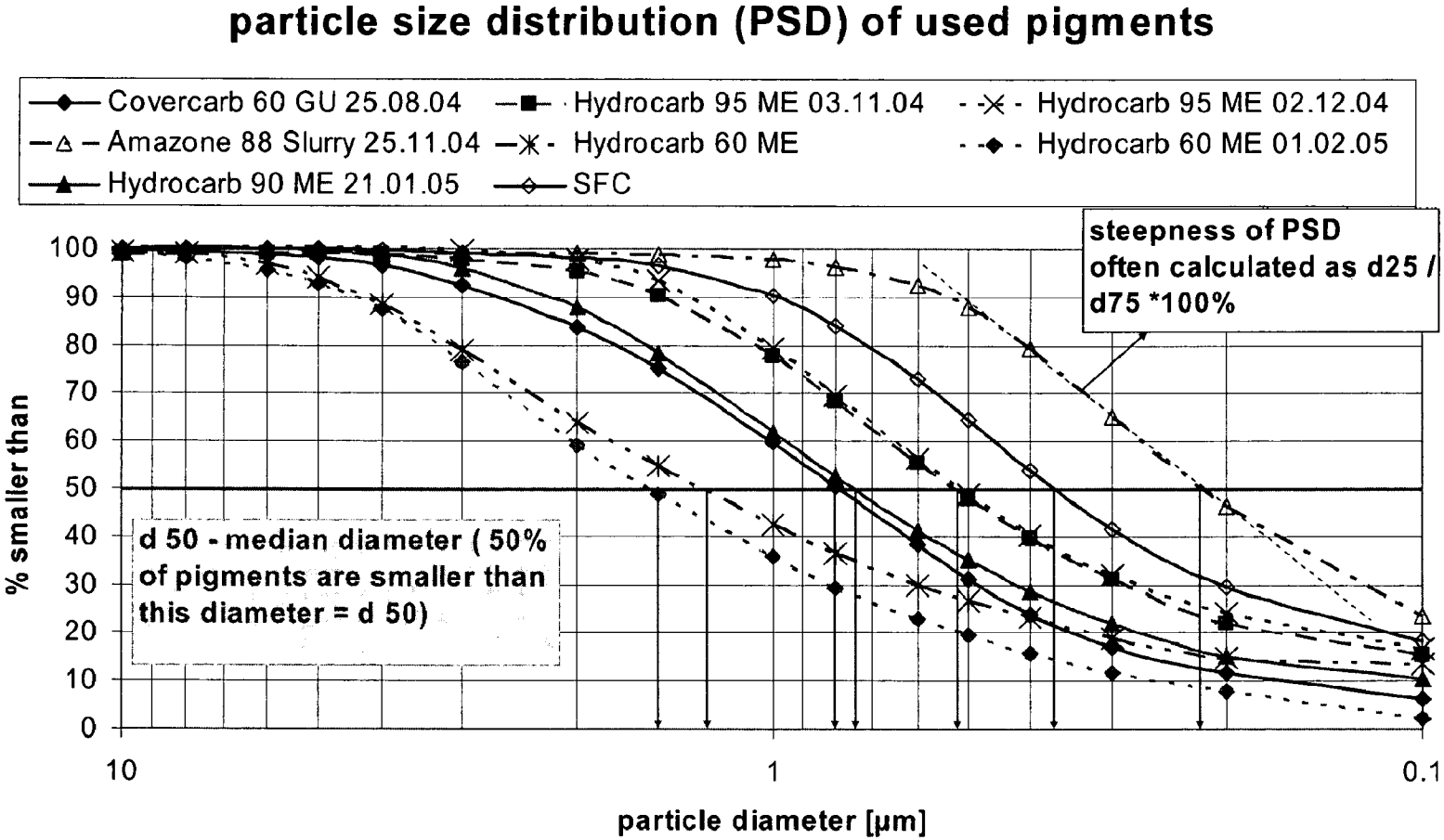

In the accompanying drawings preferred embodiments of the invention are displayed in which are shown:

FIG. 1 a schematic cut through a coated printing sheet;

FIG. 2 grammage and thickness of middle coated papers;

FIG. 3 paper gloss of middle coated papers;

FIG. 4 paper roughness of middle coated papers;

FIG. 5 grammage and thickness of top coated papers—uncalendered;

FIG. 6 brightness and opacity of top coated papers—uncalendered;

FIG. 7 paper gloss level of top coated papers—uncalendered;

FIG. 8 ink setting of top coated papers—uncalendered, a) top side, b) wire side;

FIG. 9 practical print gloss vs. paper gloss of top coated papers—uncalendered;

FIG. 10 print snap of top coated papers—uncalendered;

FIG. 11 offset suitability of top coated papers—uncalendered;

FIG. 12 droplet test of top coated papers—uncalendered;

FIG. 13 wet ink rub resistance (ink scuff) measured of top coated papers—uncalendered;

FIG. 14 grammage and thickness of top coated papers—calendered;

FIG. 15 brightness and opacity of top coated papers—calendered;

FIG. 16 paper gloss level of top coated papers—calendered;

FIG. 17 ink setting of top coated papers—calendered, a) top side, b) wire side;

FIG. 18 practical print gloss vs. paper gloss of top coated papers—calendered;

FIG. 19 print snap of top coated papers—calendered;

FIG. 20 offset suitability of top coated papers—calendered;

FIG. 21 droplet test of top coated papers—calendered;

FIG. 22 wet ink rub resistance (ink scuff) measured of top coated papers—calendered;

FIG. 23 white gas test (cotton tip) carried out in laboratory on calendered papers;

FIG. 24 ink scuff results of printed papers—uncalendered;

FIG. 25 mottle evaluations of uncalendered papers;

FIG. 26 ink scuff results of printed papers—calendered;

FIG. 27 mottle evaluations of calendered papers;

FIG. 28 multi colour ink setting for differing latex contents;

FIG. 29 set off measurements for differing latex contents;

FIG. 30 white gas test results of calendered papers;

FIG. 31 wet ink rub resistance (ink scuff) test results of calendered papers;

FIG. 32 set off values for top-side (a) and wire side (b) of calendered papers;

FIG. 33 multi colour ink setting values for top-side (a) and wire side (b) of calendered papers;

FIG. 34 offset suitability and MCFP for calendered papers;

FIG. 35 wet ink rub test (ink scuff) results for calendered papers;

FIG. 36 mercury intrusion porosity data of final coatings—coated papers;

FIG. 37 comparison of white gas tests of samples with silica gel and samples with precipitated silica; and FIG. 38 particle size distributions of used pigments.

DETAILED DESCRIPTION OF THE PREFERRED EMBODIMENTS

Referring to the drawings, which are for the purpose of illustrating the present preferred embodiments of the invention and not for the purpose of limiting the same, FIG. 1 shows a schematic view of a coated printing sheet. The coated printing sheet 4 is coated on both sides with layers, wherein these layers constitute the image receptive coating. In this particular case, a top coating 3 is provided which forms the outermost coating of the coated printing sheet. Beneath this top layer 3 there is provided as second layer 2. In some cases, beneath this second layer there is an additional third layer, which may either be a proper coating but which may also be a sizing layer.

Typically a coated printing sheet of this kind has a base weight in the range of 80-400 g/m$^2$, preferably in the range of 100-250 g/m$^2$. The top layer e.g. has a total dried coat weight of in the range of 3 to 25 g/m$^2$, preferably in the range of 4 to 15 g/m$^2$, and most preferably of about 6 to 12 g/m$^2$. The second layer may have a total dried coat weight in the same range or less. An image receptive coating may be provided on one side only, or, as displayed in FIG. 1, on both sides.

The main target of this document is to provide a coated printing sheet for "instant" ink drying for sheet-fed offset papers in combination with standard inks. Pilot coated papers were printed on a commercial sheet-fed press and ink setting as well as ink drying tests (evaluated by white gas test as given below) were carried out next to reprintability and convertibility evaluations.

It was possible to speed up ink setting tendency of coated papers by use of silica (Syloid C803 and others like Sylojet types, by Grace Davison) in second or top coating significantly compared to standard coated papers. For calendered papers a much better (lower) ink scuff behaviour compared to uncalendered papers was observed. Improvements especially analysed via white gas tests were confirmed by converting tests at practical printer (sheet-fed press).

Use of silica in top coating led to fast physical and chemical drying, short time and long time ink setting was also faster and mottle tendency of calendered paper even slightly better than for referent paper. Paper gloss and print gloss levels were slightly lower than reference.

When silica is used in the second coating, influence on physical and chemical ink drying of the final paper still exists but the mechanism is not as active as for the top coating application. Advantages of silica containing middle or second coating were higher paper gloss and equal ink setting time compared to reference which led to higher print gloss. For use in second coating silica amount had to be higher.

Table 1 shows the different test papers which were used for the subsequent analysis. Five different papers were made wherein the paper designated with IID_1 comprises a top coating without silica and a middle coating with silica, IID_2 comprises a top coating with silica and a middle coating without silica, IID_3 comprises no silica in standard middle coating or top coating, and IID_5 comprises a standard middle coating without silica and a top coating with silica. The detailed formulations of the middle coating and the top coating are given in tables 2 and 3 below.

TABLE 1 trial plan (IID - for Instant Ink Drying) (B for middle coated papers)

| | IID_1 | IID_2 | IID_3 | IID_5 |
|---|---|---|---|---|
| Middle coat | Blade | Blade | | |
| coating nr | MC_1 | MC_2 | | |
| coating weight WS [g/m$^2$] | 11 | 11 | | |
| moisture [%] | 4.9 | 4.9 | | |
| coating weight TS [g/m$^2$] | 11 | 11 | | |
| moisture [%] | 5.2 | 5.2 | | |
| Top coat | Blade | Blade | Blade | Blade |
| coating nr | TC_1/A | TC_3/A | TC_1/B | TC_3/B |
| coating weight WS [g/m$^2$] | 10.5 | 10.5 | 10.5 | 10.5 |
| moisture [%] | 4.9 | 4.9 | 4.9 | 4.9 |
| coating weight TS [g/m$^2$] | 10.5 | 10.5 | 10.5 | 10.5 |
| moisture [%] | 5.0 | 5.0 | 5.0 | 5.0 |
| Coating weight total [g/m$^2$] | 43 | 43 | 21 | 21 |
| Printing trial | Paper 12 | Paper 11 | Paper 15 | Paper 13 |

TABLE 2

Formulations of middle coatings

| Pigments | Standard middle-coating % | Pigments | MC_1 % | Pigments | MC_2 % |
|---|---|---|---|---|---|
| HC 60 | 85 | HC60 | 40 | HC 60 | |
| HC 60 | 15 | | | | |
| HC 90 | | | | HC 95 | 100 |
| | | CC 60 | 50 | | |
| | | Syloid C803 | 10 | | |
| Binders | | Binders | | Binders | |
| Latex | 5 | Latex | 10 | Latex | 7.5 |
| Dextrin | 6 | Dextrin | 3 | Dextrin | 3 |
| Additives | | Additives | | Additives | |
| CMC | 0.3 | CMC | 0.4 | CMC | 0.3 |
| Polysalz S | 0.2 | Polysalz S | 0.2 | Polysalz S | 0.2 |
| Plus others | | Plus others | | Plus others | |

Remarks: MC_1 formulation is optimised in a way to reach fast long time ink setting by changes in middle coating. CC 60 (steep particle size distribution) is used to create higher pore volume, and silica as acceleration additive for physical and chemical ink drying. Starch has also negative influence on internal pore volume, as it seems to slow down long time ink setting but starch is also necessary as an rheology additive to increase water retention of coating colour. If silica was to be replaced by additional 10% HC60 latex amount would be 7.5 pph (clearly lower). Binding power (rule of thumb): 10+0.5*3=11.5. Binding power reference middle coat: 5+0.5*6=8.

MC_2 formulation is optimised based on practical experiences, where a fine pigment HC95 is used. Binding power: 7.5+0.5*3=9.

For both middle coating colours further additives are used as necessary (e.g. CMC, brighteners, rheology modifiers, defoamers, colorants etc.).

Middle coating colour MC_1 (with 10% silica) and MC_2 (100% HC 95) were applied on a pre-coated paper (produced for 150 gsm). Starch level of middle coatings was reduced to 3 pph to reach fast ink setting—for common standard middle coating formulation 6 pph starch were used.

TABLE 3

| Top coating formulations | | | | | |
|---|---|---|---|---|---|
| | | Middle coat: | | | |
| | | MC_1 D1/A | MC_2 D3/A | B middle coated D1/B | B middle coated D3/B |
| | | Top coat: | | | |
| | solid [%] | TC_1/A IID_1 | TC_3/A IID_2 | TC_1/B IID_3 | TC_3/B IID_5 |
| Pigments | | | | | |
| HC 60 | 78 | 3 | | 3 | |
| HC 90 | 76.5 | 15 | | 15 | |
| HC 95 | 78 | | | | |
| CC60 | 72 | | | | |
| Pigment SFC | 72 | 72 | 77 | 72 | 77 |
| Pigment Syloid C803 | 98 | | 8 | | 8 |
| Amazon | 72 | 10 | 15 | 10 | 15 |
| Binder/Additive | | | | | |
| Latex Acronal | 50 | 6.5 | 8.5 | 6.5 | 8.5 |
| Latex | 50 | 1 | 1 | 1 | 1 |
| CMC | 93.5 | 0.5 | 0.5 | 0.5 | 0.5 |
| PVOH | 20 | 1.2 | 1.2 | 1.2 | 1.2 |
| Fluocast | 50 | 0.55 | 0.55 | 0.55 | 0.55 |
| Polysalz S | 45 | 0.1 | 0.1 | 0.1 | 0.1 |

Two different top coating colours (TC_1 and TC_3) were prepared and applied on middle coated papers (produced for 150 gsm) as well as TC_1 (Standard) on MC_1 and TC_3 with 8% silica on MC_2 too.

Aims were an investigation of best coating layer for use of silica and to compare them with Standard coating (IID_3).

Middle and top coating application was done via blade coater (wire side was coated first)—coating weights, drying temperatures and moisture contents were chosen as commonly used.

Laboratory investigations of these coated papers were carried out using standard methods. Nevertheless, in view of the analysis of ink setting properties certain specific methods were used which shall be defined below:

Wet Ink Rub Test (Ink Scuff Test):

Generally, one understands ink markings by ink scuff. Such ink markings can be produced by different causes: * if the ink is not fully dry→seen in wet ink rub test; * if the ink is fully dry→seen in ink rub resistance test. The wet ink rub test, which is a convertibility test, is detailed here. The ink rub resistance test shares the same principle as the wet ink rub test, but it is carried out after the ink has dried for 48 hours.

Scope: The method describes the evaluation of the rub resistance of papers and boards at several time intervals after printing, before full drying. Normative References/Relating International Standards: GTM 1001: Sampling; GTM 1002: Standard Atmosphere for Conditioning; ESTM 2300: Prüfbau printing device-description and procedure. Relating Test methods descriptions: Prüfbau manual.

DEFINITIONS

Ink-rub: when submitted to mechanical stress like shear or abrasion, ink layers can be damaged and cause markings on the printed products, even if they are fully dried.

Chemical drying: in sheet fed offset, the hardening of the ink film via reactions of polymerisation.

Wet ink rub value: measurement of the amount of ink that has marked the counter paper during the wet ink rub test at a given time after printing.

Principle: A test piece is printed with commercial ink at the Prüfbau printing device. After several time intervals, a part of the printed test piece is rubbed 5 times against a blank paper (same paper). The damaging of the print and the markings on the blank paper are evaluated and plotted against a time scale. Printing ink Tempo Max black (SICPA, CH) is used.

Laboratory procedure: 1. Adjust the printing pressure to 800N, 2. Weigh the ink with a tolerance of 0.01 g and apply the amount of ink on the inking part of the Prüfbau printing device, 3. Distribute the ink for 30 s, (the ink distribution time can be lengthened to 60 s for easier manipulation), 4. Fix the test piece on the short sample carrier, 5. Place the aluminium Prüfbau reel on the inking part and take off ink for 30 s, 6. Weigh the inked reel ($m_1$), 7. Put the inked aluminium Prüfba reel on a print unit, 8. Put the sample plate against the inked aluminium reel, print the test piece at 0.5 m/s, 9. Mark the time at which the sample as been printed, 10. After printing, weigh again the inked reel ($m_2$) and determine the ink transfer $I_t$ in g (Note: the ink transfer $I_t$ is given by $I_t=m_1-m_2$ where $m_1$ is the weight of the inked reel before printing and $m_2$ the weight of the same reel after printing), 11. Adjust the number of rubbing on the Prüfbau ink rub resistance tester to 5, 12. Cut a round piece in the printed strip with the Prüfbau piece cutter. 13. Stick the test piece against one of the Prüfba test piece carrier, and fix a blank strip of the same paper on the paper carrier, 14. After a defined time interval after printing, place the blank paper and the printed round piece face to face on the Prüfba device and start the rubbing (five times), 15. Recommence the operation for all defined time intervals after printing and then, evaluate the papers drying as a function of the density of markings on the blank paper/damaging of the printed paper.

The chart below provides an example for the amount of ink to be weighed for the printing and the times after printing at which the ink rub test can be performed:

| Grades | Ink amount | Rubbing times (min.) |
|---|---|---|
| Gloss | 0.30 g | 15/30/60/120/480 |
| Silk/Matt | 0.30 g | 30/60/240/360/480 |

Results evaluation: The results are both measured and evaluated visually. Visual evaluation: order all the tested blank samples from best to worse as a function of the amount of ink that has marked the blank paper. Measurement: with the Colour Touch device, measure the colour spectrum of the blank samples (light source UV excluded). Measure the colour spectrum of the untested white paper. The colour spectra of the tested samples have a peak of absorption at a defined wavelength, which is typical for the ink used (this is the colour of the ink). The difference of the reflectance factors at this wavelength between the tested sample and the white untested sample is an indication of the ink rub. With the SICPA Tempo Max Black, the peak wavelength is 575 nm and $InkRub=(R_{sample}-R_{blank})_{575\ nm}$ Folding Test:

Execution: Each sheet is folded twice (cross fold). The first fold is made with a buckle, the second fold is made by a knife. The sheets are folded at different time intervals after printing.

Evaluation: The folding test is evaluated by visual judgement of the folded sheets.

For the folding test, two markings are significant:

Cross-fold: the ink from the printed area is folded against a blank area.

Guiding-reels markings: at the reception of the folding machine (transport-band), two plastic reels guide the sheets. In this case, the sheets went out with a blank area up, whereas the other side was a litho. The guiding reels made distinct marks by pressure/carbonising.

Blocking Test:

A certain number of sheets are printed and after that directly piled up to a certain weight, simulating as closely as possible practical load conditions in a pallet of printed sheets. Then markings on the sheets on the next unprinted side are visually evaluated after 4 hours.

Multicolour Ink Setting (Laboratory) and K+E Counter Test (Printer):

Scope: This method describes the measurement of the ink setting (stack simulation) at high ink coverage of all papers and boards for offset printing. The high ink coverage is obtained by printing with multiple colours from 2 nips (laboratory) to 4 colours (commercial printing). This standard describes both laboratory and commercial printing standard tests. Multicolour ink setting test measures the ink setting properties on a long time scale.

DEFINITIONS

Set-off: ink transfer from a freshly printed paper to a counter paper (same paper) after different penetration times.

Counter paper: The counter paper absorbs the ink that has not set. In this test, the counter paper is the same as the tested paper.

Setting value: density of the ink transferred to the counter paper.

Principle: A sheet is printed. After several time intervals, a part of the printed test piece is countered against the same blank paper. The density of the transferred ink of each area on the counter paper is measured and plotted against a time scale.

Preparation of Test Pieces: Mark the Topside of the Paper or Board. Cut a Test Piece of approximately 4.6 cm×25.0 cm. Sheet fed: For a sheet fed paper or board cut the longest side of the test piece parallel to the cross direction. Reel fed: For a reel fed paper or board cut the longest side of the test piece parallel to the machine direction. Cut the counter paper in pieces of approximately 4.6 cm×25.0 cm (mark the contact-side of the paper).

Standard Procedure for laboratory, multicolour ink setting (MCIS): 1. Adjust the printing pressure of the 2 printing units to 800N, 2. Adjust the printing speed to 0.5 m/s, 3. Weigh two sets of ink with a tolerance of 0.01 g and apply the 2 amounts of ink on 2 inking parts of the Prüfbau printing device, 4. Distribute the ink for 30 s, (the ink distribution time can be lengthened to 60 s for easier manipulation), 5. Fix the test piece to the sample carrier, 6. Place the 2 aluminium Prüfbau reels on the inking part and take off ink for 30 s, 7. Weigh the 2 inked reels $m_{11}$ and $m_{21}$, 8. Put the 2 inked aluminium Prüfbau reels on the printing units, 9. Put the sample carrier against the first inked aluminium reel, print the test piece at 0.5 m/s and switch on the stopwatch at the same time, 10. Weigh the 2 inked reels $m_{12}$ and $m_{22}$ after printing and calculate the ink transfer $I_t$ in g given by: $I_t=(m_{12}-m_{11})+(m_{22}-m_{21})$, 11. Clean the two aluminium Prüfbau reels, 12. Place the right (second) Prüfbau reel back on the printing unit, 13. Turn the FT 10 module on, 14. Put the test piece in front of the left (first) printing unit (no reel on this printing unit), 15. Set the time delay switch at about 2 seconds, 16. Press the start button on the FT 10 module, 18. After 1 minute and 53 seconds, press the start button of the FT10 module, 19. When the countering is done, remove the sample, turn the FT10 module off and switch the time delay back to 0 s, 20. When the ink is dry, measure the density (McBeth) of the 3 areas (2, 6 and 10 minutes) on the counter paper. The density of one area is the average of ten measurements, which are taken according a pattern.

The time intervals that can be used for the MCIS test: 2 min, 6 min., 10 min. until no marking.

Procedure for practical printing (K&E counter test): 1. The pressure reels are on position "high" (hand-levers in position high), 2. Put the reels at the top extremity of the K&E setting equipment table, 3. When a freshly printed sheet is taken out of the press by the printer, start the stopwatch, 4. Lay the sheet flat on the K&E setting equipment, with the printed side of the sheet above, 5. Place a blank sheet of the same paper flat on the printed sheet, bottom on top, 6. At the defined time interval, put the pressure reels on position "low" and drive the pressure reels to the opposite extremity of the K&E setting equipment table at constant speed, 7. Put the reels again in position "high" (hand-levers on position high) and drive the reels to their initial position (opposite extremity of the K&E setting equipment table), 8. Remove the counter sheet from the printed sheet, 9. Repeat the operation with a new fresh sheet and a new blank paper for all the time intervals defined.

The time intervals that can be used for the K&E test: 15 sec., 30 sec., 60 sec., 120 sec., 180 sec. until no marking.

Set Off Test:

Scope: The set-off test method describes the measurement of the set-off (pile simulation) of all papers and boards used for sheet fed and reel fed offset printing. The counter paper used is the same as the paper tested. Set off test measures the ink setting properties on a short time scale.

DEFINITIONS

Ink penetration: phenomenon of selective absorption of the ink vehicle components into the paper.

Counter paper: The counter paper absorbs the ink that has not set.

Set-off: ink transfer from a freshly printed paper to a counter paper (same paper) after different penetration times.

Set-off value: density of the ink transferred to the counter paper.

Principle: A sample is printed with a standard ink on the Prüfbau printing device. After several time intervals, a part of the printed sample is countered against a counter paper (top on bottom in order to simulate a pile). The density of the transferred ink of each area on the counter paper is measured and plotted against time.

Device: Prüfbau printing device; Aluminium Prüfbau reels 40 mm; Prüfbau sample carrier; Huber Setting Test Ink cyan 520068; Counter paper: same paper as tested paper; Gretag McBeth-densitometer (DC-type, with filter).

Procedure: 1. Adjust the printing pressure for both printing units to 800 N; 2. Adjust the switch for the waiting time to 2 seconds; 3. Adjust the printing speed to 0.5 m/s; 4. Weigh the ink with a tolerance of 0.001 g and apply the amount of ink on the inking part of the Prüfbau printing device (Attention: different ink amounts for gloss and silk/matt grades); 5. Distribute the ink for 30 s; 6. Fix the test piece on the sample carrier; 7. Place the aluminium Prüfbau reel on the inking part and take off ink for 30 s, 8. Weigh the inked reel (m1); 9. Put the inked aluminium Prüfbau reel on the left print unit and the clean reel on the right countering unit; 10. Put the sample carrier against the inked aluminium reel, switch the printing speed on and switch on the stopwatch at the same time; 11. Switch the printing speed off; 12. Put the counter paper on top of the printed test piece (top on bottom); 13. Move the handle of the Prüfbau printing device up and down until the blanket of the sample carrier is against the clean aluminium Prüfbau reel; 14. Move the handle of the Prüfbau printing device up and down after 15, 30, 60 and 120 s, while holding the counter paper vertically after the nip to avoid prolonged contact with the printed paper; 15. After printing, weigh the inked reel (m2) again and determine the ink transfer It in g wherein the ink transfer It is given by It=m1−m2 where m1 is the weight of the inked reel before printing and m2 the weight of the same reel after printing; 16. When the ink is dry, measure the density (Gretag-Mc Beth densitometer, cyan filter) of the areas (15, 30, 60 and 120 s) on the counter paper, wherein the density of one area is the average of 10 measurements, which are taken according to a pattern.

Ink Drying Tests:

When this research was started, no ink drying tests were available and that is the reason why the three tests given in the following were sequentially developed and are of increasing reliability and objectivity.

Thumb Test:

Non-standard; in line with general practice of commercial printing (and also in paint testing area) at several time intervals (15, 30, 60, 90 . . . minutes) a thumb, covered with (special) house-hold tissue paper (to avoid influence of skin grease), is firmly (but always at about same force) pressed and simultaneously turned over 90° in the printed ink layer. In case of fully wet stage all ink is wiped off, leaving a clear white spot on paper substrate. In case of fully chemically dried ink no injury can be seen. It is preferred that one and the same operator is performing all series. It was found that thumb dry results roughly reflect up to 100% physically dry+some degree of chemical dry. In fact, the result is more or less comparable with 'cotton tip' dry in second test below or 'tail dry' in third test Fogra below.

White Gas Test—Cotton Tip (Benzin Test):

Substantially identical to the white gas test-Fogra given below. So white gas test-cotton tip means same definitions, principle, device and sampling/test piece preparation as described below for Fogra white gas test.

In contrast to Fogra white gas test concerning preparation/printing, here a cotton tip (Q-tip) is dipped in white gas and then rubbed by hand in one stroke over the printed paper strip, starting the stroke just next to the printed area, thus in the non-printed area. Ergo, most of the (not fixed amount) white gas is not directly on the printed area itself (as it is in Fogra test) and due to the softness of the tip and limited and (not fixed, operator dependent) exerted pressure this test seems to mostly measure the tail dry value (or still somewhat further) as from the Fogra white gas test below.

White Gas Test—Fogra:

The white gas test Fogra is also used to evaluate the time needed for a sheet fed offset ink film printed on a paper to be chemically dry.

Definitions: Chemical ink drying: full cross-linking of unsaturated vegetable oils of the ink via oxido-polymerisation.

Principle: A sample is printed with a standard commercial ink on the Prüfbau printing device. After several time intervals, a part of the printed sample is put in contact with white gas. The white gas can dissolve the ink film on the paper as long as the ink film is not totally cross-linked. When the white gas does not dissolve the ink film anymore, the sample is considered chemically dry.

Device: Prüfbau printing device; Aluminium Prüfbau reel 40 mm; Prüfbau sample carrier; Tempo Max Black (SICPA); FOGRA-ACET device.

Sampling and test piece preparation: For the white gas test, cut a piece of the strip of at least 5 cm length. Then: 1. Adjust the pressure of the printing nip of the Prüfbau printing device to 800N; 2. Adjust the printing speed to 0.5 m/s; 3. Weigh the ink with a tolerance of 0.005 g and apply the amount of ink on the inking part of the Prüfbau printing device; 4. Distribute the ink for 30 s; 5. Fix the test piece on the sample carrier; 6. Place the aluminium Prüfbau reel on the inking part and take off ink for 30 s; 7. Put the inked aluminium Prüfbau reel on the right print unit; 8. Put the sample carrier against the inked aluminium reel and switch the printing speed on; 9. Switch the printing speed off; 10. Mark the time of printing (e.g.: starting time for the white gas test); 11. Choose the thickness card that corresponds to the paper's grammage; 12. Cut a piece of the strip of at least 5 cm length; 13. Stick the extremity of the strip to the thickness card with tape; 14. Place a felt pad in the pad holder of the FOGRA-ACET device; 15. Pump 0.5 ml white gas with the all glass syringe and apply it on the felt pad; 16. Place the thickness card with the sample to be tested in the card holder; 17. Close the FOGRA-ACET device and immediately pull the thickness card with the test sample attached to it out of the device; 18. Evaluate the chemical drying of the sample; 19. Repeat the operation every hour until the sample is fully dry (no dissolving of the ink layer visible; 20. Evaluation: a visual evaluation can be made of the samples with help of the following notation system: 5=No sign of drying; 4=Start of drying of the tail; 3=Middle drying of the tail; 2=Tail dry; 1=almost dry; 0=Fully dry.

Calculations: The chemical drying time of a printed ink film is the time at which the ink on the sample tested could not be dissolved. The chemical drying time is given in hours.

It should be noted that in this third test the largest discrimination of drying results is attained, from somewhat physical+0% chemical dry at start, to 100% physical dryness+some (apparently sufficient) degree of chemical dryness up to finally 100% chemical dryness (and of-course still 100% physical dryness) at dot dry stage. Referring to remark 'apparently sufficient' it should additionally be stated that several experimental experiences reveal that this tail dry stage (in Fogra, roughly equalling to cotton tip dry stage or thumb dry stage) appeared to be already sufficient (=sufficient mechanical thoughness of printed ink layer) for further acceptable convertability steps in practice. And it is also to be noted that results normally are displayed as continuous graph with dryness result varying from 5 (=0% dry) to 0 (=100% dry) and that sufficient tail dry level here has level 2. But that in practice, to allow displaying of drying results in table form, three levels 0, 2 and 5 are explicitly taken out and mentioned. In the Fogra test the amount white gas is exactly weighed, all white gas comes directly on the printed paper, the 'tip' there is much harder than a cotton tip and pressure is completely fixed (and probably higher than in cotton tip method). Therefore this Fogra method discriminates clearly better and so also indicates the 100% chemical dry endpoint. And finally it should be noted that to allow for reliable prediction of convertability not only white gas tests should be used but in combination with results of ink scuff test.

Droplet Test (Also Called Wet Repellence Test):

Definition: Wet repellence: Shows the influence of fountain solution on ink absorption.

Principle: Before a strip of paper is printed with an aluminium reel, a drop of 20% Isopropyl Alcohol solution is applied on the paper. The drop will be spread by the printing reel between paper and ink. The higher the density of colour on the wetted area, the better the wet repellence.

Device: Prüfba printing device; Aluminium Prüfbau reel 40 mm; Blanket Prüfbau sample carrier long; Huber picking test ink 408001; 20 (v/v) % Isopropyl alcohol-solution; Gretag-McBeth densitometer (DC-type, with filter);

Sampling and test piece preparation: Mark the topside of the paper or board. Cut a test piece of approximately 4.6 cm×25.0 cm. For sheet fed and reel fed papers cut the longest side of the test piece parallel to the machine direction. Then: 1. Adjust the printing pressure for both printing units to 800N; 2. Adjust the printing speed to 1.0 m/s; 3. Weigh the ink with a tolerance of 0.005 g and apply the amount of ink on the inking part of the Prüfbau printing device (No different ink amounts for gloss and silk/matt grades); 4. Distribute the ink for 30 s; 5. Fix the test piece on the sample carrier; 6. Place the aluminium Prüfbau reel on the inking part and take off ink for 30 s; 7. Put the inked reel on the printing unit; 8. Put the sample plate against the inked reel; 9. Put with the pipette a drop of 5 μl 20% Isopropyl-alcohol on the paper; 10. Print the test piece immediately after setting the drop; 11. Remove the printed test piece from the sample plate; 12. After 24 hours the density of dry area ("dry-density") and the density of the wetted area ("wet-density") is measured.

Calculations: The wet repellence in percentage is calculated by dividing the wet density by the dry density and multiplying it by 100. The higher the value, the better the wet-repellence. Typically: <20% very bad; 20-30% bad; >30% good.

Offset Suitability Test

Scope and field of application: This Test specifies the method to determine the picking resistance with and without moisturizing of all sheetfed and reelfed papers and boards Definition: Offset suitability: Surface strength of paper to determine the suitability for multicolour offset printing.

Principle: A strip of paper is printed with an aluminum reel, and is contacted several times (max. 6) with the same reel until picking is noticed. One part of the test-strip is wetted to show besides dry pick also the wet pick resistance. With this splitting the tack of the ink will increase. The number of passages without picking determines the suitability for multi colour offset printing.

Apparatus and equipment: Prüfbau printing apparatus; aluminum Prüfbau reel; Blanket Prüfbau sample plate long; Ink: Huber proofing and mottle testing ink 408010; 25% Isopropyl alcohol-solution;

Procedure: Weigh to the nearest 0.01 g, exactly 0.3 g of the ink and apply the amount of ink on the inking part of the Prüfbau; Distribute the ink for 1 minute; Place the pipette with 12.5 μl 25% Isopropylalcohol solution on the wetting unit; Place the aluminum Prüfbau reel on the inking part and take off ink for 30 sec.; Fix the test strip on the sample plate; Put the inked aluminum Prüfbau reel on the first (left) print unit; Wet (raise speed of wetting unit up to 1 m/s) and print (1 m/s) test piece with the inked aluminum reel; After 10 seconds the test piece is conveyed against the same reel at the same print unit. Both, wetted and not wetted part has to be checked if there is some picking; This handling is repeated in interval times of 10 seconds, to a maximum of 6 times (excluding printing) until picking is noticed.

Expression of results: The last picking-free passage separate for wetted and not wetted part excluded printing is mentioned. The higher the value the better (max. 6).

Experimental Results, Part 1

Laboratory investigations of middle and top coated papers (uncalendered): Grammage and thickness of middle coated papers, paper gloss of middle coated papers, and paper roughness of middle coated papers are given graphically in FIGS. 2-4, respectively, wherein the data designated with IID_4 are not the object of these investigations.

Paper calliper and with it specific volume is higher for middle coated papers as produced on a standard paper machine. Paper gloss of middle coated papers MC_1 and MC_2 is clearly higher than those of middle coated papers. Main reason for this seems to be the use of coarse pigments (HC60) and higher starch level for current standard middle coating as used in IID_3 and IID_5. Highest gloss level is reached with MC_2 which has 100% HC95 in coating formulation. Measured PPS-values do not confirm observed gloss differences, as one can see from FIG. 4.

Grammage and thickness of top coated papers (uncalendered) are given in FIG. 5. Paper grammage of top coated papers points out a variation from 144 gsm for IID_1 and IID_2 to 151 gsm for IID_5.

Brightness and opacity of top coated papers—uncalendered, as well as paper gloss level of top coated papers—uncalendered, are given in FIGS. 6 and 7, respectively. The highest paper gloss level is seen for papers with standard formulation, silica in top coating colour reduces paper gloss slightly (Tappi 75°~10% and DIN 75°~5%).

Ink setting of top coated papers—uncalendered, and practical print gloss vs. paper gloss of top coated papers—uncalendered, are given in FIGS. 8 and 9, respectively. Very rapid ink setting can be recognised for top coatings containing silica (see FIG. 8, wherein FIG. 8 *a*) displays the values for the topside and FIG. 8 *b*) the values for the wire side). On the other hand, also paper gloss and print gloss go down for those two samples (see FIG. 9, topside of uncalendered papers shown).

FIG. 10 shows the print snap (print gloss minus paper gloss) of top coated papers—uncalendered, and FIG. 11 shows the offset suitability (passes until failure) of the top coated paper—uncalendered.

Extremely fast ink setting is observed for papers IID_2 and IID_5 with silica in top coating colour—possible advantage for fine middle coating as used for IID_2.

Slowest ink setting was measured for reference paper IID_3—use of silica in middle coating with standard top coating (TC_1) leads to faster ink setting.

Extremely fast short time ink setting usually leads to lower print gloss at commercial printer. Highest print snap is measured for IID_1—lowest one for IID_2.

The offset suitability of paper IID_2 shows to be approximately 2 passes lower than those of reference IID_3. Increase of latex in top coating colour TC_3 however leads to a reduced ink setting speed and to an increased print gloss level. The balance of these two constituents (silica, binder) therefore has to be chosen carefully in accordance with the needs in terms of print gloss etc.

As one can see from FIG. 12, extremely high droplet test values were measured for silica containing paper. Here, also an obvious influence of middle coating was observed.

Fast short time ink setting and high absorption rate of paper IID_2 leads to good wet ink rub resistance (low value) measured in laboratory as one can see from FIG. 13 (wet ink rub resistance measured of top coated papers—uncalendered; the lower the better).

Experimental Results, Part 2

Laboratory investigations of top coated papers calendered: With reference paper roll IID_3 calendering setting was adjusted to reach gloss target DIN 75° (55%) and kept constant for all other rolls. The following parameters were chosen for calendering:

Speed: 300 m/min; Nip load: 290 N/mm; Temperature: 90° C.; Nips used: 11.

Grammage and thickness of top coated papers—calendered—are given in FIG. 14, brightness and opacity of top coated papers—calendered—are given in FIG. 15, and paper gloss level of top coated papers—calendered—are given in FIG. 16.

Paper grammage and calliper of calendered papers are comparable. After calendering paper gloss differences are mainly damped—slightly higher values are measured for paper IID_1.

FIG. 17 shows the ink setting of top coated papers—calendered, wherein a) shows the data for the topside and b) shows the data for the wire side. Again, strikingly and exceptionally low ink setting values can be observed for the two coatings IID_2 and IID_5 comprising silica in the top coating.

Practical print gloss vs. paper gloss of top coated papers—calendered—is given in FIG. 18, print snap (print gloss minus paper gloss) of top coated papers—calendered—is given in FIG. 19, and the offset suitability (passes till failure) of top coated papers-calendered—is given in FIG. 20.

Again extremely fast ink setting is observed for calendered papers IID_2 and IID_5 with silica in top coating colour—at this fast ink setting level some advantage for fine middle coating used for IID_2 is visible.

Slowest ink setting was measured for reference paper IID_3—use of silica in middle coating with standard top coating (TC_1) leads to faster ink setting.

General set-off values measured after 15 seconds are slower than for uncalendered papers (influence of paper smoothness)—after 30 seconds faster values for calendered papers (finer pores).

Extremely fast short time ink setting leads to lower print gloss at commercial printer. Highest print snap is measured for reference IID_3—lowest one for IID_2.

Offset suitability of paper IID_2 is lower than those of reference IID_3. Increase of latex in top coating colour TC_3 leads to a reduced ink setting speed and as result to an increased print gloss level. Again, therefore, the balance of the two constituents of silica and latex binder can to be adjusted according to current needs.

FIG. 21 shows the results of droplet test of top coated papers—calendered. Fast short time ink setting and high absorption rate of paper IID_2 and IID_5 lead to good wet ink rub resistance (low value) measured in laboratory even 5 minutes after printing, as one can see from FIG. 22, in which the wet ink rub resistance of top coated papers is graphically given.

White gas test carried out in laboratory (see FIG. 23, white gas test data, cotton tip) shows faster physical and chemical drying for papers with silica in top coating.

Experimental Results, Part 3, Practical Printing Trials

Uncalendered as well as calendered papers were printed on a practical sheet-fed press to check possibilities for a glossy and silk paper development. Just the top side was printed.

a) Uncalendered Papers:

FIG. 24 shows ink scuff results of printed papers—uncalendered (ink scuff is a term that is variably used by printers).

Generally higher (worse) ink scuff values of uncalendered papers measured at printer are observed—best level for paper IID_5 and worst level for reference IID_3.

Folding test evaluations given in table 4 below show lowest marking tendency at folding of a printed 300% area (against a blank area) for uncalendered paper IID_2 even after 0.5 hour after printing followed by paper IID_1 with good level 2 hours after printing. Paper IID_3 without silica is clearly worse at folding test.

The same trend is found for white gas test (benzin test, cotton tip) carried out at printer on a 400% printed area—paper IID_2 starts to get dry (chemically dry) after 3 hours, paper IID_5 after 4 hours, paper IID_1 after 5 hours but for reference paper IID_3 chemical drying was not observed until 24 hours have expired.

It can be summarised that clear improvements of physical and chemical drying process by use of silica are confirmed by practical printing trials.

TABLE 4

Investigations of uncalendered papers carried out at printer

| | | | | Drying time in hours | | | | | | | | |
|---|---|---|---|---|---|---|---|---|---|---|---|---|
| | | | | 0.5 | 1 | 2 | 3 | 4 | 5 | 6 | 7 | >48 |
| IID_2 | Paper 1: D3a | 8 parts silica in topcoating and adjusted middle layer | folding benzin test ink scuff | + wet 5.5 | + wet 5.2 | + wet 4.8 | + wet/dry 5 | + dry 4.5 | + dry 3.4 | + dry 4.8 | + dry 4.4 | ++ dry 3.6 |
| IID_1 | paper 2: D1a | 10 parts silica in middle coat standard topcoating | folding benzin test ink scuff | = wet 5.3 | = wet 5.2 | +/= wet 3.3 | + wet 4.6 | + wet 4.4 | + wet/drydry 4.7 | + wet/dry 4.6 | + wet/dry 4.3 | ++ dry 3 |
| IID_5 | paper 3: D3 | 8 parts silica in topcoating and standard middle layer | folding benzin test ink scuff | − wet 3.2 | − wet 2.8 | − wet 3.6 | − wet 3.2 | − wet/dry 2.8 | − wet/dry 2.9 | − wet/dry 2.9 | − wet/dry 2.9 | ++ dry 1.8 |
| IID_3 | paper 5: D1 | standard | folding benzin test ink scuff | −− wet 7.4 | −− wet 6.9 | −− wet 4 | −− wet 4.9 | −− wet 3.8 | −(−) wet 4.7 | − wet 3.6 | − wet 3.8 | ++ dry 2 |

Legend
++ clearly better
+ better
= equal
− worse
−− clearly worse

Mottle evaluations of uncalendered papers are given in FIG. 25. The results of a K+E counter test of printed paper (time till no countering was visible—the lower the better): IID_1=240 seconds; IID_2>180 seconds; IID_3>300 seconds; IID_5>240 seconds. All tests were carried out on a 400% area.

b) Calendered Papers:

FIG. 26 shows ink scuff results of printed papers—calendered. Much better (lower) ink scuff values measured at printer are observed for calendered papers compared to uncalendered papers with best level for paper IID_2 and worst level for reference IID_3.

Folding test evaluations given in table 5 below show lowest marking tendency at folding of a printed 300% area (against a blank area) for silica containing calendered papers IID_1, IID_2 and IID_5 even after 0.5 hour. Paper IID_3 without silica is clearly inferior in the folding test.

The same trend is found for white gas test (cotton tip) carried out at printer on a 400% printed area—paper IID_2 starts to get dry after 2 hours, papers IID_1 and IID_5 after 4 hours but for reference paper IID_3 physical and chemical drying is observed not until 24 hours.

It can be summarised that clear improvements of physical and chemical drying process by use of silica is confirmed by practical printing trials.

Tendency of laboratory tests show good correlation to observations at printer.

TABLE 5

Investigations of calendered papers carried out at printer

| | | | | Drying time in hours | | | | | | |
|---|---|---|---|---|---|---|---|---|---|---|
| | | | | 0.5 | 1 | 2 | 3 | 4 | 5 | >48 |
| IID_2 | Paper 11: D3a | 8 parts silica in topcoating and adjusted middle layer | folding | + | + | + | + | + | + | ++ |
| | | | benzin test | wet | wet | wet/dry | dry | dry | dry | dry |
| | | | ink scuff | 2.1 | 2.1 | 2 | 1.1 | 1.8 | 2.1 | 1.1 |
| IID_1 | paper 12: D1a | 10 parts silica in middle coat standard topcoating | folding | +(+) | + | + | + | + | + | ++ |
| | | | benzin test | wet | wet | wet | wet | wet/dry | wet/drydry | dry |
| | | | ink scuff | 3.4 | 1.9 | 2.5 | 2.5 | 2.7 | 2.9 | |
| IID_5 | paper 13: D3/Gk | 8 parts silica in topcoating and standard middle layer | folding | + | + | + | + | + | + | ++ |
| | | | benzin test | wet | wet | wet | wet | wet/dry | wet/drydry | dry |
| | | | ink scuff | 2.5 | 2.1 | 1.9 | 1.7 | 2 | 1.8 | 1.2 |
| IID_3 | paper 15: D1 | standard | folding | − | − | − | − | − | − | ++ |
| | | | benzin test | wet | wet | wet | wet | wet | wet | dry |
| | | | ink scuff | 4.9 | 2.5 | 1.3 | 1.8 | 1.6 | 1.5 | 0.5 |

Legend
++ clearly better
+ better
= equal
− worse
−− clearly worse

Ink scuff level of matt papers is clearly worse than the one of calendered papers. The best mottle tendency (lowers values) is observed for calendered papers IID_1 and IID_2 which had also very fast physical and chemical drying behaviour. FIG. 27 shows the mottle evaluations of calendered papers.

Results of the K+E counter test of printed paper (time till no countering is visible—the lower the better) are as follows: IID_1=240 seconds; IID_2=180 seconds; IID_3>420 seconds; IID_5>360 seconds. All tests were carried out on a 400% area.

Caused by a smoother paper surface of the calendered papers higher ink transfer to counter paper takes place which leads to longer times till no countering is visible.

Experimental Results, Part 4

In a further effort to specify the critical limits of the formulations, in a separate series of experiments the influence of the silica content in the coatings was evaluated. Prepared top coatings were applied on a Bird applicator (laboratory applicator) on a regular paper substrate without topcoat layer, meant for 250 gsm end-paper i.e. on a substrate only with regular middle coat composition. Silica amount (in this case Syloid C803) in top coating colour was increased from 0% (Standard top coating) up to 3% and 10% (see table 6 below).

For all coating formulations latex level was kept constant at a level of 8 pph.

Papers were calendered (2 passes with 2000 daN nip load and 75° C. temperature of steel roll) and tested in laboratory.

TABLE 6

Formulations of top coating, coating colour composition in %

| Product/Trial-Nr. | SC | 20 | 21 | 23 |
|---|---|---|---|---|
| Setacarb HG | 75.0 | 100 | 100 | 100 |
| Litex | 50.0 | 8 | 8 | 8 |
| Starch | 25.0 | 0.4 | 0.4 | 0.4 |
| PVOH | 22.0 | 1.8 | 1.8 | 1.8 |
| Thickener | 30.0 | 0.024 | 0.024 | 0.024 |
| Polysalz S | 40.0 | | 0.1 | 0.1 |
| Syloid C803 | 99.4 | | 10 | 3 |
| Based on pigment atro | | 500 | 500 | 500 |
| Solids | | 69.24 | 70.99 | 69.75 |

TABLE 7

Experimental findings for the formulations 20, 21 and 23 according to table 6.

| Product/Trial-Nr. | | 20 | 21 | 23 |
|---|---|---|---|---|
| Set off | | | | |
| Set-off 15 sec. | top wire | 0.90 | 0.27 | 0.63 |
| Set-off 30 sec. | top wire | 0.53 | 0.07 | 0.12 |
| Set-off 60 sec. | top wire | 0.07 | 0.01 | 0.04 |
| Set-off 120 sec. | top wire | 0.03 | <0.01 | 0.01 |
| Wet Ink Rub | | | | |
| 15 min | top | 1.78 | 1.45 | 2.69 |
| 30 min | top | 6.43 | 0.77 | 9.2 |

TABLE 7-continued

Experimental findings for the formulations 20, 21 and 23 according to table 6.

| Product/Trial-Nr. | | | 20 | 21 | 23 |
|---|---|---|---|---|---|
| 60 min | top | | 3.1 | 0.74 | 8.44 |
| 120 min | top | | 3.05 | 0.7 | 5.27 |
| Chemical Ink Drying | | | | | |
| Thumb test | top | h | 3 | <1 | 1.5 |
| Thumb test | wire | h | | | |
| White gas test (cotton tip) | top | h | >3.5 | 1 | 3.5 |
| White gas test (cotton tip) | wire | h | | | |
| Gloss (unprinted) | | | | | |
| Gloss Tappi 75° | top | | 74.3 | 64.6 | 74.1 |
| | wire | | | | |
| Gloss DIN 75° | top | | 55.6 | 43.9 | 53.6 |
| | wire | | | | |
| Gloss DIN 45° | top | | 17.0 | 8.2 | 16.4 |
| | wire | | | | |
| Gloss (printed as for ink drying test) | | | | | |
| Gloss Tappi 75° | top | | 77.4 | 66.8 | 77.3 |
| | wire | | | | |
| Gloss DIN 75° | top | | 34.1 | 26.6 | 34.4 |
| | wire | | | | |
| Gloss DIN 45° | top | | 19.1 | 11.3 | 18.5 |
| | wire | | | | |

Discussion of the Results:

The presence of less than 3 or 5 part of silica does in this series not lead to significant desired effect, so the inventive choice is clearly limited in its boundaries.

Presence of 10 parts silica-gel Syloid C803 results in very fast physical ink-setting behaviour, according to (short time) set-off test. Also according expectations, this fast behaviour slows down in case of less amount Syloid C803.

It is however quite surprising that presence of 10 parts Syloid C803 apparently also causes quite significant enhancement of physical and chemical ink drying behaviour: white gas test dry in <1 h (thumb test) and =1 h (cotton tip).

Potential drawbacks of Syloid C803 product, partly related to its fast physical ink-setting behaviour are its relatively low print gloss and paper gloss. Possible solutions for improved print gloss: more latex binder, see below part 5.

Another further explanation for the intrinsic physical and chemical drying potential of Syloid C803, apart from the surface properties and the porosity, seems to be presence of residual transition metals (out of raw material water glass) like Fe (20-50 ppm) and Mn (<2 ppm) on the surface of inner pores. Quite generally one can say, that a selective enrichment in transition metals of the silica used is a possibility for further increasing the physical and chemical drying effect of silica (gels).

In respect of the last issue, further investigations were carried out to determine the actual content of these traces of metals. Elemental analysis of various commercially available silica was carried out using ICP, wherein the samples were prepared as follows: GASIL 23D: (1.0 g); GASIL 35M: (1.0 g); Ludox PW50: (5.0 mL); Sylojet 710A: (5.0 mL); Syloid C803: (1.0 g), were mixed with $HNO_3$ into an 50 ml solution for ICP analysis. The values as given in table 8 were obtained.

TABLE 8

Metal contents of different silica pigments and their ink drying tendencies. Ink drying tendency is evaluated according to white gas test. All values of metal content are ppm metals in solid (part) of material.

| Sample | pigment type | $SiO_2$ content [%] | oil absorption [g/100 g] | pore volume [ml/g] | average particle diameter [μm] supplier | average particle diameter [μm] Sappi | specific surface [$m^2$/g] supplier | specific surface [$m^2$/g] Sappi | ink drying tendency (10 low to 0 high) | Fe | Mn | Co | Cr | Ni | Zn | V | Cu |
|---|---|---|---|---|---|---|---|---|---|---|---|---|---|---|---|---|---|
| GASIL 35M | amorphous silica gel | | 200 | 1.2 | 4 | | | | 1 | 49 | 1.4 | 0.05 | 1.35 | 1.15 | 1.7 | 0.05 | 0.8 |
| Ludox PW50 | colloidal silica | 50 | | 0 | 0.1 | | 75 | | 4 | 78.2 | 7.1 | 14.3 | 47.1 | 12.8 | 7.0 | 0.2 | 16.9 |
| Sylojet 710A | amorphous silica gel | | | 0.9 | 1.0 | 0.94 | 250 | | 1 | 41.6 | 1.7 | 0.19 | 1.67 | 1.8 | 6.7 | 0.19 | 2.1 |
| Sylojet 703A | amorphous silica gel | | | 0.7 | 0.3 | | 250 | | 1 | | | | | | | | |
| Syloid C803 | amorphous silica gel | 99.4 | 320 | 2 | 3.5 | 0.93 | 330 | 294 | 1 | 26.1 | 1.6 | 0.1 | 1.38 | 1.0 | 11.9 | 0.5 | 3.5 |

It can be noted that the product Ludox PW50, which is characterised in rather high metal content, does not show satisfactory ink drying tendency. An explanation for this is the fact that this silica has almost no porosity and that it has a specific surface which is too small for the physical and chemical drying to develop significant effect.

As already pointed out above, in principle not only silica could be used to produce the effect according to the invention, but also conventional pigments (for example carbonates, kaoline, clay) as long as they have a high surface area e.g. reflected in a high porosity, a particle size distribution and a specific surface as specified for the above silica, and preferably as long as they comprise traces of metal in the same range as given in table 8.

Experimental Results, Part 5

As pointed out above, the latex content can be used for slightly slowing down ink setting on a short timescale and for increasing the gloss. In order to show that the claimed range for the binder indeed is an inventive selection, a series of experiments was carried out to find out what the optimum latex content would have to be.

Paper substrate: Regular papers without topcoat layer, meant for 250 gsm end-paper quality. Latex level of silica containing (10%) coatings was increased stepwise 8 to 10 and 12 pph. Coating colours were applied via Bird applicator (laboratory applicator, yield of the coating on the paper was 5-7 g/m$^2$→quite low but trend should be observable). Papers were calendered (2 passes with 2000 daN nip load and 75° C. temperature of steel roll) and tested in laboratory.

TABLE 9

Formulations for the evaluation of influence of Latex binder content
Coating Colour Composition in %

| Product/Trial-Nr. | SC | Ref 1 | 2 2 | 4 3 | Stand. 4 |
|---|---|---|---|---|---|
| Setacarb HG | 75.0 | 90 | 90 | 90 | 100 |
| Litex | 50.0 | 8 | 10 | 12 | 8 |
| Starch | 25.0 | 0.4 | 0.4 | 0.4 | 0.4 |
| PVOH | 22.0 | 1.8 | 1.8 | 1.8 | 1.8 |
| Thickener | 30.0 | 0.0 | 0.0 | 0.0 | 0.024 |
| Calciumstearat | 50.0 | 0.700 | 0.700 | 0.700 | |
| | 1 | | | | |
| Syloid C803 | 99.4 | 10.0 | 10.0 | 10.0 | |
| Based on pigment atro | | 250 | 250 | 250 | 250 |
| Solids | | 70.50 | 70.00 | 69.51 | 69.24 |
| Solids target A | | 60.00 | 60.00 | 60.00 | |

The results are summarised in table 10:

TABLE 10

Results of the evaluation of influence of Latex binder content

| Topcoat | Thumb dry | White gas dry (cotton tip) | solids | Print gloss Tappi 75 | Print gloss Din 75 | Print gloss Din 45 |
|---|---|---|---|---|---|---|
| 1 | 1 h | 1-2 h | 60.0% | 65.88 | 25.05 | 11.40 |
| 2 | 1 h | 1 h | 59.7% | 74.17 | 33.16 | 17.77 |
| 3 | 2 h | 3 h | 60.5% | 80.63 | 39.23 | 22.80 |
| 4 | 3-4 h | >5 h | 68.9% | 87.42 | 38.58 | 22.96 |

FIG. 28 shows the multicolour ink setting for the different samples, wherein the reference (ref) comprises eight parts, and the subsequent samples 2 and 3 comprise more latex in increasing steps of 2. Only the standard (Stand) formulation does not comprise silica. Numerically evaluated one obtains the data as given in table 11.

TABLE 11

Averaged ink setting times at 2 minutes, six minutes and 10 minutes (MCIS-test)

| | Ref (8 parts) | +2 litex (10 parts) | +4 litex (12 parts) | Stand |
|---|---|---|---|---|
| 2 min. | 1.15 | 2.03 | 1.97 | 1.71 |
| 6 min. | 0.76 | 1.11 | 1.39 | 1.02 |
| 10 min | 0.77 | 1.03 | 1.15 | 0.82 |

FIG. 29 shows the set off for the same samples as a function of time on a shorter time scale. The corresponding numerical values are summarised in table 12.

TABLE 12

Averaged ink setting for shorter timescales (set off test).

| | Ref (8 parts) | +2 parts (10 parts) | +4 parts (12 parts) | Stand. |
|---|---|---|---|---|
| 15 sec. | 0.44 | 0.61 | 0.62 | 0.85 |
| 30 sec. | 0.18 | 0.46 | 0.46 | 0.69 |
| 60 sec. | 0.05 | 0.18 | 0.22 | 0.37 |
| 120 sec. | 0.04 | 0.06 | 0.10 | 0.18 |

CONCLUSIONS

- Short time ink setting (set off) is slowed down by use of more latex (no significant additional difference for +2 and +4 pph latex observed) but still faster than reference paper.
- Print gloss is increased, if more latex is added (caused by slower set off).
- Long time ink setting speed (multicolour ink setting) is also decreased with more latex (slower than reference paper).
- Ink drying time (thumb test) does not increase, if 2 pph extra latex is added.
- Adding 4 extra parts slows down ink drying, level obtained with +4 pph latex is still better than reference. Print gloss is comparable to reference (DIN 75 and DIN 45 values)

Experimental Results, Part 6

The aim of this part is to determine an optimum concept for middle and top coatings with silica to improve physical and chemical ink drying.

Experiment: Paper substrate: Regular papers without middle and top coating layer, meant for 250 gsm end paper. Prepared middle and top coatings were applied on laboratory-coater (coated just on one side, pre coating application 12 gsm, top coating application 12 gsm). Papers were calendered (2 passes with 2000 daN nip load and 75° C. temperature of steel roll) and tested in laboratory.

The trials according to Table 13 were carried out:

TABLE 13

Trials for evaluation of middle coating

| Trial number | First coating layer | Second coating layer |
|---|---|---|
| 45 | Precoat 2 | TC2 |
| 47 | Precoat 2 | TC6 |
| 48 | Precoat 3 | TC1 |
| 49 | Precoat 3 | TC2 |
| 50 | Precoat 3 | TC3 |
| 53 | Precoat 3 | TC6 |

The following formulations were used for the trials (see table 14):

TABLE 14

Formulations for the trial according to experimental part 6.

| Product/Trial-Nr. | SC | Precoat 2 2 | Precoat 3 3 | TC1 4 | TC2 5 | TC3 6 | TC6 9 |
|---|---|---|---|---|---|---|---|
| Setacarb HG | 75.0 | | | 100.0 | 95.0 | 90.0 | 90.0 |
| Hydrocarb 95 | 78.0 | 95.0 | 100.0 | | | | |
| Syloid C803 | 99.4 | 5.0 | | | 5.0 | 10.0 | 10.0 |
| Latex | 50.0 | 11.5 | 11.0 | | | | |
| Litex | 50.0 | | | 8.0 | 8.0 | 8.0 | 10.0 |
| Starch | 25.0 | 1.0 | 1.0 | 0.4 | 0.4 | 0.4 | 0.4 |
| CMC | 20.0 | 0.3 | 0.3 | | | | |
| PVOH | 22.0 | 0.3 | 0.3 | 1.8 | 1.8 | 1.8 | 1.8 |
| Thickener | 30.0 | | | 0.027 | 0.027 | 0.027 | 0.027 |
| Calciumstearate | 50.0 | 1.0 | 1.0 | 0.7 | 0.7 | 0.7 | 0.7 |
| Based on pigment atro | | 700 | 1000 | 300 | 600 | 300 | 500 |
| Solids | | 71.90 | 71.42 | 69.07 | 69.78 | 70.50 | 70.00 |
| Solids target A | | 62 | 68 | 68 | 62 | 57 | 57 |
| Solids target B | | | | | | | |
| Solids target C | | | | | | | |

First applied coating layer is the middle or second coating; second applied coating layer is the top coating.

The results of the printing properties are summarised in table 15:

General fast short time ink setting is also responsible for low print gloss values—for further improvements latex level can be increased to damp this unwanted print gloss decrease slightly.

TABLE 15

Summary of the printing properties of experimental part 6

| | | Pre2 + TC2 | Pre2 + TC6 | Pre3 + TC1 = Reference | Pre3 + TC2 | Pre3 + TC3 | Pre3 + TC6 |
|---|---|---|---|---|---|---|---|
| Set off | | | | | | | |
| Set-off 15 sec. | top wire | 0.41 | 0.23 | 0.58 | 0.34 | 0.10 | 0.23 |
| Set-off 30 sec. | top wire | 0.13 | 0.06 | 0.24 | 0.10 | 0.03 | 0.06 |
| Set-off 60 sec. | top wire | 0.03 | 0.02 | 0.05 | 0.02 | 0.01 | 0.01 |
| Set-off 120 sec. | top wire | 0.01 | 0.01 | 0.02 | 0.01 | 0.00 | 0.00 |
| Printing gloss | | | | | | | |
| paper gloss Tappi 75° | top | 69.8 | 67.3 | 76.5 | 69.6 | 62.1 | 68.7 |
| print gloss Tappi 75° | top | 89.2 | 84.6 | 91.4 | 86.2 | 72.0 | 86.7 |
| Delta Printing gloss | top | 19.4 | 17.3 | 14.9 | 16.6 | 9.9 | 18.0 |
| Chemical ink drying | | | | | | | |
| White gas test (cotton tip) | top h | 2-3 | 2-3 | 7 | 2-3 | 1-2 | 2-3 |
| White gas test (cotton tip) | wire h | | | | | | |

CONCLUSIONS

Different top coatings on Standard middle coating (PC_3):

Addition of 5 and 10% silica (Syloid C803) leads to a stepwise increased short time ink setting speed (set off) which is not advantageous for runnability at printing press but set off level can be slowed down by an appropriately increased latex amount.

The higher the amount of silica used in top coating formulations the faster are the analysed white gas test values (cotton tip). With 10% of Syloid C803 physical and chemical ink drying is improved from 7 hours (reference) to 1-2 hours (measured under laboratory conditions).

The higher silica amount in top coating the lower is paper gloss level of produced paper.

Experimental Results, Part 7

For verification a further set of experiments was carried out with the formulations for the middle coatings as given in table 2 and with top coatings according to table 16.

TABLE 16

Formulations of top coatings

| trial order | solid [%] | Top coat TC_1 | Top coat TC_3 |
|---|---|---|---|
| HC 60 | 78 | 3 | |
| HC 90 | 76.5 | 15 | |
| Pigment SFC | 72 | 72 | 77 |
| Pigment Syloid C803 | 98 | | 8 |
| Amazon | 72 | 10 | 15 |
| Acronal | 50 | 6.5 | 8.5 |
| Latex | 50 | 1 | 1 |

TABLE 16-continued

| Formulations of top coatings | | | |
|---|---|---|---|
| | solid | Top coat | |
| trial order | [%] | TC_1 | TC_3 |
| CMC | 93.5 | 0.5 | 0.5 |
| PVOH | 20 | 1.2 | 1.2 |
| Fluocast | 50 | 0.55 | 0.55 |
| Polysalz S | 45 | 0.1 | 0.1 |

Experimental Results, Part 8

A further more detailed analysis was carried out in order to assess the possibility of using chemical drying aids in the coatings in combination with silica and in order to test the possibility of using the papers according to the present invention without having to use anti-set-off powder.

Anti Set-off Powders are blends of pure food starches with anti-caking and flow agents added and are available in a wide range of particle sizes (~15 to ~70 μm). The starch can be tapioca, wheat, maize, or potato. When sprinkled over the printed surface, it prevents the front or printed side of a substrate from intimately contacting the back or unprinted side of a next substrate. The starch particles act as spacers.

Offset powder obviously plays a very important role in a converting application that uses inks requiring oxidation to reach their final properties. Although offset powders are very beneficial, they can contribute detrimental characteristics. In applications in which a printed substrate is subject to further converting when perfect surface appearance is a requirement, use of offset powders may not be appropriate. E.g. in case of a printed substrate that will undergo lamination with an adhesive to a clear film. The application may be a label on which gloss and an optically perfect appearance are necessary. The dusting of offset powder acts like a sprinkling of dirt or other contaminant: It will produce surface imperfections in the laminate and seriously detract from the final appearance. They become entrapped in the lamination and contribute a "hills-and-valleys" appearance. This may be on a very small scale, but it is often enough to lead to an unsatisfactory appearance on close inspection. Another application in which the use of offset powder may not be appropriate is on a printed substrate used to make labels for the in-mould label process. In this process, a printed label on a plastic substrate becomes an integral part of an injection- or blow-moulded container during the moulding operation. For the popular "no-label" look, the optical characteristics must be such that the consumer cannot see the label under any circumstances. Specks of offset powder, dust, or anything similar would detract from the appearance of such a label and make it unsatisfactory.

Therefore the need for finding paper a substrates which eliminate the use of such powders.

On a conventional woodfree paper coatings were applied with formulations as given in the subsequent tables, wherein the substrate was coated on both sides with a precoat layer in a coat weight of 11 gsm, and a top coat layer of also 11 gsm.

The formulations of the precoat layers as investigated are given in table 17, and the formulations of the top coat layers and how they are combined with the precoat layers is given in table 18:

TABLE 17

| Formulations of precoatings | | | | | | | | |
|---|---|---|---|---|---|---|---|---|
| | solids | pre coat: | | | | | | |
| | [%] | V6 | V7 | V8 = V6 | V9 = V6 | V10 = V6 | V11 = V6 | V12 = V7 |
| HC 60 M HH | 78 | | 43 | | | | | 43 |
| HC 90 | 75 | | 45 | | | | | 45 |
| HC 95 M HH | 78 | 100 | | 100 | 100 | 100 | 100 | |
| Pigment Syloid C803 | 99.4 | | 12 | | | | | 12 |
| Binders/additives | | | | | | | | |
| Latex | 50 | 9 | 11.5 | 9 | 9 | 9 | 9 | 11.5 |
| PVOH | 22 | 0.3 | 0.3 | 0.3 | 0.3 | 0.3 | 0.3 | 0.3 |
| Polysalz S | 40 | | 0.1 | | | | | 0.1 |

TABLE 18

| Formulations of top coat | | | | | | | | |
|---|---|---|---|---|---|---|---|---|
| | | IID_6 | IID_7 | IID_8 | IID_9 | IID_10 | IID_11 | IID_12 |
| | | pre coat: | | | | | | |
| | | V10 | V12 | V8 | V9 | V6 | V11 | V7 |
| | solid | top coat | | | | | | |
| | [%] | D6 | D7 | D8 | D9 | D10 | D11 | D12 = D6 |
| HC 60 M HH | 78 | 3 | 3 | | | | | 3 |
| HC 90 | 75 | 15 | 15 | | | | | 15 |
| HC 95 M HH | 78 | | | | | | | |
| SFC | 72 | 72 | 72 | 77 | 73 | 70 | 77 | 72 |
| Amazon 88 | 74 | 10 | 10 | 15 | 15 | 15 | 15 | 10 |
| Pigment Syloid C803 | 99.4 | | | 8 | 12 | 15 | 8 | |
| Latex Acronal | 50 | 8.0 | 8.0 | 10.0 | 10.0 | 10.0 | 10.0 | 8.0 |
| Latex | 50 | 1.0 | 1.0 | 1.0 | 1.0 | 1.0 | 1.0 | 1.0 |
| PVOH | 22 | 0.5 | 0.5 | 0.5 | 0.5 | 0.5 | 0.5 | 0.5 |
| Polysalz S | 40 | 0.1 | 0.1 | 0.1 | 0.1 | 0.1 | 0.1 | 0.1 |
| Manganese Acetate | 100 | 1.5 | | | | | 1.5 | 1.5 |

All coatings have good runnability without scratches and there is a high glossability of the papers—paper gloss level (55% DIN 75°) was reached with 200 kN/m nip load.

The higher the silica amount used in top coating, normally the lower the paper gloss. Addition of manganese acetate has no significant influence on paper gloss. Use of silica in pre coating leads to slightly lower paper gloss of top coated paper (before calendering).

Preferentially Mn(II) acetate is used because of many advantages above other catalyst systems, and it has to be pointed out that the use of such manganese complexes is, as already pointed out above, is not limited to the present coatings but can be extended to any other coating. The manganese acetate system is characterised by no smell, a lower price, more easily water soluble salt, smaller effect on brightness/shade, no environmental/health issues. As a matter of fact for full catalytic activity of such a system, it seems to be advantageous to have Mn(II) as well as Mn(II) in the coating (top coating or second coating beneath the top coating) at the same time. Optimum activity is achieved if Mn(II) and at least some III)acetate is present. One advantageous way to intrinsically introduce necessary Mn(III) acetate next to II-form at the same time creating a minimum amount of generally brownish and in fact rather water insoluble Mn(III) form is possible as follows:

a) addition of additional 0.1 pph Polysalz, in order to keep Mn-ions fully available as free catalytic species. It is suspected that if this constituent is not added, then most probably high valency Mn-ions will strongly interfere or even be bounded with calcium carbonate dispersions in coating, and will destabilise/coagulate them via interaction with double layers, so also coat quality is decreased, b) Mn(acetate) is slowly added as last component to topcoat composition, where it is preferred to start with most pH=8, 5-9. Higher pH up to 10 is possible and the result (some Mn(III)) is only satisfactory but the dissolving behaviour of Mn(acetate) is then better/quicker, c) after dissolving Mn(acetate) (as visually judged) it is also preferred to again adjust pH up to approximately 8.5 (pH generally goes down when dissolving acid reacting Mn(acetate)), d) Finally it seems to be beneficial to have additional mixing time (typically 30 minutes in present praxis) to fully dissolve Mn(acetate) to molecular level to have it all available for catalytic cycle.

Mn(acetate) is preferably present 0.1-0.6% Manganese (=II+III) in weight of the total dry weight of a top coating. Most preferred is the presence of 0.2-0.4%. It has to be noted that other Mn-salts/complexes are also possible, like Mn(II) acac. The sole catalytic activity of Mn(acetate) can be enhanced and/or supported via different measures: A) combination with secondary driers and/or auxiliary driers, B) combination with responsible ligands, so e.g. combined with bpy the activity is very high and almost equal to a system like Nuodex/bpy, so combined with other ligands activity can be significantly increased to attractive level, C) addition of systems like Li(acac), D) addition of peroxides (in properly stabilized but available form) to have necessary oxygen direct at spot without diffusional limitations.

As one can see from FIGS. 30 and 31, showing the white gas test (FOGRA) and the wet ink rub test results, respectively, paper IID_7 with reference top coating and silica in pre coating shows slowest physical and chemical drying tendency in laboratory. With silica in top coating it is possible to reach drying times of 3 or 2 hours (tail dry, for higher silica amounts). Paper IID_11: use of manganese acetate in combination with 8% silica led to a further improvement 2 hours (instead of 3 hours). In this case also the dot (more critical than tail) on tested paper is dry between 3 to 4 hours. Use of silica leads to improved wet ink rub (ink scuff) behaviour in laboratory. Addition of manganese acetate or silica in pre coating leads to further improvements.

As one can see from FIGS. 32 to 34, slowest ink setting is observed for paper IID_7 with silica in pre coating and reference top coating without silica or manganese acetate. An increased silica amount in top coating leads to faster initial ink setting behaviour. Use of silica in pre coating results in a slightly faster set-off compared to pre coating without silica. Short time as well as long time ink setting values are extremely small. Offset suitability (dry) as well as multi colour fibre picking level of all papers is rather low (offset suitability in most cases O— best valued for paper IID_7).

The specific chemical drying aid used in these experiments is $Mn(II)(Ac)_2.4H_2O$. It should be noted that this specific transition metal complex is a highly efficient chemical drying aid, and, while it shows synergistic effect in combination with silica, it is a generally useful chemical drying aid for use in top coatings or in precoatings. One of its advantages is its price but also the stability, the ease of handling and the fact that it somewhat influences the colour of the coatings provided with this chemical drying aid.

Printing Properties:

Papers tested (all 135 g/m$^2$): Scheufelen (manufacturer), BVS+8 (Name); D6; D7, D8, D9, D10; D11; D12 (all as given above). Printing conditions: Printer: Grafi-Media (Swalmen, NL); Press: Ryobi 5 colours; Inks in order of colour sequence: Sicpa Tempo Max B, C, M, Y; Printing speed: 11.000 sheets/h; anti-set-off powder: yes/no; Infra Red dryers: no.

Tests performed: Folding: cross fold (1 buckle, 1 knife, no creasing); ink scuff; White gas test; Blocking test (no anti-set-off powder). Testing times: ½ hour, 1 hour, 2 hours, 3 hours, 4 hours, 24 hours, >48 hours.

Results Blocking Test:

| | |
|---|---|
| D6 | Slight markings in 300% area |
| D7 | Very slight markings (better than D6) |
| D8 | Very slight markings in 300% area (~D6) |
| D9 | No markings |
| D10 | No markings |
| D11 | Very slight markings in 300% area (a bit more than D6, but less than BVS+) |
| D12 | Slight markings in 300% area (a bit more than D6, but less than BVS+) |
| BVS+ | Markings |
| D8 with powder | No markings |
| D11 with powder | No markings |
| BVS+ with powder | No markings |

No paper presents blocking. The papers printed with anti-set-off powder do not present any markings. The paper with the most markings is BVS+. D9 and D10 (and also D8 and D11 to a slightly lesser extent) do not present any markings: they are printable without anti-set-off powder.

Results Folding Test:

The folding test has been done on a buckle folder. Contrarily to printer Haletra, there is no creasing module for the second fold, so that the folding is a bit less critical. The folding test is evaluated with help of a mark from 0 (no markings visible) to 5 (very strong markings). The results of the folding taste are summarised in table 19.

TABLE 19

| Results of the folding test | | | | | | |
|---|---|---|---|---|---|---|
| Paper | ½ hr | 1 hr | 2 hr | 3 hr | 4 hr | ∞ |
| D6 | 1.00 | 1.25 | 1.00 | 1.00 | 1.00 | 0.25 |
| D7 | 0.75 | 0.75 | 0.75 | 0.75 | 0.75 | 0.75 |
| D8 | 0.25 | 0.25 | 0.25 | 0.25 | 0.25 | 0.25 |
| D9 | 0.50 | 0.50 | 0.50 | 0.50 | 0.50 | 0.50 |
| D10 | 0.75 | 0.75 | 0.75 | 0.75 | 0.75 | 0.75 |
| D11 | 0.75 | 0.75 | 0.75 | 0.75 | 0.75 | 0.75 |
| D12 | 1.00 | 1.00 | 1.00 | 1.00 | 1.00 | 0.75 |
| BVS+ | 1.00 | 1.00 | 1.00 | 1.00 | 1.00 | 0.75 |
| D8 with powder | 0.25 | 0.25 | 0.25 | 0.25 | 0.25 | 0.25 |
| D11 with powder | 0.75 | 0.75 | 0.75 | 0.75 | 0.75 | 0.75 |
| BVS+ with powder | 0.25 | 0.25 | 0.25 | 0.25 | 0.25 | 0.25 |

The general level of markings at the fold has been evaluated by a group of experts (printers) as very good. There is little to no difference in the markings between ½ hour and ∞ (=a week), which would imply that the chemical drying has small additional effect on the folding test. There are only small differences between the papers.

Results Ink Scuff:

The wet ink rub test has been performed on the printed sheets, on the 300% area B, C, M. The results of this test are summarised graphically in FIG. 35. All papers show a very good level of ink scuff in general. The best paper is D11, followed by D7, D8, then D9 and D10. D6, D12 and BVS+ have similar levels of markings.

Results White Gas Test (FOGRA):

The white gas test (tail dry) has been performed on the printed sheets, on the 300% area B, C, M. The results are summarised in table 20.

TABLE 20

| White gas test results, all values single data points | |
|---|---|
| Paper | White gas drying time (hr) |
| D6 | 4 < t < 24 |
| D7 | 3 |
| D8 | ≧4 |
| D9 | ½ |
| D10 | ½ |
| D11 | 3 |
| D12 | ≧4 |
| BVS+ | 4 < t < 24 |
| D8 with anti set-off powder | ≧4 |
| D11 with anti set-off powder | 3 |
| BVS+ with anti set-off powder | 4 < t < 24 |

The fastest papers are D9 and D10, which are dry after ½ hour. The slowest paper is BVS+, followed by D6.

The following conclusions can be drawn from this experimental part:

D9 and D10 are printable without any anti-set-off powder.

D7, and also D11 are also printable without anti-set-off powder (only slight markings on critical areas)

For the wet ink rub test, the levels are very good, but D11, followed by D7 and D8 showed the best results.

Experimental Results, Part 9

In the above examples, in particular Syloid C803 is used, which is an example for a silica gel. On the other hand, as outlined in the introductory portion, this silica gel may also be replaced by precipitated silica, as long as this precipitated silica has corresponding specific surface properties. In order to prove that, in the following examples shall be given for precipitated silica, in particular for the products available from Degussa under the name Sipemat, and the experiments shall be compared with corresponding paper substrates with coatings with silica gel pigment parts allowing a comparison with all the above-mentioned experiments. The two types of precipitated silica which have been tested are Sipemat 310 as well as Sipemat 570. These precipitated silica pigments have the properties as given in table 22 below.

Prepared top coatings were applied on a laboratory-coater on a regular paper substrate without top coat layer, meant for 115 gsm end-paper i.e. on a substrate only with regular pre coat composition. For all coatings latex level was kept constant at a level of 12 pph. Papers were calendered (10 passes with 1000 daN nip load and 70° C. temperature of steel roll) and tested in laboratory.

Formulations of the examples with precipitated silica and the comparative examples with silica gel are given in table 21, all values are parts in weight:

TABLE 21

| Formulations of part 9 | | | | | | | |
|---|---|---|---|---|---|---|---|
| | solid | Top coat | | | | | |
| | [%] | TC_2 | TC_3 | TC_4 | TC_5 | TC_15 | Ref. |
| CC85 | 72.0 | | | | | | 100 |
| Pigment SFC | 72.1 | 80 | 80 | 80 | 80 | 80 | |
| Setacarb GU | 75.0 | | | | | | |
| Gasil 35M | 99.0 | 20 | | | | | |
| Sipernat 310 | 99.0 | | 20 | | | | |
| Syloid C803 | 99.0 | | | 20 | | | |
| Sipernat 570 | 99.0 | | | | | 20 | |
| Sylojet 710A | 20.0 | | | | 20 | | |
| Latex | 50.0 | 12 | 12 | 12 | 12 | 12 | 9 |
| PVA | 18.0 | 1 | 1 | 1 | 1 | 1 | 1 |
| CMC | 93.5 | 0.28 | | | | | 0.2 |
| Polysalz S | 50.0 | 0.3 | 0.3 | 0.2 | | | |

In order to further characterise the coatings which can be used in accordance with the present invention, mercury intrusion measurements were made to determine the porosity of the final coating The results of the mercury intrusion measurements are given in FIG. 36. In comparison with the reference (Ref.) one notices that in the range below 0.02 μm, i.e. in particular in the range between 0.01 and 0.02 μm, the porosity of the coatings according to the invention is higher than the one of the reference. One therefore notices an increased porosity (sometimes even a "peak") in and partly also below this range, which is likely to contribute and to be key to the physical ink adsorption process.

The resulting ink drying properties (Fogra white gas tests) of these examples are summarised graphically in FIG. 37 (single data points). One can see, that in terms of tail dryness as well as in terms of dot dryness the use of precipitated silica with these specific properties (high surface area and small particle sizes) indeed proves to be similar to the use of silica gel. It was found that attractively fast ink drying is governed by high-pore-volume type silica-gel pigments Syloid C803 and Gasil 35M. It appeared that 20 pph of highly sophisticated (e.g. very high BET surface 750 $m^2/g$) precipitated silica types Sipemat 570 and (somewhat less Sipernat 310) govern ink drying performance comparable to that of 20 pph Syloid C803.

Materials:

Inorganic pigments: The particle size distributions of used inorganic pigments are given in FIG. 38. The proper choice of the particle size distribution is important for the final paper and print gloss and for the ink setting properties. SFC stands for a steep fine carbonate with a specific surface area of 18 $m^2/g$.

Silica: physical and chemical ink drying tendency of all silica containing papers was extremely fast—also other types of silica (Sylojet 710A and Sylojet 703A also from Grace Davison) are working (not only Syloid C803). Syloid C803 is used because this product is available as powder which allows higher solids content of coating colour and is cheaper than others. Some of the main properties of the silica gels (Sylojet and Gasil) and precipitated silicas (Sipemat) are summarised in table 22.

TABLE 22

Properties of silica used based on data supplied by supplier

| Product | Pore Volume (ml/g) | Average particle size (μm) | Surface area ($m^2/g$) BET | Surface charge | pH | Oil absorption g/100 g | Solids content (%) |
|---|---|---|---|---|---|---|---|
| Sylojet P403 (=Syloid C803) | 2.0 | 3.5* | 300-330 | Anionic | 3.5 | 320 | 99 |
| Sylojet 703A | 0.7 | 0.3* | 250 | Anionic | 8 | | 20 |
| Sylojet 710A | 0.9 | 1.0* | 250 | Anionic | 8 | | 20 |
| Gasil 35M | 1.2 | 4.0 | — | Anionic | 7 | 200 | 99 |
| Gasil 23D | 1.8 | 4.4 | — | Anionic | 7 | 290 | 99 |
| Sipernat 310 | — | 5.5** | 750 | Anionic | 6 | 210 (DBP) | 99 |
| Sipernat 570 | — | 6.7** | 750 | Anionic | 6 | 259 (DBP) | 99 |

*measured via Malvern Master Sizer 2000

**measured in 100 micrometer capillary, Multisizer

Use of silica in pre coating colour in combination with standard top coating colour improves ink drying (investigated in laboratory) significantly.

Binders: all the binders mentioned here are a commercially available and therefore their properties are accessible to the public. For example Litex P 2090 is an aqueous dispersion of a copolymer of styrene and n-butylacrylate. Acronal S360D is a copolymer of styrene and acrylic ester available from BASF, DE.

LIST OF REFERENCE NUMERALS

1 substrate; 2 second layer; 3 top layer; 4 coated printing sheet

The invention claimed is:

1. Coated printing sheet for sheet-fed offset printing with an image receptive coating layer on a paper substrate, wherein the image receptive coating layer comprises a top layer and optionally at least one second layer below said top layer, said top layer or said second layer comprising:

a pigment part, wherein this pigment part is composed of 75 to 99 parts in dry weight of a fine particulate carbonate and/or of a fine particulate kaolin and/or of a fine particulate clay 1 to 25 parts in dry weight of a fine particulate silica selected from the group consisting of: amorphous silica gel; amorphous precipitated silica with a surface area above 150 m2/g, and a binder part, wherein the binder part is composed of: 5-20 parts in dry weight of binder and less than 4 parts in dry weight of additives, wherein the total surface energy of the image receptive coating layer is less than or equal to 30 mN/m and wherein the dispersive part of the total surface energy is less than or equal to 18 mN/m.

2. The printing sheet according to claim 1, wherein the silica has an internal pore volume above 0.2 ml/g.

3. The printing sheet according to claim 1 or 2, wherein the pigment part is composed of 6-25 parts in dry weight of silica gel and/or precipitated silica, and 75-94 parts in dry weight of carbonate and/or kaolin and/or clay.

4. The printing sheet according to claim 1 or 2, wherein the silica is an amorphous precipitated silica with a surface area above 500 $m^2/g$.

5. The printing sheet according to claim 1 or 2, wherein the silica has an internal pore volume above or equal to 1.8 ml/g.

6. The printing sheet according to claim 1 or 2, wherein the image receptive coating layer has a cumulative porosity volume as measured by mercury intrusion of pore widths in the range of 8-20 nm of more than 9 ml/(g total paper), or wherein the cumulative porosity volume in a range of 8-40 nm is more than 13 ml/(g total paper).

7. The printing sheet according to claim 1 or 2, wherein the total surface energy of the image receptive coating layer is less than or equal to 28 mN/m.

8. The printing sheet according to claim 1 or 2, wherein the dispersive part of the total surface energy is less than or equal to 15 mN/m.

9. The printing sheet according to claim 1 or 2, wherein the top layer as well as the second layer comprise a pigment part.

10. The printing according to claim 1 or 2, wherein the pigment part comprises 80-95 parts in dry weight of a fine particulate carbonate and/or of a fine particulate kaolin and/or of a fine particulate clay and 5 to 20 parts in dry weight of a fine particulate silica.

11. The printing sheet according to claim 1 or 2, wherein the pigment part comprises 8-10 parts in dry weight of a fine particulate silica.

12. The printing sheet according to claim 1 or 2, wherein in the case of a silica gel the pigment part comprises a fine particulate silica with a particle size distribution such that the average particle size is in the range of 0.1-5 μm, or in case of a precipitated silica the pigment part comprises a fine particulate precipitated silica with a particle size distribution such that the average particle size is in the range of 5-7 μm.

13. The printing sheet according to claim 1 or 2, wherein the pigment part comprises a fine particulate silica with a particle size distribution such that the average particle size is in the range of 0.3-1 μm or in the range of 3-4 μm.

14. The printing sheet according to claim 1 or 2, wherein the pigment part comprises a fine particulate silica with a surface area of at least 300 $m^2/g$.

15. The printing sheet according to claim 14, wherein the pigment part comprises a fine particulate silica with a surface area in the range of 200-1000 $m^2/g$.

16. The printing sheet according to claim 1 or 2, wherein the pigment part comprises 70-80 parts in dry weight of a fine particulate carbonate, with a particle size distribution such that 50% of the particles are smaller than 1 μm.

17. The printing sheet according to claim 1 or 2, wherein the pigment part comprises 10-25 parts in dry weight of a fine particulate kaolin or clay.

18. The printing sheet according to claim 1 or 2, wherein that the pigment part comprises a fine particulate kaolin or clay with a particle size distribution such that 50% of the particles are smaller than 1 μm.

19. The printing sheet according to claim 1 or 2, wherein the binder part comprises 7-12 parts in dry weight of a binder.

20. The printing sheet according to claim 1 or 2, wherein the binder part comprises a binder or a mixture of binders selected from the group consisting of latex, in particular styrene-butadiene, styrene-butadiene-acrylonitrile, styrene-acrylic, in particular styrene-n-butyl acrylic copolymers, styrene-butadiene-acrylic latexes, acrylate vinylacetate copolymers, starch, polyacrylate salt, polyvinyl alcohol, soy, casein, carboxymethyl cellulose, hydroxymethyl cellulose and copolymers as well as mixtures thereof.

21. The printing sheet according to claim 1 or 2, wherein the binder is an acrylic ester copolymer based on at least one of butylacrylate, styrene and acrylonitrile.

22. The printing sheet according to claim 1 or 2, wherein the binder part comprises at least one additive selected from the group consisting of defoamers, colorants, brighteners, dispersants, thickeners, water retention agents, preservatives, crosslinkers, lubricants and pH control agents or mixtures thereof.

23. The printing sheet according to claim 1 or 2, wherein the top coat of the image receptive layer comprises a pigment part, wherein the pigment part is composed of 80-95 parts in dry weight of a fine particulate carbonate and of a fine particulate kaolin or clay and 6 to 25 parts in dry weight of a fine particulate silica.

24. The printing sheet according to claim 1 or 2, wherein the top coat of the image receptive layer comprises a pigment part comprising 70-80 parts in dry weight of a fine particulate carbonate with a particle size distribution such that 50% of the particles are smaller than 0.4 μm, 10-15 parts in dry weight of a fine particulate kaoline or clay with a particle size distribution such that 50% of the particles are smaller than 0.3 μm, 8-12 parts in dry weight of a fine particulate silica with an average particle size between 3-5 μm and a surface area of 300-400 $m^2/g$ and with an internal pore volume above 0.5 ml/g, and a binder part comprising 8-12 parts in dry weight of a latex binder and less than 3 parts in dry weight of additives.

25. The printing sheet according to claim 1 or 2, wherein said coated printing sheet is calendered.

26. The printing sheet according to claim 1 or 2, wherein said coated printing sheet is one of a matt, glossy or a satin paper.

27. The printing sheet according to claim 1 or 2, characterised in case of a glossy paper by a gloss on the surface of the image receptive coating of more than 75% according to TAPPI 75 deg or of more than 50 according to DIN 75 deg, or characterised in case of a matt paper by a gloss on the surface of the image receptive coating of less than 25% according to TAPPI 75 deg, or characterised in case of a satin paper by a gloss on the surface of the image receptive coating in the intermediate range.

28. The printing sheet according to claim 1 or 2, wherein an image receptive coating layer is provided on both sides of the substrate.

29. The printing sheet according to claim 1 or 2, wherein the substrate is a woodfree paper substrate.

30. The printing sheet according to claim 1 or 2, wherein the image receptive coating layer has a second layer beneath said top layer comprising: a pigment part, wherein this pigment part is composed of 80-98 parts in dry weight of a mixture of or a single fine particulate carbonate, with a particle size distribution such that 50% of the particles are smaller than 2 μm, 2-25 parts in dry weight of a fine particulate silica, and a binder part, wherein the binder is composed of:

8-15 parts in dry weight of latex or starch binder, and less than 4 parts in dry weight of additives.

31. The printing sheet according to claim 30, wherein the fine particulate carbonate of the pigment part consists of a mixture of one fine particulate carbonate with a particle distribution such that 50% of the particles are smaller than 2 μm, and of another fine particulate carbonate with a particle distribution such that 50% of the particles are smaller than 1 μm.

32. The printing sheet according to claim 30, wherein the pigment part comprises 5-15 parts in dry weight of silica.

33. The printing sheet according to claim 1 or 2, wherein it is re-printable and convertable within less than 0.5 hours.

34. The printing sheet according to claim 1 or 2, wherein at least a fraction of the pigment part comprises or is selectively enriched in traces of transition metals, wherein at least one metal is present in the silica and/or the other pigments in more than 500 ppb.

35. The printing sheet according to claim 34, wherein Co, Mn, V, Ce, Fe, Cr, Ni, Rh, Ru, or combinations thereof, present in the pigment in more than 10 ppb up to 10 ppm, and/or in case of Ce up to 20 ppm and/or in case of Fe up to 100 ppm, possibly in combination with Zr, La, Nd, Al, Bi, Sr, Pb, Ba or combinations thereof, present in the pigment in more than 10 ppb up to 20 ppm, possibly in combination with Ca, K, Li, Zn and combinations thereof, present in the pigment in more than 10 ppb up to 10 ppm or 20 ppm.

36. The printing sheet according to claim 35, wherein a combination is selected from Co+Mn, Co+Ca+Zr or La or Bi or Nd, Co+Zr/Ca, Co+La, Mn+K and/or Zr.

37. The printing sheet according to claim 1 or 2, wherein the top coat and/or the second layer further comprises a chemical drying aid, selected from a transition metal complex, a transition metal carboxylate complex, a manganese complex, a manganese carboxylate complex and/or a manganese acetate complex or a mixture thereof, wherein the chemical drying aid is present in 0.5 to 3 parts in dry weight.

38. The printing sheet according to claim 1 or 2, wherein the top coat and/or the second layer further comprises a chemical drying aid, wherein the chemical drying aid acts as a catalytic system and is given by a manganese complex, a manganese carboxylate complex and/or a manganese acetate or acetylacetate complex, and wherein the metal part of the catalyst system is present in the coating in 0.05-0.6 weight-%, of the total dry weight of the coating.

39. The printing sheet according to claim 30, wherein the pigment part comprises 5-15 parts in dry weight of silica.

40. Method for making a printing sheet according to claim 1 or 2, wherein a silica comprising coating formulation is applied onto a precoated or on coated paper substrate, preferably on woodfree basis, using a curtain coater, a blade coater, a roll coater, a spray coater, an air knife, cast coating and/or a metering size press.

41. Method for making a printing sheet according to claim 40, wherein the coated paper is calendered at a speed of in the range of 200-2000 m/min, at a nip load of in the range of 50-500 N/mm and at a temperature above room temperature, preferably above 60° Celsius, even more preferably in the range of 70-95° Celsius using between 1 and 15 nips.

42. Use of a printing sheet according to claim 1 in a sheet fed offset printing process, wherein in that process reprinting and converting takes place within less than one hour, preferably within less than 0.5 hours, preferably it is reprinted within less than 30 minutes, even more preferably within less than 15 minutes and converted within less than one hour, preferably within less than 0.5 hours.

* * * * *